US008415888B2

(12) United States Patent
Ishihara

(10) Patent No.: US 8,415,888 B2
(45) Date of Patent: Apr. 9, 2013

(54) ILLUMINATION CONTROL TERMINAL AND ILLUMINATION CONTROL SYSTEM

(75) Inventor: Asami Ishihara, Nara (JP)

(73) Assignee: Panasonic Corporation, Osaka (JP)

( * ) Notice: Subject to any disclaimer, the term of this patent is extended or adjusted under 35 U.S.C. 154(b) by 276 days.

(21) Appl. No.: 13/031,912

(22) Filed: Feb. 22, 2011

(65) Prior Publication Data

US 2011/0204827 A1 Aug. 25, 2011

(30) Foreign Application Priority Data

Feb. 23, 2010 (JP) ..... 2010-037754
May 21, 2010 (JP) ..... 2010-117560

(51) Int. Cl.
*H05B 37/00* (2006.01)

(52) U.S. Cl.
USPC ..... 315/193; 315/192; 315/209 R; 315/291; 315/292

(58) Field of Classification Search ..... 315/209 R, 315/210, 225, 226, 72, 119, 121, 192, 186, 315/193, 312, 313, 318, 319, 360, 362
See application file for complete search history.

(56) References Cited

U.S. PATENT DOCUMENTS

| | | | | |
|---|---|---|---|---|
| 6,658,303 | B2 | 12/2003 | Hatemata et al. | |
| 7,933,265 | B2 | 4/2011 | Kawamata | |
| 2001/0014832 | A1 | 8/2001 | Hatemata et al. | |
| 2005/0227761 | A1 * | 10/2005 | Yoshino et al. | 463/30 |

FOREIGN PATENT DOCUMENTS

| | | |
|---|---|---|
| JP | 2001175306 | 6/2001 |
| JP | 2002-016987 | 1/2002 |
| KR | 10-2001-0073647 | 8/2001 |
| KR | 10-2007-0094484 | 9/2007 |

* cited by examiner

*Primary Examiner* — Douglas W Owens
*Assistant Examiner* — Jianzi Chen
(74) *Attorney, Agent, or Firm* — Bacon & Thomas, PLLC

(57) ABSTRACT

An illumination control terminal includes a frame; a handle cover pivotably rotatably attached to the frame. An operation switch unit is arranged on a front surface of the handle cover. Provided on a rear surface of the handle cover are a setting operation unit for setting a set time at which lamps are turned on or off and a locking portion which keeps the handle cover in a closed state. Provided on a front surface of the frame are a display unit for displaying setting contents and a locked portion engaging with the locking portion. The terminal further includes a storage unit storing a setting program set by the setting operation unit and a terminal control unit for outputting a control signal on an on/off operation of the lamps, either upon pushing the operation switch unit or according to the setting program.

14 Claims, 37 Drawing Sheets

| LAMP | ADDRESS |
|---|---|
| 1 | 1-1 |
| 2 | 1-2 |
| 3 | 1-3 |
| 4 | 1-4 |
| 5 | 1-5 |
| 6 | 1-6 |
| 7 | 1-7 |
| 8 | 1-8 |

| GROUP | ADDRESS |
|---|---|
| G1 | 1-1, 1-2, 1-3, 1-4 |
| G2 | 2-1, 2-2, 2-3, 2-4 |
| G3 | 1-2, 1-4 |
| G4 | 2-2, 2-4 |

| OPERATION PANEL | GROUP |
|---|---|
| SWa | G1 |
| SWb | G2 |

*FIG. 5*

| PR NO. | GROUP | TURNING-ON | FORENOTICE TURNING-OFF | TURNING-OFF | CONTROL DAY |
|---|---|---|---|---|---|
| 1 | G3, G4 | | 12:00 | | MONDAY-FRIDAY |
| 2 | G1, G2 | | | 12:05 | MONDAY-FRIDAY |
| 3 | G3, G4 | | 18:00 | | MONDAY-FRIDAY |
| 4 | G2 | | | 18:05 | MONDAY-FRIDAY |
| 5 | G3 | | 23:00 | | MONDAY-FRIDAY |
| 6 | G1 | | | 23:05 | MONDAY-FRIDAY |

| LAMP | ADDRESS |
|---|---|
| 1 | 1-1 |
| 2 | 1-2 |
| 3 | 1-3 |
| 4 | 1-4 |
| 5 | 1-5 |
| 6 | 1-6 |
| 7 | 1-7 |
| 8 | 1-8 |

| GROUP | ADDRESS |
|---|---|
| G1 | 1-1, 1-2, 1-3, 1-4 |
| G2 | 2-1, 2-2, 2-3, 2-4 |
| G3 | 1-2, 1-4 |
| G4 | 2-2, 2-4 |

| OPERATION PANEL | GROUP |
|---|---|
| SWa' | G1 |
| SWb' | G3 |
| SWc' | G2 |
| SWd' | G4 |

FIG. 20A

PRa

| PR NO. | CONTROL TARGET | FORENOTICE TURNING-OFF | FORENOTICE TURNING-OFF DURATION (MIN) | TURNING-OFF TIME | CONTROL DAY | OPERATION PANEL | FLAG |
|---|---|---|---|---|---|---|---|
| 1 | G3 | 11:55 | 5 | -- | MONDAY-FRIDAY | SWb' | VALID |
| 2 | G1 | -- | -- | 12:00 | MONDAY-FRIDAY | SWa' | VALID |
| 3 | G3 | 17:55 | 5 | -- | MONDAY-FRIDAY | SWb' | VALID |
| 4 | G1 | -- | -- | 18:00 | MONDAY-FRIDAY | SWa' | VALID |
| 5 | G3 | 18:55 | 5 | -- | MONDAY-FRIDAY | SWb' | VALID |
| 6 | G1 | -- | -- | 19:00 | MONDAY-FRIDAY | SWa' | VALID |
| 7 | G3 | 19:55 | 5 | -- | MONDAY-FRIDAY | SWb' | VALID |
| 8 | G1 | -- | -- | 20:00 | MONDAY-FRIDAY | SWa' | VALID |
| : | : | : | : | : | : | : | : |

FIG. 20B

PRb

| PR NO. | CONTROL TARGET | REPEATED TURNING-OFF START | REPEATED TURNING-OFF END | TURNING-OFF TIME INTERVAL (MIN) | CONTROL DAY | FLAG |
|---|---|---|---|---|---|---|
| 1 | G2 | 17:00 | 05:00 | 60 | SATURDAY/SUNDAY | INVALID |
| 2 | G1 | 18:00 | 23:00 | 60 | MONDAY-FRIDAY | VALID |
| 3 | G2 | 19:00 | 22:00 | 30 | MONDAY-FRIDAY | VALID |
| 4 | : | : | : | : | : | : |

FIG. 21

| | | | | 1 | 2 | 3 | 4 |
|---|---|---|---|---|---|---|---|
| 8:00 | STARTING WORK | 1-1 | TURN ON MANUALLY | ● | ○ | ○ | ○ |
| 8:20 | | 1-2,1-3 | TURN ON MANUALLY | ● | ● | ● | ○ |
| 8:25 | | 1-4 | TURN ON MANUALLY | ● | ● | ● | ● |
| 11:55 | FORENOTICE TURNING-OFF | G3 | TURN OFF BY TIMER | ● | ○ | ● | ○ |
| 12:00 | LUNCH TIME | G1 | TURN OFF BY TIMER | ○ | ○ | ○ | ○ |
| 13:00 | AFTERNOON WORK | G1 | TURN ON MANUALLY | ● | ● | ● | ● |
| 17:55 | FORENOTICE TURNING-OFF | G3 | TURN OFF BY TIMER | ● | ○ | ● | ○ |
| 18:00 | FINISHING WORK | G1 | TURN OFF BY TIMER | ○ | ○ | ○ | ○ |
| 18:10 | | G1-G3 | TURN ON MANUALLY | ● | ● | ● | ● |
| 18:55 | FORENOTICE TURNING-OFF | G3 | TURN OFF BY TIMER | ● | ○ | ● | ○ |
| 19:00 | | G1 | TURN OFF BY TIMER | ○ | ○ | ○ | ○ |
| 19:10 | | G1-G3 | TURN ON MANUALLY | ● | ● | ● | ● |
| 19:55 | FORENOTICE TURNING-OFF | G3 | TURN OFF BY TIMER | ● | ○ | ● | ○ |
| 20:00 | | G1 | TURN OFF BY TIMER | ○ | ○ | ○ | ○ |
| 20:10 | | G1-G3 | TURN ON MANUALLY | ● | ● | ● | ● |
| ⋮ | | | | | | | |
| 23:00 | | | | ○ | ○ | ○ | ○ |

ILLUMINATION CONTROL TERMINAL AND ILLUMINATION CONTROL SYSTEM

FIELD OF THE INVENTION

The present invention relates to an illumination control terminal for outputting a control signal to control an on/off operation of an illumination load and an illumination control system including the illumination control terminal.

BACKGROUND OF THE INVENTION

A conventional illumination control system 100*z* for controlling an on/off operation of illumination loads (hereinafter just referred to as "lamps") installed in an office, a factory, a store or other place will be described with reference to FIG. 35, which is an explanatory view showing a configuration of the conventional illumination control system 100*z*. The illumination control system 100*z* includes lamps 1*z* to 4*z*, an operation control unit 13*z*, an illumination control terminal 14*z* serving as an illumination switch and a commercial AC power source AC4.

Each of lamps 1*z* to 4*z* is turned on or off depending on the opening or closing of corresponding contacts of individual relays provided in the operation control unit 13*z* in a corresponding relationship with the lamps 1*z* to 4*z*. For example, if the contacts of the relay corresponding to the lamp 1*z* are closed, the lamp 1*z* is turned on. If the contacts of the relay corresponding to the lamp 3*z* are opened, the lamp 3*z* is turned off.

The operation control unit 13*z* is operated by using as a driving power source the electric power supplied from the commercial AC power source AC4. The illumination control terminal 14*z* outputs to the operation control unit 13*z* a control signal, so that the operation control unit 13*z* controls the on/off operation of the respective lamps 1*z* to 4*z* in response to the control signal.

In FIG. 35, the lamps 1*z* to 4*z* and the commercial AC power source AC4 are electrically connected to the operation control unit 13*z* by respective power lines. The operation control unit 13*z* is electrically connected to the illumination control terminal 14*z* by a signal line S. In this regard, it is assumed that the kinds of the lamps 1*z* to 4*z* to be turned on or off upon pushing an operation panel SWy or SWz, i.e., an operation switch unit, of the illumination control terminal 14*z* shown in FIG. 36 are previously set in the operation control unit 13*z*.

As mentioned above, upon pushing the operation panel SWy or SWz shown in FIG. 36, the illumination control terminal 14*z* outputs to the operation control unit 13*z* the control signal for controlling the on/off operation of the lamps 1*z* to 4*z*. The control signal contains information on the kind of the pushed operation panel SWy or SWz. More specifically, the control signal issued by pushing the operation panel SWy contains information on the kind of the operation panel SWy. Similarly, the control signal issued by pushing the operation panel SWz contains information on the kind of the operation panel SWz. Since the control signal issued by pushing the operation panel SWy or SWz contains information on the kind of the pushed operation panel, the operation control unit 13*z* can control the on/off operation of the lamps 1*z* to 4*z* corresponding to the kind of the pushed operation panel contained in the control signal.

The details of the external structure of the illumination control terminal 14*z* will now be described with reference to FIG. 36, which shows an external structure of the conventional illumination control terminal 14*z*. In the description of FIG. 36, the upper, lower, left and right directions running along the paper surface will be defined as upper, lower, left and right directions of the illumination control terminal 14*z*. Moreover, the direction running perpendicularly forwards with respect to the paper surface will be defined as a front direction and the direction running perpendicularly rearwards with respect to the paper surface will be defined as a rear direction.

The illumination control terminal 14*z* is visibly installed on a wall surface of an office, a factory, a store or other place. The illumination control terminal 14*z* shown in FIG. 36 includes a terminal frame K having a left frame 14*zl* and a right frame 14*zr*, both of which are arranged at the front side and unified together. A set of operation panel SWy and LED lamp 23*z* and a set of operation panel SWz and LED lamp 24*z* are arranged in the left frame 14*zl* of the illumination control terminal 14*z*. A display unit 17*z* formed of, e.g., an LCD (Liquid Crystal Display), and a various buttons 26*z* to 30*z* are provided in the right frame 14*zr* of the illumination control terminal 14*z*.

As set forth above, when the operation panel SWy or SWz is pushed, the illumination control terminal 14*z* outputs to the operation control unit 13*z* a control signal for controlling the on/off operations of the respective lamps 1*z* to 4*z*. The LED lamp 23*z* arranged in the left frame 14*zl* of the illumination control terminal 14*z* emits light in different colors to identify the on/off state of, e.g., the lamps 1*z* and 2*z*, which are previously set to be turned on or off upon pushing the operation panel SWy in the operation control unit 13*z*. The LED lamp 24*z* arranged in the left frame 14*zl* of the illumination control terminal 14*z* emits light in different colors to identify the on/off state of, e.g., the lamps 3*z* and 4*z*, which are previously set to be turned on or off upon pushing the operation panel SWz in the operation control unit 13*z*. For example, the LED lamp 23*z* emits red light in the on-state of the lamps 1*z* and 2*z*. The LED lamp 23*z* emits green light in the off-state of the lamps 3*z* and 4*z*.

In the right frame 14*zr* of the illumination control terminal 14*z*, there are arranged a display unit 17*z* for displaying the current time or the like, information on the kinds of the operation panels SWy and SWz and a plurality of buttons 26*z*, 27*z*, 28*z* and 30*z* and the relationships between the operation panel SWy or SWz and the respective lamps 1*z* to 4*z* turned on or off upon pushing the operation panel SWy or SWz. The buttons 26*z*, 27*z*, 28*z* and 30*z* will be described in more detail. The buttons 26*z*, 27*z*, 28*z* and 30*z* include a mode selection button 28*z* for selecting one of a normal mode, a timer mode and a current time mode appearing in a mode display area 31*z* displayed in the upper portion of the display unit 17*z*.

Here, the modes in a mode display area 31*z* will now be described in detail.

The normal mode is a mode indicating that the illumination control system 100*z* is in operation. The normal mode excludes the current time mode for setting the current time and the timer mode for reviewing the setting programs used in turning on or off one of the lamps 1*z* to 4*z* at a specified time. The timer mode a mode in which a user can review the setting programs used in turning on or off one of the lamps 1*z* to 4*z* at a time predetermined by the user.

In the following description, the programs for setting therein a plurality of operation parameters to turn on or off the lamps at a set time and for causing the operation control unit 13*z* to perform the on/off operation of the lamps will be referred to as "setting programs". Each operation parameter set in the setting programs includes the time at which the lamps are to be turned on or off (hereinafter referred to as "set time") and the kinds of the lamps to be turned on or off. The setting programs containing such operation parameters are stored in a storage unit (not shown) in the operation control unit 13z. The operation control unit 13z includes an internal clock C1 (not shown). For example, if the current time indicated by the internal clock C1 coincides with a set time included in an operation parameter of a setting program, the lamps set as the control target of the operation parameter of the setting program are turned on or off. The current time mode is a mode for setting the current time of an internal clock C2 (not shown) built in the illumination control terminal 14z.

Turning back to the description of the buttons 26z, 27z, 28z and 30z, an increment button 26z and a decrement button 27z are provided to increase or decrease the program number of the setting programs that can be reviewed in the timer mode when the timer mode is selected and also to increase or decrease the digits of the current time that can be changed in the current time mode when the current time mode is selected, for example. Further, a setting button 30z is provided to make a setting to display one of the setting programs selected by pushing the increment button 26z or the decrement button 27z and to set the time selected by pushing the increment button 26z or the decrement button 27z as the current time.

The operation control unit 13z which stores the setting programs that can be reviewed in the timer mode includes, as one element thereof, a program timer for controlling the on/off operation of the respective lamps 1z to 4z in accordance with the setting programs. The program timer is disclosed in, e.g., Japanese Patent Application Publication No. 2001-175306. The above disclosure discloses a program timer for a remote monitoring and control system in which transmission signals are sent and received between a plurality of terminals having their own addresses and a transmission unit, both of which are connected to a signal line. Responsive to an on/off signal as a monitoring signal inputted to one of the terminals, the remote monitoring and control system controls the loads connected to other terminals by using the correspondence relationship of the addresses of the terminals.

However, the conventional illumination control terminal 14z shown in FIG. 36 is limited in installation width (Lz) and installation number because it is installed in a narrow installation area of an office, a factory, a store or other place. The display unit 17z and the buttons 26z, 27z, 28z and 30z of the illumination control terminal 14z are all arranged in the narrow area of the right frame 14zr of the illumination control terminal 14z in an integrated manner. This makes it difficult to arrange a display unit having an increased physical size in the right frame 14zr. Use of the small-size display unit 17z makes it troublesome to set the respective parameters in the timer mode.

In case of executing a turning-off program, one of the setting programs, for control of the off operation of the lamps, it is sometimes the case that the lamps are manually turned on again by a third person after execution of the turning-off program. In other words, the turning-off program available in the conventional illumination control terminal is set to turn off the lamps only once at a set time. In order to periodically turn off the lamps as a countermeasure against the event that the lamps are turned on again by a third person, there is a need to prepare an increased number of turning-off programs and to thoroughly execute the turning-off programs thus prepared. This requires a user managing the illumination control system to invest a considerable amount of time in preparing the turning-off programs and to perform troublesome operations. Since the turning-off programs available in the conventional illumination control terminal are hard to keep the lamps thoroughly turned off, difficulties are encountered in reducing power consumption by not turning on unnecessary lamps.

SUMMARY OF THE INVENTION

In view of the above, the present invention provides an illumination control terminal having a compact installation area while making a operation switch unit and a setting efficient and easy to control the on/off operation of lamps, and an illumination control system provided with the illumination control terminal.

In addition, the present invention provides an illumination control terminal capable of thoroughly turning off lamps in an office, a factory, a store or other place and remarkably reducing the power consumption of lamps without having to prepare a vast number of turning-off programs one by one, and an illumination control system provided with the illumination control terminal.

In accordance with an first aspect of the present invention, there is provided an illumination control terminal, including: a frame with a pivot shaft extending in a longitudinal direction; a handle cover pivotably attached to the frame for rotating about the pivot shaft; an operation switch unit arranged on a front surface of the handle cover for, when pushed, turning on or off lamps; a setting operation unit arranged on a rear surface of the handle cover for setting a set time at which the lamps are turned on or off, the handle cover including a locking portion arranged on the rear surface thereof to keep the handle cover in a closed state; a display unit arranged on a front surface of the frame for displaying setting contents set by the setting operation unit, the frame including a locked portion arranged on the front surface thereof to keep the handle cover in the closed state through engagement with the locking portion; a storage unit storing a setting program set by the setting operation unit; and a terminal control unit for outputting a control signal on an on/off operation of the lamps, either upon pushing the operation switch unit or according to the setting program in case where a current time indicated by a clock built in the terminal control unit coincides with the set time of the setting program stored in the storage unit.

In accordance with a second aspect of the present invention, there is provided an illumination control system, including the illumination control terminal described above and an operation control unit for controlling the on/off operation of the lamps in response to the control signal outputted from the illumination control terminal.

In accordance with a third aspect of the present invention, there is provided an illumination control terminal, including: a frame with a pivot shaft extending in a longitudinal direction; a handle cover pivotally attached to the frame for rotation about the pivot shaft; an operation switch unit arranged on a front surface of the handle cover for, when pushed, turning on or off lamps; a locking portion arranged on a rear surface the handle cover to keep the handle cover in a closed state; a setting operation unit arranged on a front surface of the frame for setting a set time at which the lamps are turned on or off; a display unit arranged on a front surface of the frame for displaying setting contents set by the setting operation unit, the frame including a locked portion arranged on the front surface thereof to keep the handle cover in the closed state through engagement with the locking portion; a storage unit for storing a setting program set by the setting operation unit; and a terminal control unit for outputting a control signal on an on/off operation of the lamps, either upon pushing the operation switch unit or according to the setting program in case where a current time indicated by a clock built in the terminal control unit coincides with the set time of the setting program stored in the storage unit.

The setting program includes contents with which all or some of the lamps are repeatedly turned off in a specified time interval during a specified time period.

In accordance with a fourth aspect of the present invention, there is provided an illumination control system, including: an illumination control terminal including: a frame with a pivot shaft extending in a longitudinal direction; a handle cover pivotally attached to the frame for rotation about the pivot shaft; an operation switch unit arranged on a front surface of the handle cover for, when pushed, turning on or off lamps, the handle cover including a locking portion arranged on a rear surface thereof to keep the handle cover in a closed state; a setting operation unit arranged on a front surface of the frame for setting a set time at which the lamps are turned on or off; a display unit arranged on a front surface of the frame for displaying setting contents set by the setting operation unit, the frame including a locked portion arranged on the front surface thereof to keep the handle cover in the closed state through engagement with the locking portion; a storage unit for storing a setting program set by the setting operation unit; and a terminal control unit for outputting a control signal on an on/off operation of the lamps, either upon pushing the operation switch unit or according to the setting program in case where a current time indicated by a clock built in the terminal control unit coincides with the set time of the setting program stored in the storage unit; and an operation control unit for controlling the on/off operation of the lamps in response to the control signal outputted from the illumination control terminal.

The setting program includes contents with which all or some of the lamps are repeatedly turned off in a specified time interval during a specified time period.

In accordance with the aspects of the present invention, there can be provided an illumination control terminal having an installation area smaller than available in the conventional illumination control terminal while assuring an operation switch unit and a setting for control of an on/off operation of lamps in an efficient and easy manner, and an illumination control system provided with the illumination control terminal.

Further, in accordance with the aspects of the present invention, there can be provided the illumination control terminal can thoroughly turn off lamps in an office, a factory, a store or other place and remarkably reduce the power consumption of lamps without having to prepare a vast number of turning-off programs one by one, and an illumination control system provided with the illumination control terminal.

BRIEF DESCRIPTION OF THE DRAWINGS

The objects and features of the present invention will become apparent from the following description of embodiments given in conjunction with the accompanying drawings, in which:

FIG. 5 is an explanatory view illustrating setting programs associated with the on/off operation of lamps;

FIGS. 20A and 20B are explanatory views showing contents of turning-off programs and repeated turning-off programs used as setting programs, FIG. 20A being an explanatory view illustrating the contents of the turning-off programs and FIG. 20B being an explanatory view illustrating the contents of the repeated turning-off programs;

FIG. 21 is an explanatory view showing a management example of the turning-off programs and the repeated turning-off programs used as the setting programs;

DETAILED DESCRIPTION OF THE PREFERRED EMBODIMENTS

Hereinafter, embodiments of the present invention will be described with reference to the accompanying drawings which form a part hereof. In the following description, the upper, lower, left and right directions running along the paper surface in FIG. 3 will be defined as upper, lower, left and right directions of an illumination control terminal. Moreover, the direction running perpendicularly forwards with respect to the paper surface in FIG. 3 will be defined as a front direction and the direction running perpendicularly rearwards with respect to the paper surface in FIG. 3 will be defined as a rear direction. By the term "turning-off" (sometimes called "normal turning-off") used herein below, it is meant that the lamps as turning-off control targets are turned off at a specified normal turning-off time. By the term "forenotice turning-off", it is meant that some of the lamps to be subjected to the normal turning-off are turned off for a forenotice purpose earlier than the normal turning-off time (e.g., five minutes earlier than the normal turning-off time).

First Embodiment

Figure 1:
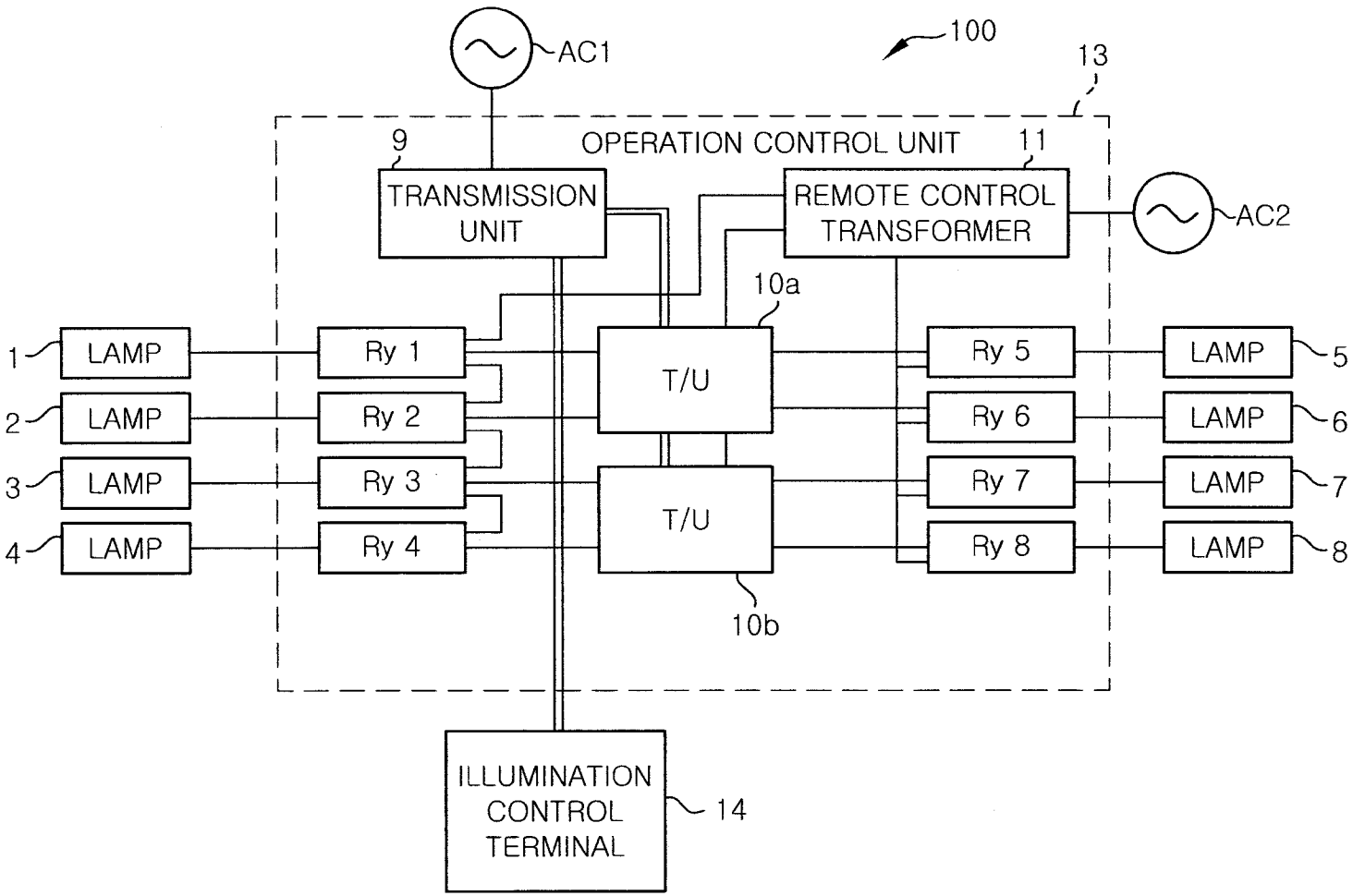
FIG. 1 is an explanatory view showing the system configuration of an illumination control system in accordance with a first embodiment of the present invention.
Figures 2A, 2B, 2C, 2D:
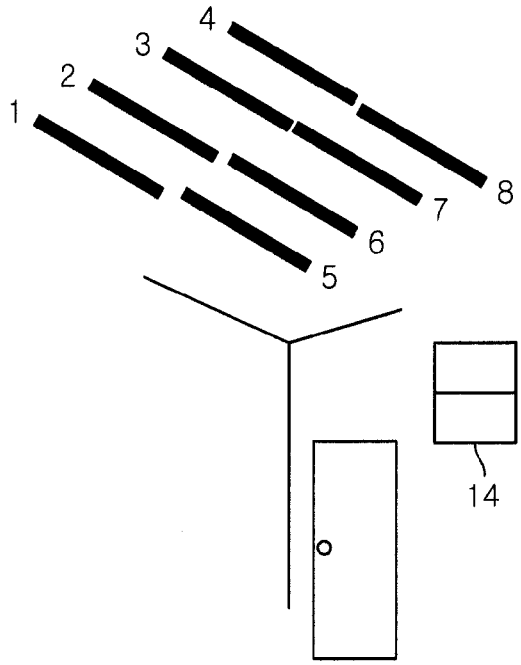
FIGS. 2A to 2D are explanatory views showing an arrangement of lamps, a correspondence relationship between the lamps and their addresses, a correspondence relationship between the groups and their addresses and a correspondence relationship between the operation panels and the groups, FIG. 2A being an explanatory view depicting the arrangement of lamps, FIG. 2B being an explanatory view illustrating the correspondence relationship between the lamps and their addresses, FIG. 2C being an explanatory view illustrating the correspondence relationship between the groups and their addresses, and FIG. 2D being an explanatory view illustrating the correspondence relationship between the operation panels and the groups.

A configuration of an illumination control system 100 in accordance with a first embodiment, which includes an illumination control terminal 14, will be described with reference to FIGS. 1 to 2D. The illumination control system 100 shown in FIG. 1 controls the on/off operation of lamps 1 to 8 installed in an office, a factory, a store or other place as illustrated in FIG. 2A. As shown in FIG. 1, the illumination control system 100 includes lamps 1 to 8 as control targets, an operation control unit 13, an illumination control terminal 14 and commercial AC power sources AC1 and AC2. The commercial AC power source AC1 may be the same as the commercial AC power source AC2.

(Configuration of Illumination Control System 100)

The lamps 1 to 8 are turned on or off depending on the open or closed state of contact points of relays Ry1 to Ry8 arranged in the operation control unit 13 in a one-to-one correspondence relationship with the lamps 1 to 8. For example, the lamp 1 is turned on if the contact points of the relay Ry1 corresponding to the lamp 1 are in a closed state. The lamp 5 is turned off if the contact points of the relay Ry5 corresponding to the lamp 5 are in an open state. The lamps 1 to 8 and the relays Ry1 to Ry8 are connected to respectively through power lines.

The lamps 1 to 8 shown in FIG. 1 are given their addresses as can be seen in FIG. 2B. The correspondence relationship between the lamps 1 to 8 and their addresses is shown in FIG. 2B. Referring to FIG. 2B, addresses 1-1 to 1-4 are respectively assigned to the lamps 1 to 4 and addresses 2-1 to 2-4 are respectively assigned to the lamps 5 to 8. The data shown in FIG. 2B are stored in a transmission unit 9 (to be described later) of the operation control unit 13.

In an effort to efficiently perform the control of the on/off operation of the lamps 1 to 8, the addresses thus assigned are set into a plurality of groups. The correspondence relationship between the addresses and the groups is shown in FIG. 2C. Referring to FIG. 2C, the addresses 1-1, 1-2, 1-3 and 1-4 are set as group G1. The addresses 2-1, 2-2, 2-3 and 2-4 are set as group G2. The addresses 1-2 and 1-4 are set as group G3. The addresses 2-2 and 2-4 are set as group G4. The data shown in FIG. 2C are stored in a transmission unit 9 (to be described later) of the operation control unit 13.

The operation control unit 13 is operated by using as a driving power source the electric power supplied from the commercial AC power sources AC1 and AC2 and controls the on/off operation of the lamps 1 to 8 in response to the control signal outputted from the illumination control terminal 14. As shown in FIG. 1, the operation control unit 13 includes a transmission unit 9, a terminal unit (T/U) 10*a*, a terminal unit (T/U) 10*b*, a remote control transformer 11 and a plurality of relays Ry1 to Ry8.

In the following description, the programs for setting therein a plurality of operation parameters to turn on or off the lamps at a set time and for causing the operation control unit 13 to perform the on/off operation of the lamps will be referred to as "setting programs".

The transmission unit 9 is operated by using as a driving power source the electric power supplied from the commercial AC power source AC1 and supplies the electric power to operate the terminal unit 10*a* or 10*b*. A control signal is outputted from the illumination control terminal and inputted to the transmission unit 9. The control signal contains at least the information on the kind of group to which the lamps 1 to 8 belong as shown in FIG. 2C and the set time at which the lamps belonging to the group are turned on or off. For example, the control signal outputted from the illumination control terminal 14 contains the information on the kind of group G1 and the set time at which the lamps of group G1 are to be turned on or off when the transmission unit 9 is set beforehand to turn on or off the lamps 1 to 4 of group G1 upon pushing the operation panel SWa as an operation switch unit of the illumination control terminal 14 (see FIG. 3) as shown in FIG. 2D. The control signal outputted from the illumination control terminal 14 contains the information on the kind of group G2 and the set time at which the lamps of group G2 are to be turned on or off when the transmission unit 9 is set beforehand to turn on or off the lamps 5 to 8 of group G2 upon pushing the operation panel SWb as an operation switch unit of the illumination control terminal 14 (see FIG. 3) as shown in FIG. 2D.

Responsive to the control signal thus inputted, the transmission unit 9 outputs to the terminal unit 10*a* or 10*b* a signal for controlling the on/off operation of the lamps 1 to 8. The transmission unit 9 and the commercial AC power source AC1 are electrically connected to each other through a power line.

The terminal unit 10*a* or 10*b* is operated either by using as a driving power source the electric power supplied from the transmission unit 9 or by using as the driving power source both the electric power supplied from the transmission unit 9 and the electric power supplementarily supplied from the remote control transformer 11. The signal outputted from the transmission unit 9 is inputted to the terminal unit 10*a* or 10*b*. Responsive to this signal, the terminal unit 10*a* or 10*b* controls the operation of the relays Ry1 to Ry8. As shown in FIG. 1, the terminal unit 10*a* controls the operation of the relays Ry1, Ry2, Ry5 and Ry6 while the terminal unit 10*b* controls the operation of the relays Ry3, Ry4, Ry7 and Ry8. The transmission unit 9 and the terminal unit 10*a* or 10*b* are electrically connected to each other by a power line. The terminal unit 10*a* and each of the relays Ry1, Ry2, Ry5 and Ry6 are electrically connected to one another by power lines. The terminal unit 10*b* and each of the relays Ry3, Ry4, Ry7 and Ry8 are electrically connected to one another by power lines. The terminal unit 10*a* or 10*b* and the remote control transformer 11 are electrically connected to each other by a power line.

The remote control transformer 11 transforms the voltage of the electric power supplied from the commercial AC power source AC2 to supplementarily supply the electric power required in driving the terminal unit 10*a* or 10*b*. Moreover, the remote control transformer 11 transforms the voltage of the electric power supplied from the commercial AC power source AC2 to supplementarily supply the electric power required in opening and closing the contact points of the relays Ry1 to Ry8. As shown in FIG. 1, the remote control transformer 11 and the relays Ry1 to Ry8 are electrically connected to each other by power lines. Likewise, the remote control transformer 11 and the commercial AC power source AC2 are electrically connected to each other by a power line.

Using the electric power supplied from an AC power source (not shown) or using both the electric power supplied from the AC power source (not shown) and the electric power supplementarily supplied from the remote control transformer 11, the relays Ry1 to Ry8 open or close their contact points to thereby control the on/off operations of the lamps 1 to 8. In FIG. 1, the relays Ry1 to Ry8 respectively control the on/off operations of the lamps 1 to 8.

(Configuration of Illumination Control Terminal 14)

Figure 3:
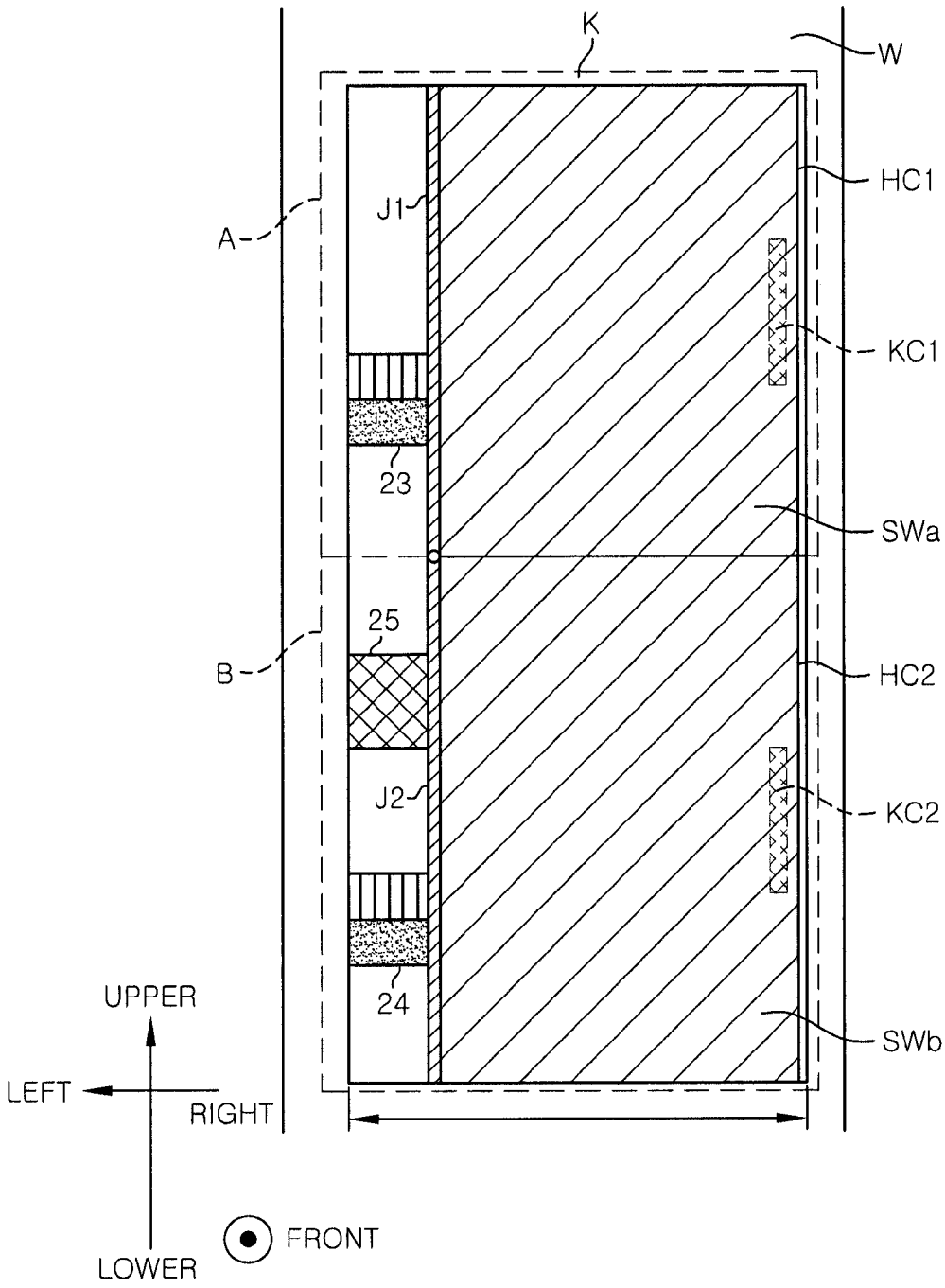
FIG. 3 is an outward appearance view showing an illumination control terminal with handle covers thereof kept in a closed state.
Figure 4:
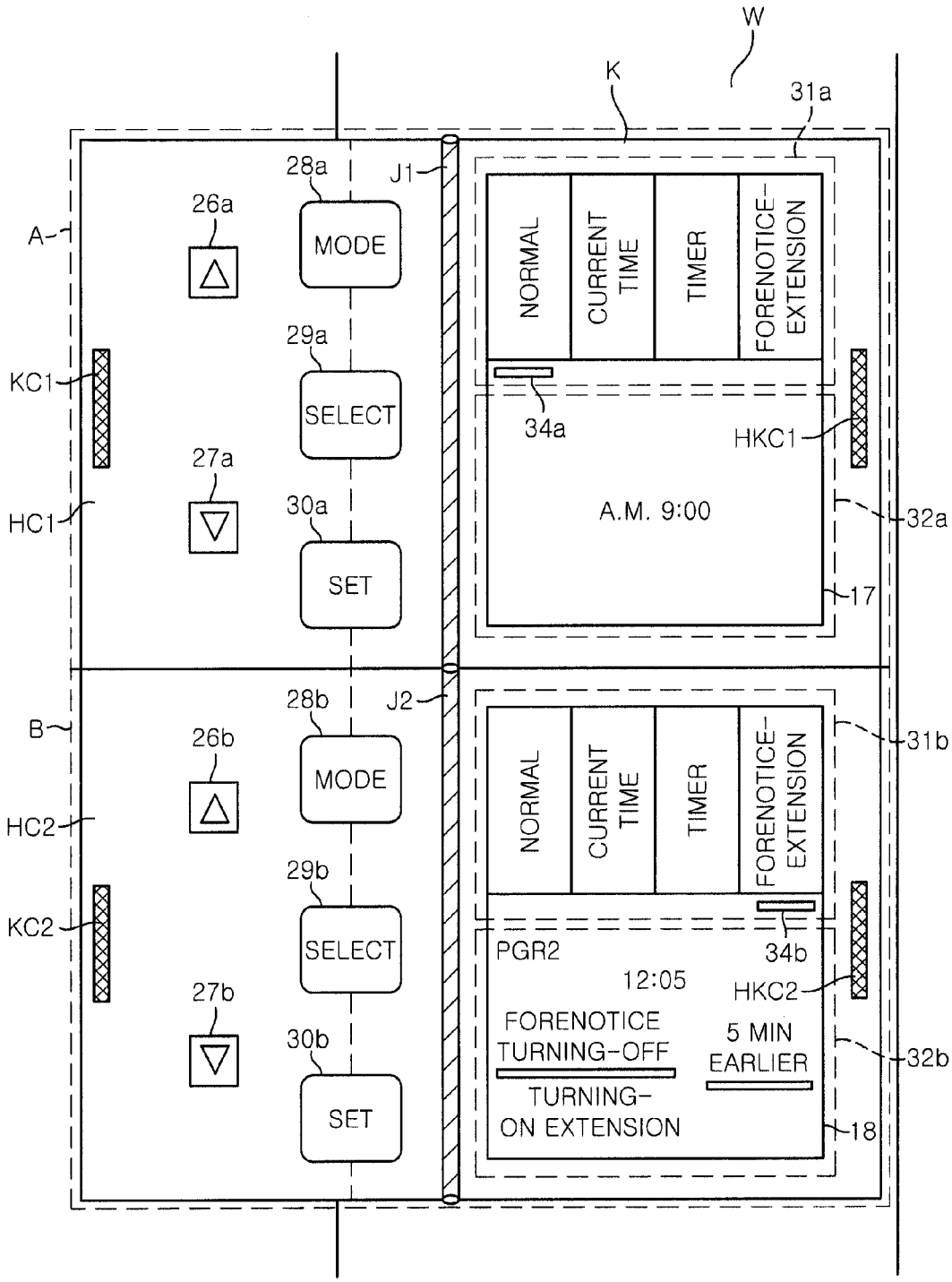
FIG. 4 is an outward appearance view showing an illumination control terminal with the handle covers thereof kept in an open state.

The illumination control terminal 14 outputs to the transmission unit 9 of the operation control unit 13 a control signal for controlling the on/off operation of the lamps 1 to 8. The details of the outward appearance of the illumination control terminal 14 will now be described with reference to FIGS. 3 and 4. FIG. 3 is an outward appearance view showing the illumination control terminal 14 of the first embodiment with handle covers HC1 and HC2 thereof kept in a closed state. FIG. 4 is an outward appearance view showing the illumination control terminal 14 of the first embodiment with the handle covers HC1 and HC2 thereof kept in an open state.

Figure 36:
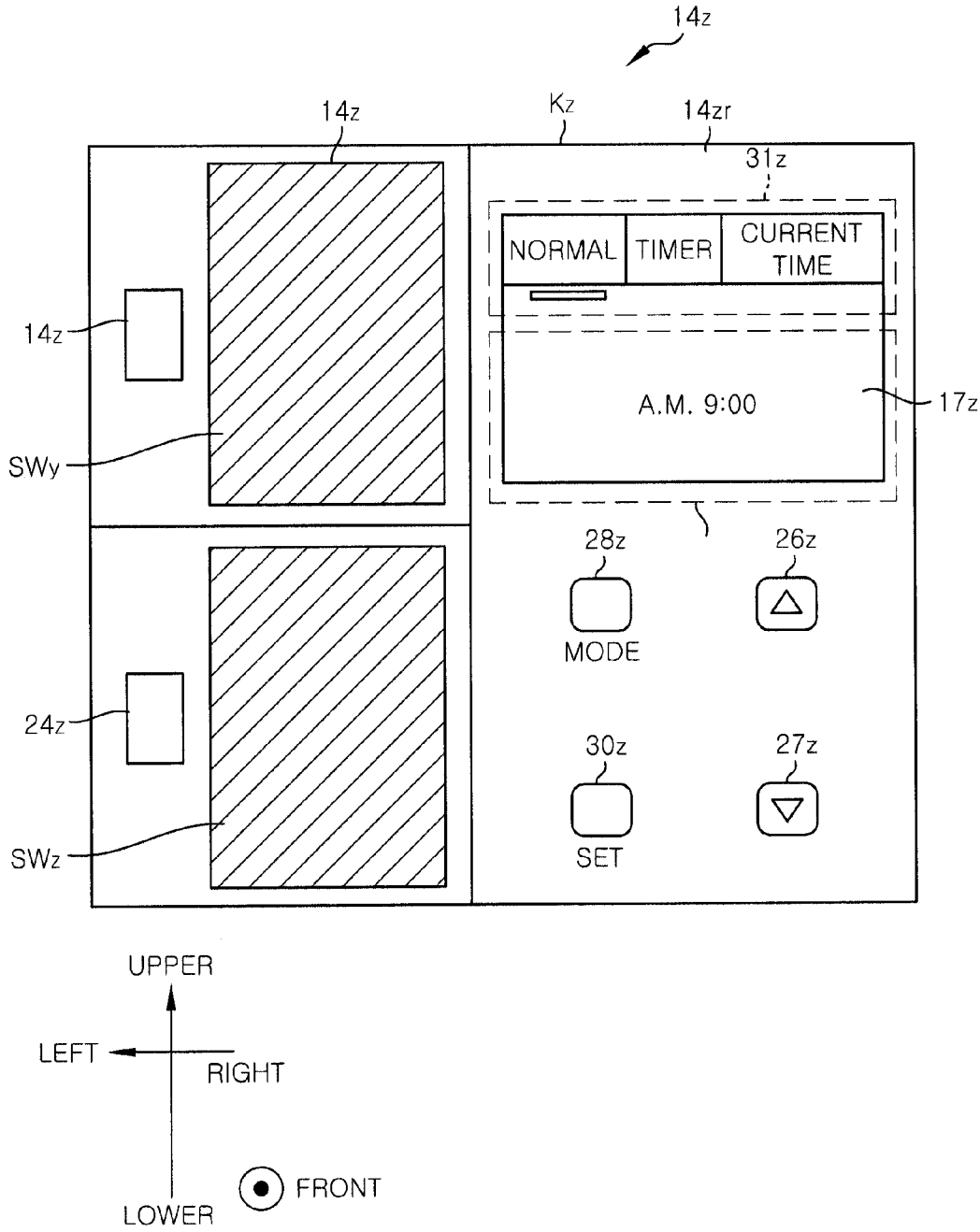
FIG. 36 (PRIOR ART)
FIG. 36 is an outward appearance view showing a conventional illumination control terminal.

As shown in FIG. 3, the illumination control terminal 14 is visibly arranged on a wall surface W of an office, a factory, a store or other place. The illumination control terminal 14 has an installation width (L) much smaller than the installation width (Lz) of the conventional illumination control terminal 14*z* shown in FIG. 36. The illumination control terminal 14 shown in FIG. 3 includes first and second operation units A and B sharing a very thin frame K of generally rectangular solid shape. While the illumination control terminal 14 shown in FIG. 3 includes two first and second operation units, the present invention is not limited thereto.

The first operation unit includes at least a very thin frame K of generally rectangular solid shape and the handle cover HC1 pivotably attached to the front surface of the frame K for rotating about a pivot shaft J1 extending in the longitudinal direction of the frame K. FIG. 3 shows the handle cover HC1 rotated by zero degree. As shown in FIG. 3, an operation panel SWa is arranged on the front surface of the handle cover HC1. An LED lamp 23 is arranged on the front surface of the frame K. Referring back to FIG. 2D, the operation panel SWa outputs, when pushed, a control signal for controlling the on/off operation of the lamps 1 to 4 of group G1. In the first embodiment, the groups of the lamps to be turned on or off upon pushing the operation panel SWa or SWb are previously set in the transmission unit 9 as shown in FIG. 2D.

The LED lamp 23 emits light in different colors to identify the on/off state of the lamps 1 to 4 of group G1. An LED lamp 24 to be set forth below emits light in different colors to identify the on/off state of the lamps 5 to 8 of group G2. For example, the LED lamp 23 emits red light to notify the on-state of the lamps 1 to 4 of group G1. The LED lamp 23 emits green light to notify the off-state of the lamps 1 to 4 of group G1. Similarly, the LED lamp 24 emits red light to notify the on-state of the lamps 5 to 8 of group G2. The LED lamp 24 emits green light to notify the off-state of the lamps 5 to 8 of group G2.

Similar to the first operation unit, the second operation unit includes at least a very thin frame K of generally rectangular solid shape and the handle cover HC2 pivotably attached to the front surface of the frame K for rotating about a pivot shaft J2 extending in the longitudinal direction of the frame K. FIG. 3 shows the handle cover HC2 rotated by zero degree. As shown in FIG. 3, an operation panel SWb is arranged on the front surface of the handle cover HC2. An LED lamp 24 and a communications unit 25 are arranged on the front surface of the frame K. The communications unit 25 receives a setting program inputted from a setting communications device 50 (to be described later), i.e., an external terminal, through infrared communications or other communications. As shown in FIG. 5, the setting program is associated with the on/off operation of the lamps 1 to 8.

The setting programs will be described with reference to FIG. 5, which is an explanatory view illustrating the setting programs associated with the on/off operation of lamps. The setting programs shown in FIG. 5 contain the program numbers of the setting programs as control program numbers, the groups of the lamps to be controlled, the turning-on time at which the lamps of the group to be controlled are simultaneously turned on, the forenotice turning-off time at which some of the lamps of the group to be controlled are turned off for a forenotice purpose before the turning-off time of the lamps of the group to be controlled, the turning-off time at which the lamps of the group to be controlled are simultaneously turned off, and the control day on which the above control is executed.

In the description made with reference to FIG. 5, it is assumed that the lamps 1 to 8 of groups G1 and G2 arranged in an office, a factory, a store or other place are all turned on at 8:30 on weekdays from Monday to Friday. With the setting program of program number 1 shown in FIG. 5, the lamps 2, 4, 6 and 8 belonging to group G3 and group G4 are turned off for a forenotice purpose at 12:00 on Monday through Friday. In this forenotice turning-off, all the lamps 1 to 8 are not collectively turned off at the same clock time but some of the lamps 1 to 8, e.g., the lamps 2, 4, 6 and 8, are turned off as a forenotice of the forthcoming collective turning-off. With the setting program of program number 2, the lamps 1 to 8 belonging to group G1 and group G2 are collectively turned off at 12:05 on Monday through Friday. Since the lamps 2, 4, 6 and 8 have been already turned off by the setting program of program number 1, only the lamps 1, 3, 5 and 7 are additionally turned off at 12:05 in reality.

With the setting program of program number 3, the lamps 2, 4, 6 and 8 belonging to group G3 and group G4 are turned off for a forenotice purpose at 18:00 on Monday through Friday. With the setting program of program number 4, the lamps 5, 6, 7 and 8 belonging to group G2 are collectively turned off at 18:05 on Monday through Friday. With the setting program of program number 5, the lamps 2 and 4 belonging to group G3 are turned off for a forenotice purpose at 23:00 on Monday through Friday. With the setting program of program number 6, the lamps 1, 2, 3 and 4 belonging to group G1 are collectively turned off at 23:05 on Monday through Friday. Since the lamps 2 and 4 have been already turned off by the setting program of program number 5, only the lamps 1 and 3 are additionally turned off at 23:05 in reality. For the setting program shown in FIG. 6, the forenotice turning-off time of the lamps may be preferably automatically set through the setting of the turning-off time at which the lamps are simultaneously turned off. Alternatively, the forenotice turning-off time may separately set from the turning-off time.

Referring back to FIG. 3, the handle cover HC1 (or HC2) is kept locked to the frame K as a locking portion KC1 (or KC2) arranged on the rear surface of the handle cover HC1 (or HC2) comes into engagement with a locked portion HKC1 (or HKC2) positioned on the front surface of the frame K. The state in which the handle cover HC1 is locked to the frame K as shown in FIG. 3 will be defined as a closed state of the handle cover HC1. The state in which the handle cover HC2 is locked to the frame K will be defined as a closed state of the handle cover HC2.

The state in which the locking portion KC1 (or KC2) is disengaged from the locked portion HKC1 (or HKC2) as shown in FIG. 4 will be defined as an open state of the handle cover HC1 (or HC2). FIG. 4 shows the handle cover HC1 (or HC2) rotated by 180 degrees. When the handle cover HC1 is in the open state, it can be seen that an increment button 26*a*, a decrement button 27*a*, a mode selection button 28*a*, a selection button 29*a* and a setting button 30*a* are arranged on the rear surface of the handle cover HC1. The locking portion KC1 is arranged on the rear surface of the handle cover HC1 to keep the handle cover HC1 in the closed state.

As shown in FIG. 4, a display unit 17 is arranged on the front surface of the frame K of the first operation unit. The screen of the display unit 17 is largely divided into a mode display area 31*a* and a setting content display area 32*a*. The mode display area 31*a* is an area for displaying various kinds of modes and specifying the currently selected mode. A normal mode is selected in the mode display area 31*a* shown in FIG. 4. The setting content display area 32*a* is an area for displaying contents corresponding to a mode selected in the mode display area 31*a*. For example, the current time reading 9:30 a.m. is displayed in the setting content display area 32*a* shown in FIG. 4.

The various kinds of modes including a normal mode, a current time mode, a timer mode and a forenotice-extension mode will now be described. The normal mode is a mode indicating that the illumination control system 100 is in a normal operation, which excludes the current time mode for setting the current time, the timer mode for setting the setting programs used in turning on or off one of the lamps 1 to 8 at a specified time and the forenotice-extension mode for setting a turning-on extension time or a forenotice turning-off time. The current time mode is a mode for setting the current time of an internal clock C3 (see FIG. 6) built in the illumination control terminal 14. The timer mode is a mode for newly registering the setting programs shown in FIG. 5 or for changing individual parameters in the setting programs. The forenotice-extension mode is a mode for newly registering the setting programs shown in FIG. 5 or for changing individual parameters in the setting programs.

As shown in FIG. 4, a display unit 18 is arranged on the front surface of the frame K of the second operation unit. The screen of the display unit 18 is largely divided into a mode display area 31*b* and a setting content display area 32*b*. The mode display area 31*b* is an area for displaying various kinds of modes and specifying the currently selected mode. A forenotice-extension mode is selected in the mode display area 31*b* shown in FIG. 4. The setting content display area 32*b* is an area for displaying the contents corresponding to a mode selected in the mode display area 31*b*. For example, a step of setting the forenotice turning-off time corresponding to the setting program of program number 2 is displayed in the setting content display area 32*b* shown in FIG. 4.

The various kinds of buttons shown in FIG. 4 will now be described. The mode selection button 28*a* (or 28*b*) is a button for selecting one of the normal mode, the current time mode, the timer mode and the forenotice-extension mode displayed in the mode display area 31*a* (or 31*b*) of the display unit 17 (or 18). The selection button 29*a* (or 29*b*) is a button for selecting individual parameters in one of the current time mode, the timer mode and the forenotice-extension mode selected by the mode selection button 28*a* (or 28*b*). The increment button 26*a* (or 26*b*) and the decrement button 27*a* (27*b*) are buttons for increasing or decreasing the values of the individual parameters in one of the current time mode, the timer mode and the forenotice-extension mode selected by the mode selection button 28*a* (or 28*b*). The setting button 30*a* (or 30*b*) is a button for setting the finally-selected individual parameters.

Figure 6:
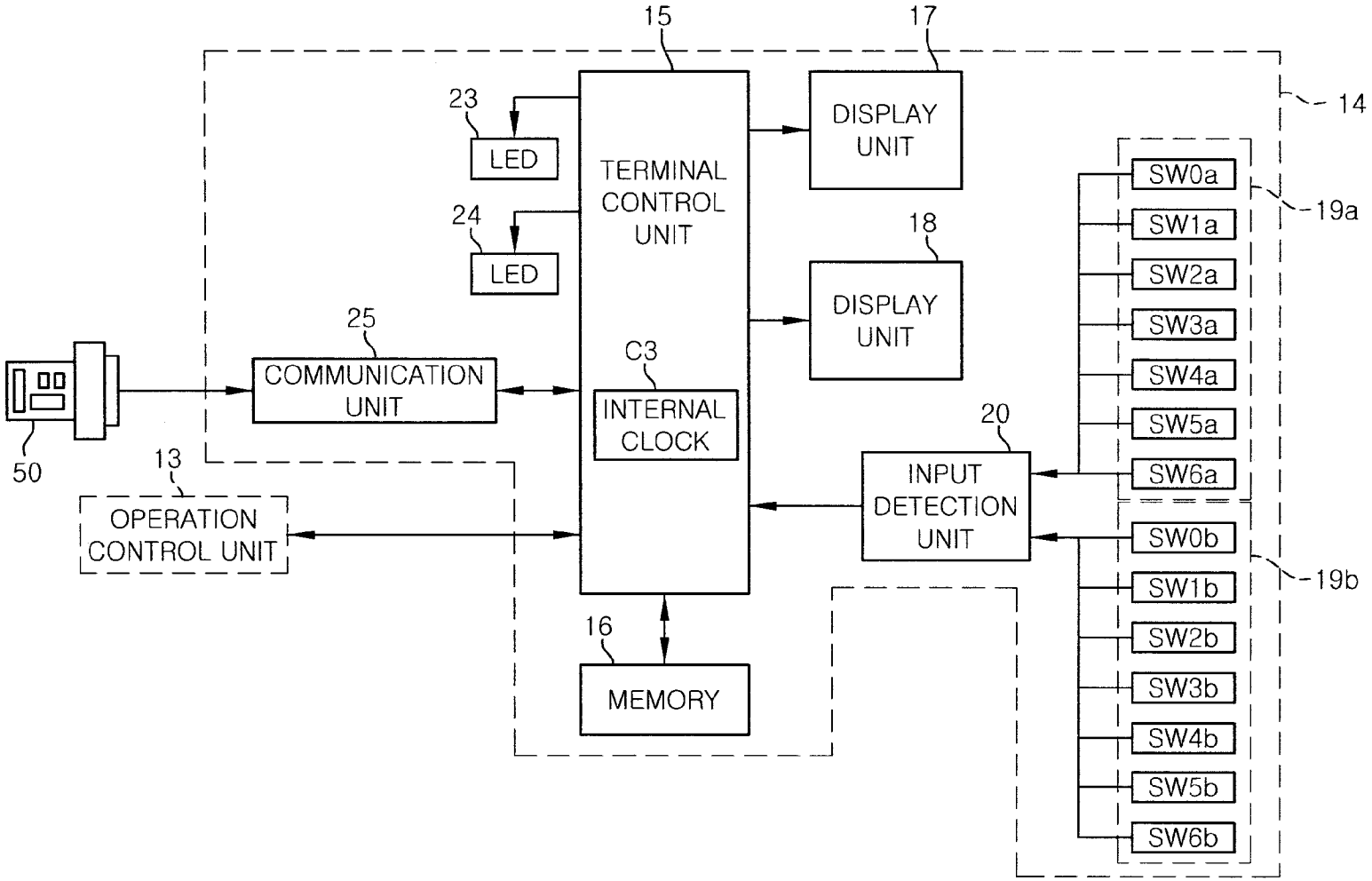
FIG. 6 is a block diagram showing a configuration of the illumination control terminal of the first embodiment.

Next, the configuration of the illumination control terminal 14 will be described in detail with reference to FIG. 6, which is a block diagram showing the internal configuration of the illumination control terminal 14 in accordance with the first embodiment. The illumination control terminal 14 includes a terminal control unit 15, an internal clock C3, a memory 16, a display unit 17, a display unit 18, a switch group 19*a*, a switch group 19*b*, an input detection unit 20, an LED lamp 23, an LED lamp 24 and a communications unit 25. The illumination control terminal 14 is operated by using as a driving power source the electric power supplied from the transmission unit 9 of the operation control unit 13.

The terminal control unit 15 includes a microcomputer and controls the operation of the respective components of the illumination control terminal 14. The internal clock C3 indicates the current time by counting the clock pulses generated from a clock circuit (not shown). The memory 16 stores the information indicating which switch of the switch group 19*a* (or 19*b*) was selected and pushed. Responsive to the push signal (to be described later) outputted by the input detection unit 20, the terminal control unit 15 generates a control signal for controlling the on/off operation of the lamps and outputs the control signal to the operation control unit 13.

The memory 16 is formed of a non-volatile memory such as an EEPROM (electrically erasable programmable read-only memory) or the like and stores the operation parameters of the setting programs shown in FIG. 5, which are associated with the control of the on/off operation of the lamps 1 to 8.

The display unit 17 (or 18) is arranged on the front surface of the frame K of the first operation unit (or the second operation unit). If the normal mode is selected by pushing the mode selection button 28*a* (or 28*b*), the current time indicated by the internal clock C3 of the terminal control unit 15 is displayed in the display unit 17 (or 18). In case where the current time mode is selected by pushing the mode selection button 28*a* (or 28*b*), the current time at the moment of pushing the mode selection button 28*a* (or 28*b*) is displayed in a flickering fashion and an underbar (not shown) indicating the availability of setting of the current time is also displayed in the display unit 17 (or 18) so that a user can set the current time.

If the timer mode is selected by pushing the mode selection button 28*a* (or 28*b*), displayed in the display unit (or 18) are one of the setting programs shown in FIG. 5 and an underbar (not shown) indicating the availability of setting of parameters (e.g., program number, group, execute and withhold) in the displayed setting program. If the forenotice-extension mode is selected by pushing the mode selection button 28*a* (or 28*b*), displayed in the display unit 17 (or 18) are one of the setting programs shown in FIG. 5 and an underbar (not shown) indicating the availability of setting of parameters (e.g., program number, group, forenotice turning-off time and turning-on extension time) in the displayed setting program.

The switch group 19*a* (or 19*b*) includes a switch SW0*a* (or SW0*b*) corresponding to the operation panel SWa (or SWb), a switch SW1*a* (or SW1*b*) indicating the open state or the closed state of the handle cover HC1 (or HC2), a switch SW2*a* (or SW2*b*) corresponding to the increment button 26*a* (or 26*b*), a switch SW3*a* (or SW3*b*) corresponding to the decrement button 27*a* (or 27*b*), a switch SW4*a* (or SW4*b*) corresponding to the mode selection button 28*a* (or 28*b*), a switch SW5*a* (or SW5*b*) corresponding to the selection button 29*a* (or 29*b*) and a switch SW6*a* (or SW6*b*) corresponding to the setting button 30*a* (or 30*b*). The switches of the switch group 19*a* (or 19*b*) other than the switch SW1*a* (or SW1*b*) output signals indicative of the pushing operation thereof to the input detection unit 20 each time when they are pushed (hereinafter, such signals referred to as 'push signals').

Responsive to the opening of the handle cover HC1 (or HC2), the switch SW1*a* (or SW1*b*) outputs a push signal indicative of the off-state of its contact points to the input detection unit 20. In response to the closing of the handle cover HC1 (or HC2), the switch SW1*a* (or SW1*b*) outputs a push signal indicative of the on-state of its contact points to the input detection unit 20.

The input detection unit 20 monitors the operation of the respective switches of the switch group 19*a* (or 19*b*), receives the push signal outputted from one of the switches of the switch group 19*a* (or 19*b*) and outputs the push signal to the terminal control unit 15. The push signal outputted from the input detection unit 20 to the terminal control unit 15 contains at least information on the kind of the pushed switch of the switch group 19*a* (or 19*b*). Based on the push signal outputted from the switch SW1*a* or SW1*b*, the input detection unit 20 detects the open state or the closed state of the handle cover HC1 or HC2. For instance, if a push signal indicating the on-state of contact points is inputted from the switch SW1*a*, the input detection unit 20 detects the fact that the handle cover HC1 is in an open state. If a push signal indicating the off-state of contact points is inputted from the switch SW1*b*, the input detection unit 20 detects the fact that the handle cover HC2 is in a closed state.

If the terminal control unit 15 determines that the lamps 1 to 4 of group G1 (or the lamps 5 to 8 of group G2) are turned on, the LED lamp 23 (or 24) emits red light under the control of the terminal control unit 15. If the terminal control unit 15 determines that the lamps 1 to 4 of group G1 (or the lamps 5 to 8 of group G2) are turned off, the LED lamp 23 (or 24) emits green light under the control of the terminal control unit 15. If a push signal outputted upon pushing the switch SW0*a* (or SW0*b*) is acquired through the input detection unit 20 while the switch SW0*a* (or SW0*b*) corresponding to the operation panel SWa (or SWb) is not in a pushed state, namely while the lamps 1 to 4 of group G1 (or the lamps 5 to 8 of group G2) are kept turned off, the terminal control unit 15 determines that the lamps 1 to 4 of group G1 (or the lamps 5 to 8 of group G2) are being turned on. Similarly, if a push signal outputted upon pushing the switch SW0*a* (or SW0*b*) is acquired through the input detection unit 20 while the switch SW0*a* (or SW0*b*) is in a pushed state, namely while the lamps 1 to 4 of group G1 (or the lamps 5 to 8 of group G2) are kept turned on, the terminal control unit 15 determines that the lamps 1 to 4 of group G1 (or the lamps 5 to 8 of group G2) are being turned off.

The communications unit 25 is arranged on the front surface of the frame K of the second operation unit to receive a control signal on the new registration of the setting programs shown in FIG. 5, which is transmitted from a setting communications device 50, i.e., an external terminal, through infrared communications or other communications. The control signal on the new registration of the setting programs contains the sign of new registration of the setting programs and the individual parameters of the setting programs inputted from the setting communications device 50. The parameters include at least the group of lamps to be controlled and the set time at which the control of the on/off operation of the lamps is to be executed. If a control signal on the new registration of the setting programs is received from the setting communications device 50, the communications unit 25 notifies the terminal control unit 15 of the fact that it has received the control signal. In case where the terminal control unit 15 is notified of the fact that the communications unit 25 has received the control signal on the new registration of the setting programs from the setting communications device 50, the terminal control unit 15 acquires the setting programs and causes the memory 16 to store the setting programs.

Figure 7:
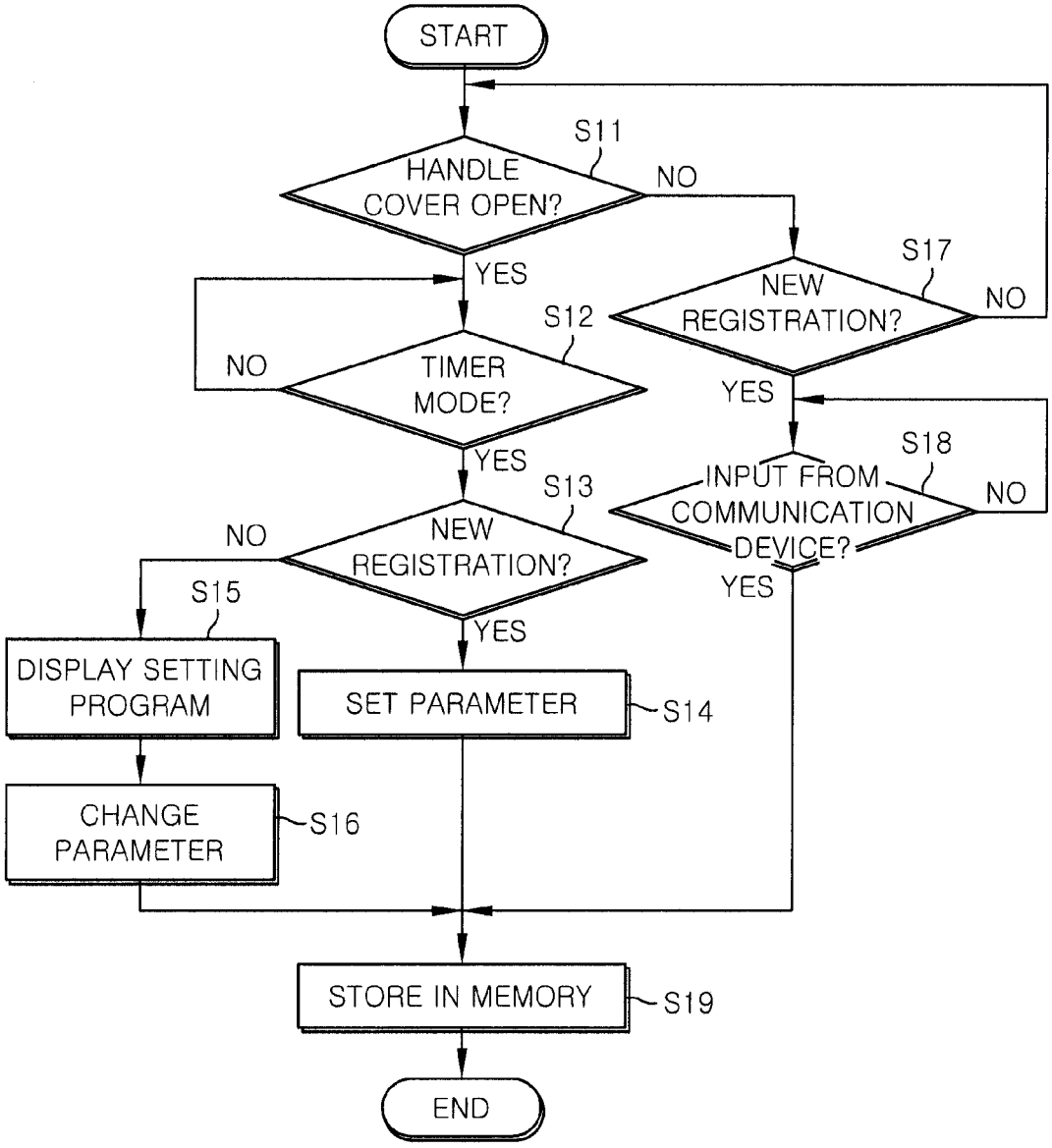
FIG. 7 is a flowchart explaining a process of newly registering or changing a setting program in a timer mode.
Figure 8:
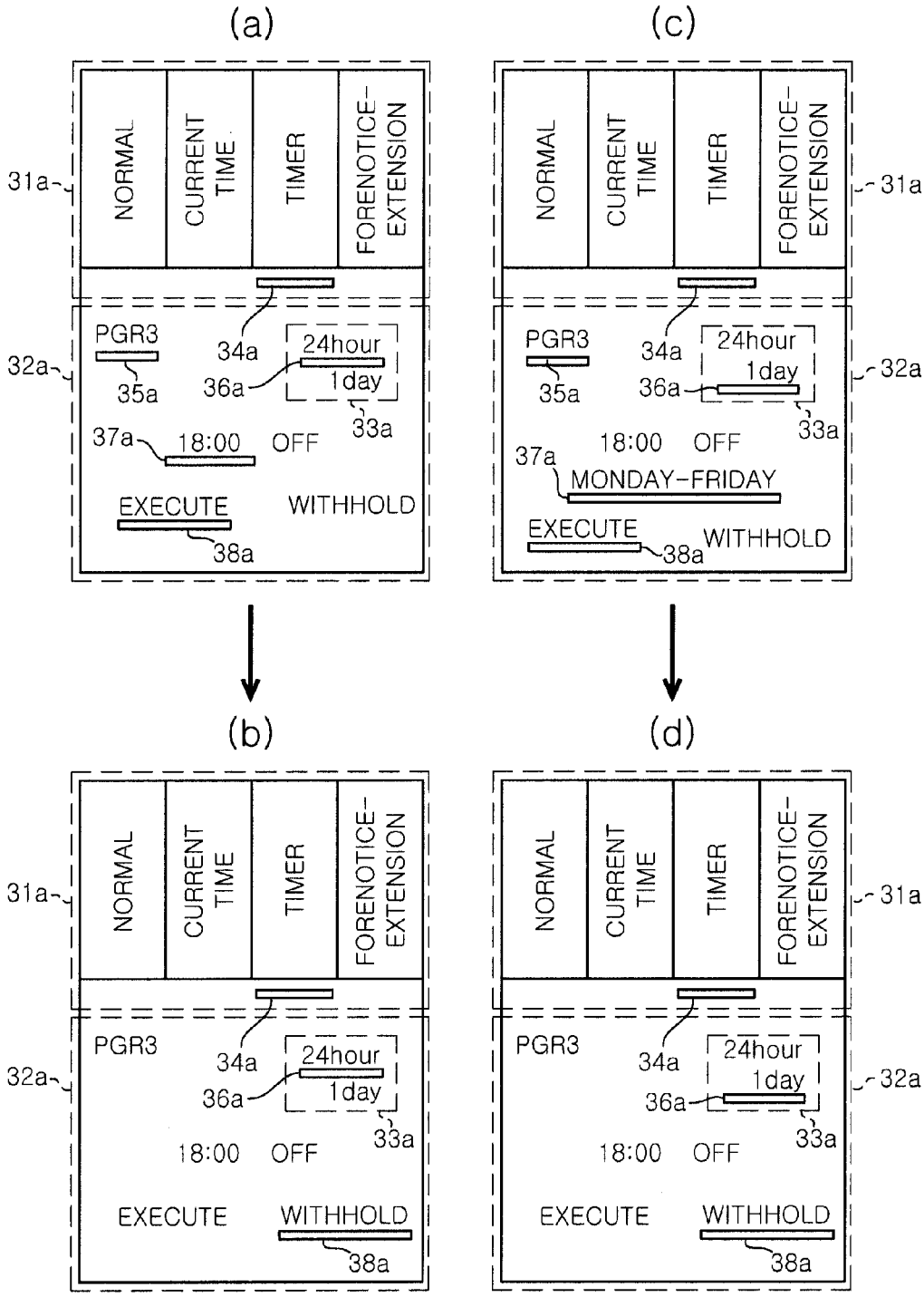
FIG. 8 illustrate examples of screen images available before and after changing the setting program in the timer mode, (a) of FIG. 8 being a screen image available before changing the 24 hour-displaying-type parameter of the setting program, (b) of FIG. 8 being a screen image available after changing a 24 hour-displaying-type parameter of the setting program, (c) of FIG. 8 being a screen image available before changing a weekday-displaying-type parameter of the setting program, and (d) of FIG. 8 being a screen image available after changing the weekday-displaying-type parameter of the setting program.

Next, a process of newly registering or changing the setting program in the timer mode will be described with reference to FIGS. 7 to 8. FIG. 7 is a flowchart explaining a process of newly registering or changing the setting program in the timer mode. FIG. 8 illustrate examples of screen images available before and after changing the setting program in the timer mode. (a) of FIG. 8 is a screen image available before changing the 24 hour-displaying-type parameter of the setting program. (b) of FIG. 8 is a screen image available after changing the 24 hour-displaying-type parameter of the setting program. (c) of FIG. 8 is a screen image available before changing the weekday-displaying-type parameter of the setting program. (d) of FIG. 8 is a screen image available after changing the weekday-displaying-type parameter of the setting program. In the description made with reference to FIGS. 7 to 8, it is assumed that the first operation unit is used by way of an example.

Referring to FIG. 7, the input detection unit 20 of the illumination control terminal 14 detects whether the handle cover HC1 is in an open state (step S11). If it is detected that the handle cover HC1 is in the open state (YES in step S11), the terminal control unit 15 designates the "timer mode" of the mode display area 31*a* with an underbar 34*a* as the switch SW4*a* (see FIG. 6) corresponding to the mode selection button 28*a* is pushed a specified number of times (step S12).

If the "timer mode" is designated with the underbar 34*a* (YES in step S12), the terminal control unit 15 causes the display unit 17 to display menus of the timer mode in the setting content display area 32*a*. If an input indicative of the new registration of a setting program is made through the displayed menus (YES in step S13), various kinds of parameters (e.g., the groups of the lamps to be controlled and the set time at which the lamps are to be turned on or off) of the setting program to be newly registered are set (step S14). Based on the parameters thus set, the terminal control unit 15 generates a setting program and stores the setting program in the memory 16 (step S19). Thus, the process shown in FIG. 7 comes to an end.

If an input indicative of the change of a setting program is made through the menus of the timer mode displayed in the setting content display area 32*a* (NO in step S13), the terminal control unit 15 causes the display unit 17 to display one of the setting programs shown in FIG. 5 in the setting content display area 32*a* as shown in (a) or (c) of FIG. 8 (step S15). The setting program thus displayed may be either a setting program whose program number is initially set to be displayed at the outset or a previous setting program displayed just before. When displaying the previous setting program, the terminal control unit 15 may have the memory 16 to store the program number of the previous setting program and cause the display unit 17 to display the setting programs based on the program number of the previous setting program stored in the memory 16.

After the setting program is displayed as shown in (a) or (c) of FIG. 8, one of the switch SW2*a* corresponding to the increment button 26*a*, the switch SW3*a* corresponding to the decrement button 27*a*, the switch SW5*a* corresponding to the selection button 29*a* and the switch SW6*a* corresponding to the setting button 30*a* is operated so that the terminal control unit 15 can change the parameters of the setting program (step S16). The terminal control unit 15 causes the memory 16 to store the setting program thus changed (step S19). Thereafter, the process shown in FIG. 7 comes to an end.

If it is detected in step S11 that the handle cover HC1 is not in the open state (NO in step S11) and if the setting program is to be newly registered (YES in step S17), the control signal on the new registration of the setting program issued by the setting communications device 50 is inputted to the communications unit 25 of the illumination control terminal 14 (YES in step S18). The communications unit 25 receives the control signal thus inputted and notifies the terminal control unit 15 of the fact that it has received the control signal. Upon receiving the notice that the communications unit 25 has received the signal on the new registration of a setting program from the setting communications device 50, the terminal control unit 15 acquires the setting program and causes the memory 16 to store the setting program (step S19). Thus, the process shown in FIG. 7 comes to an end.

Description will now be made on the examples shown in (a) and (b) of FIG. 8. As shown in (a) of FIG. 8, upon pushing the switch SW4*a* corresponding to the mode selection button 28*a*, the terminal control unit 15 designates the "timer mode" of the mode display area 31*a* with the underbar 34*a*. At this time, the terminal control unit 15 causes the display unit 17 to initially display the parameter "PGR3" indicating the setting program of program number 3 (PGR3) in the setting content display area 32*a*. The setting program initially displayed upon selecting the timer mode from the mode display area 31*a* may be an arbitrary one set by the previously-defined setting.

In case where the setting program of program number 3 (PGR3) is displayed in the setting content display area 32*a* as shown in (a) of FIG. 8, the terminal control unit 15 designates the parameter "PGR3" displayed in the setting content display area 32*a* with an underbar 35*a* as a primary key. Upon pushing the switch SW2*a* corresponding to the increment button 26*a* or the switch SW3*a* corresponding to the decrement button 27*a* while the parameter "PGR3" is selected by the underbar 35*a*, the terminal control unit 15 causes the display unit 17 to display the setting program of arbitrary program number corresponding to the number of pushing times. For example, if the switch SW2*a* corresponding to the increment button 26*a* is pushed once while the parameter "PGR3" is selected by the underbar 35*a*, the setting program of program number 4 corresponding to the parameter "PGR 4" is displayed in the setting content display area 32*a*.

In case where a parameter changing task is performed with respect to the setting program of program number 3 (PGR3) displayed in the setting content display area 32*a* shown in (a) of FIG. 8, the terminal control unit 15 designates the time period display region 33*a* in the setting content display area 32*a* with an underbar 36*a* as the primary key upon pushing the switch SW6*a* corresponding to the setting button 30*a* while the parameter "PGR3" is selected by the underbar 35*a*. In this regard, a 24 hour-displaying-type parameter "24 hour" that can be selected to change the turning-on or turning-off time period on an hourly basis and a weekday-displaying-type parameter "1 day" that can be selected to change the turning-on or turning-off time period on a weekday basis are displayed in the time period display region 33*a*.

If the switch SW2*a* corresponding to the increment button 26*a* or the switch SW3*a* corresponding to the decrement button 27*a* is pushed once while the time period display region 33*a* is designated with the underbar 36*a*, the parameter "1 day" can be selected by the underbar 36*a*. In the previously-defined setting, the parameter "24 hour" is selected by the underbar 36*a* at the outset. Alternatively, the parameter "1 day" may be initially selected by the underbar 36*a*. As can be seen in FIG. 5, the setting program of program number 3 is set to turn off, for a forenotice purpose, the lamps 2, 4, 6 and 8 of groups G3 and G4 at 18:00.

As shown in (a) of FIG. 8, if the switch SW5*a* corresponding to the selection button 29*a* is pushed while the parameter "24 hour" is selected by the underbar 36*a* in the time period display region 33*a* of the setting program of program number 3 (PGR3), the terminal control unit 15 designates the parameter "18:00" indicative of the turning-off time of the setting program with an underbar 37*a* as the primary key. The turning-off time can be arbitrarily changed by pushing the switch SW2*a* corresponding to the increment button 26*a* or the switch SW3*a* corresponding to the decrement button 27*a* while the underbar 37*a* is displayed in the setting content display area 32*a*. If the switch SW5*a* corresponding to the selection button 29*a* is pushed after the turning-off time has been changed by pushing the switch SW2*a* or the switch SW3*a*, the terminal control unit 15 designates the parameter "execute" indicating execution of the setting program of program number 3 with an underbar 38*a* as the primary key. In the previously-defined setting, the parameter "execute" is selected by the underbar 38*a* at the outset. Alternatively, the parameter "withhold" may be initially selected by the underbar 38*a*.

As shown in (b) of FIG. 8, if the parameter "withhold" is selected by pushing the switch SW2*a* corresponding to the increment button 26*a* or the switch SW3*a* corresponding to the decrement button 27*a* while the underbar 38*a* is displayed in the setting content display area 32*a*, the terminal control unit 15 removes the underbar 37*a* from the setting content display area 32*a*. The parameter "withhold" shown in (b) of FIG. 8 indicates that the setting program of program number 3 is not executed. If the switch SW6*a* corresponding to the setting button 30*a* is pushed while the parameter "withhold" is selected by the underbar 38*a* as shown in (b) of FIG. 8, the terminal control unit 15 additionally sets a non-execution flag in the setting program of program number 3 and stores the setting program in the memory 16.

Description will now be made on the examples shown in (c) and (d) of FIG. 8. As shown in (c) of FIG. 8, upon pushing the switch SW4*a* corresponding to the mode selection button 28*a*, the terminal control unit 15 designates the "timer mode" of the mode display area 31*a* with the underbar 34*a*. At this time, the terminal control unit 15 causes the display unit 17 to initially display the parameter "PGR3" indicating the setting program of program number 3 (PGR3) in the setting content display area 32*a*. The setting program initially displayed upon selecting the timer mode from the mode display area 31*a* may be an arbitrary one set by the previously-defined setting.

In case where the setting program of program number 3 (PGR3) is displayed in the setting content display area 32*a* as shown in (c) of FIG. 8, the terminal control unit 15 designates the parameter "PGR3" displayed in the setting content display area 32*a* with the underbar 35*a*. Upon pushing the switch SW2*a* corresponding to the increment button 26*a* or the switch SW3*a* corresponding to the decrement button 27*a* while the parameter "PGR3" is selected by the underbar 35*a*, the terminal control unit 15 causes the display unit 17 to display the setting program of arbitrary program number corresponding to the number of pushing times. For example, if the switch SW2*a* corresponding to the increment button 26*a* is pushed once while the parameter "PGR3" is selected by the underbar 35*a*, the setting program of program number 4 corresponding to the parameter "PGR 4" is displayed in the setting content display area 32*a*.

In case where a parameter changing task is performed with respect to the setting program of program number 3 (PGR3) displayed in the setting content display area 32*a* shown in (c) of FIG. 8, the terminal control unit 15 designates the time period display region 33*a* in the setting content display area 32*a* with the underbar 36*a* upon pushing the switch SW6*a* corresponding to the setting button 30*a* while the parameter "PGR3" is selected by the underbar 35*a*

By pushing the switch SW2*a* corresponding to the increment button 26*a* or the switch SW3*a* corresponding to the decrement button 27*a* while the underbar 36*a* is displayed in the time period display region 33*a*, the parameter "24 hour" can be selected by the underbar 36*a*. As can be seen in FIG. 5, the setting program of program number 3 is set to turn off, for a forenotice purpose, the lamps 2, 4, 6 and 8 of groups G3 and G4 at 18:00.

As shown in (c) of FIG. 8, if the switch SW5*a* corresponding to the selection button 29*a* is pushed while the parameter "1 day" is selected by the underbar 36*a* in the time period display region 33*a* of the setting program of program number 3 (PGR3) displayed in the setting content display area 32*a*, the terminal control unit 15 designates the parameter "Monday-Friday" indicative of the turning-off control day of the setting program with the underbar 37*a*. By pushing the switch SW2*a* corresponding to the increment button 26*a* or the switch SW3*a* corresponding to the decrement button 27*a* while the underbar 37*a* is displayed in the setting content display area 32*a*, it is possible to arbitrarily change the turning-off control day. For example, the parameter "Monday-Friday" is displayed if the switch SW2*a* corresponding to the increment button 26*a* is pushed once. The weekday parameters selectively displayed depending on the number of pushing times of the increment button 26*a* or the decrement button 27*a* may be previously set on a periodical basis. If the switch SW5*a* corresponding to the selection button 29*a* is pushed after the turning-off control day has been changed by pushing the switch SW2*a* corresponding to the increment button 26*a* or the switch SW3*a* corresponding to the decrement button 27*a*, the terminal control unit 15 designates the parameter "execute" indicative of execution of the setting program of program number 3 with the underbar 38*a*.

As shown in (d) of FIG. 8, if the parameter "withhold" is selected by pushing the switch SW2*a* corresponding to the increment button 26*a* or the switch SW3*a* corresponding to the decrement button 27*a* while the underbar 38*a* is displayed in the setting content display area 32*a*, the terminal control unit 15 removes the underbar 37*a* and the turning-off control day from the setting content display area 32*a*. The parameter "withhold" shown in (d) of FIG. 8 indicates that the setting program of program number 3 is not executed. If the switch SW6*a* corresponding to the setting button 30*a* is pushed while the parameter "withhold" as shown in (d) of FIG. 8 is selected by the underbar 38*a*, the terminal control unit 15 additionally sets a non-execution flag in the setting program of program number 3 and stores the setting program in the memory 16.

While not shown in (a) to (d) of FIG. 8, the terminal control unit 15 may designate the control target group of the setting program with an underbar (not shown) to enable a user to change the control target group. In this case, the control target group of the setting program can be arbitrarily changed by pushing the switch SW2*a* corresponding to the increment button 26*a* or the switch SW3*a* corresponding to the decrement button 27*a* a specified number of times.

Figure 9:
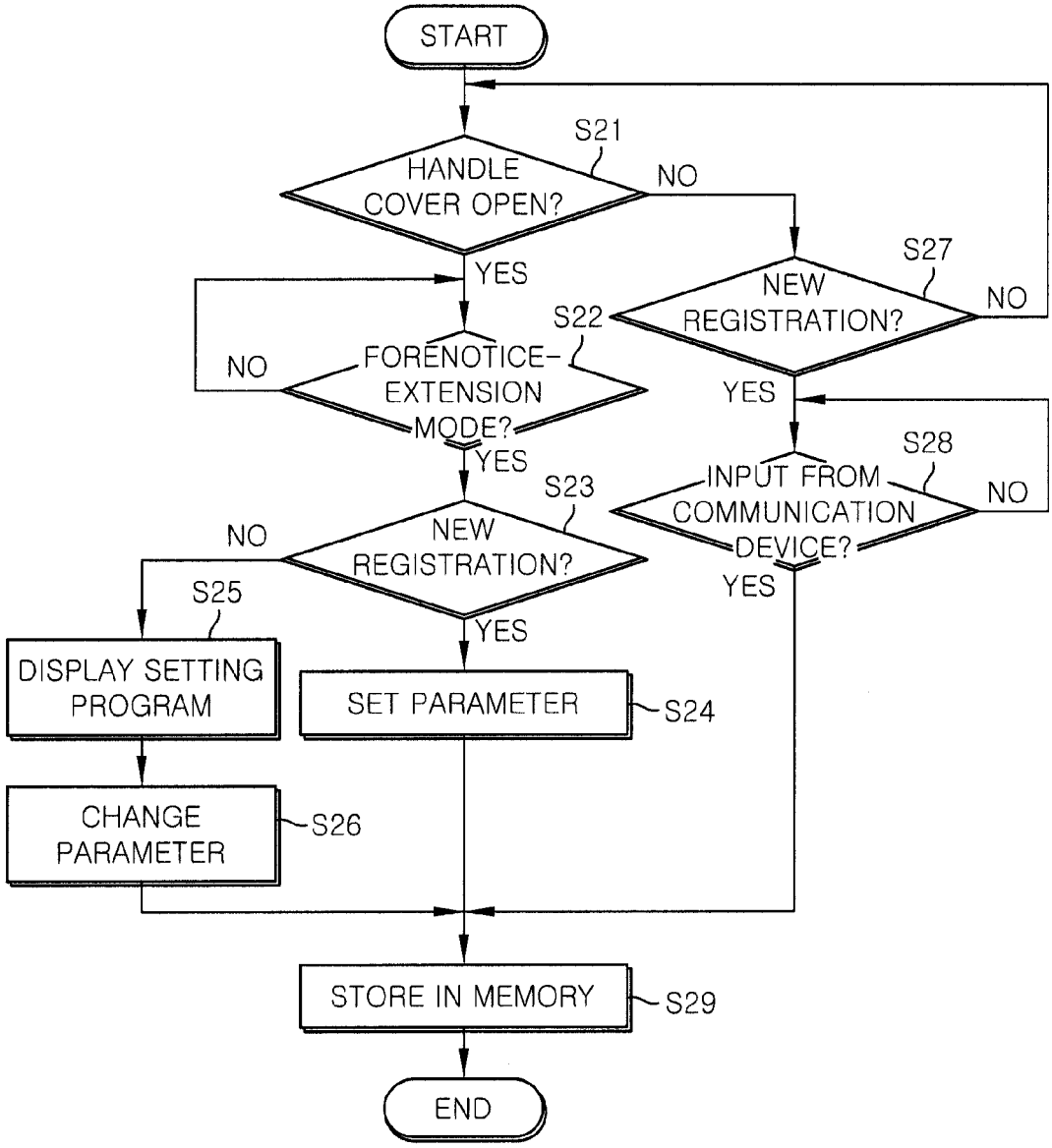
FIG. 9 is a flowchart explaining a process of newly registering or changing a setting program in a forenotice-extension mode.
Figure 10:
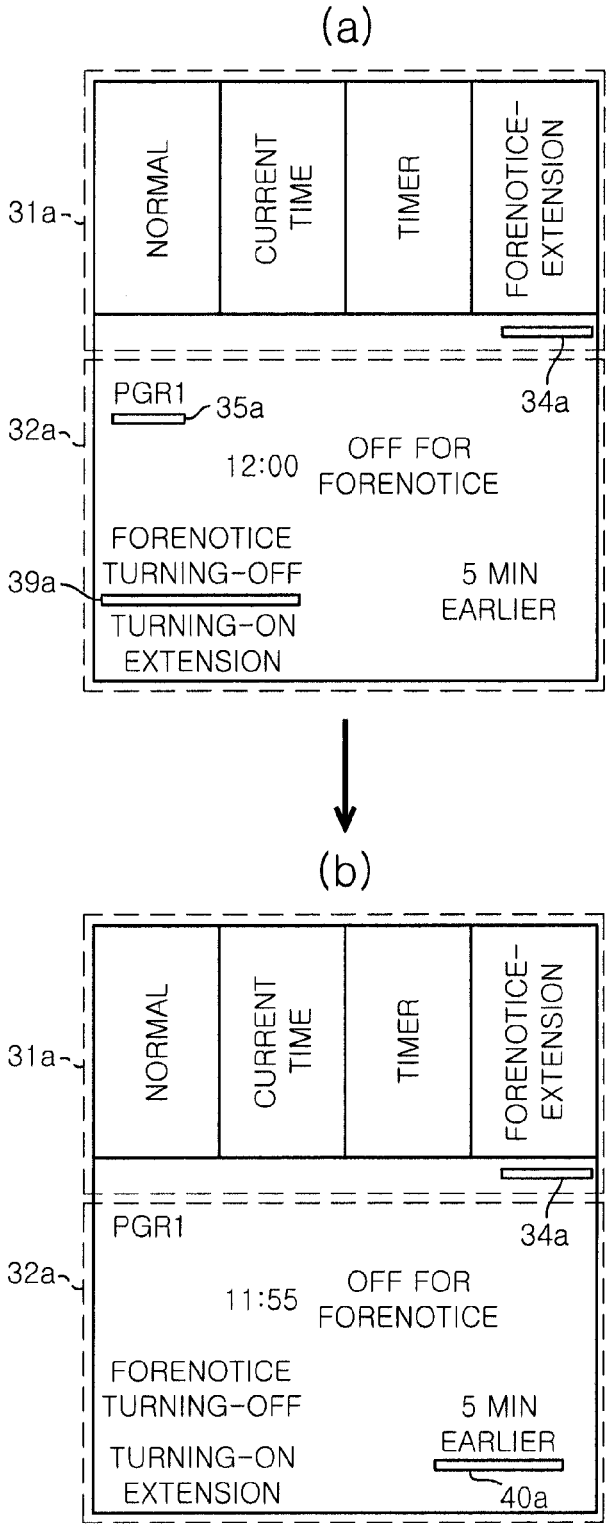
FIG. 10 illustrate examples of screen images available before and after changing the setting program in the forenotice-extension mode, (a) of FIG. 10 being a screen image available before changing the forenotice turning-off time and (b) of FIG. 10 being a screen image available after changing the forenotice turning-off time.
Figure 11:
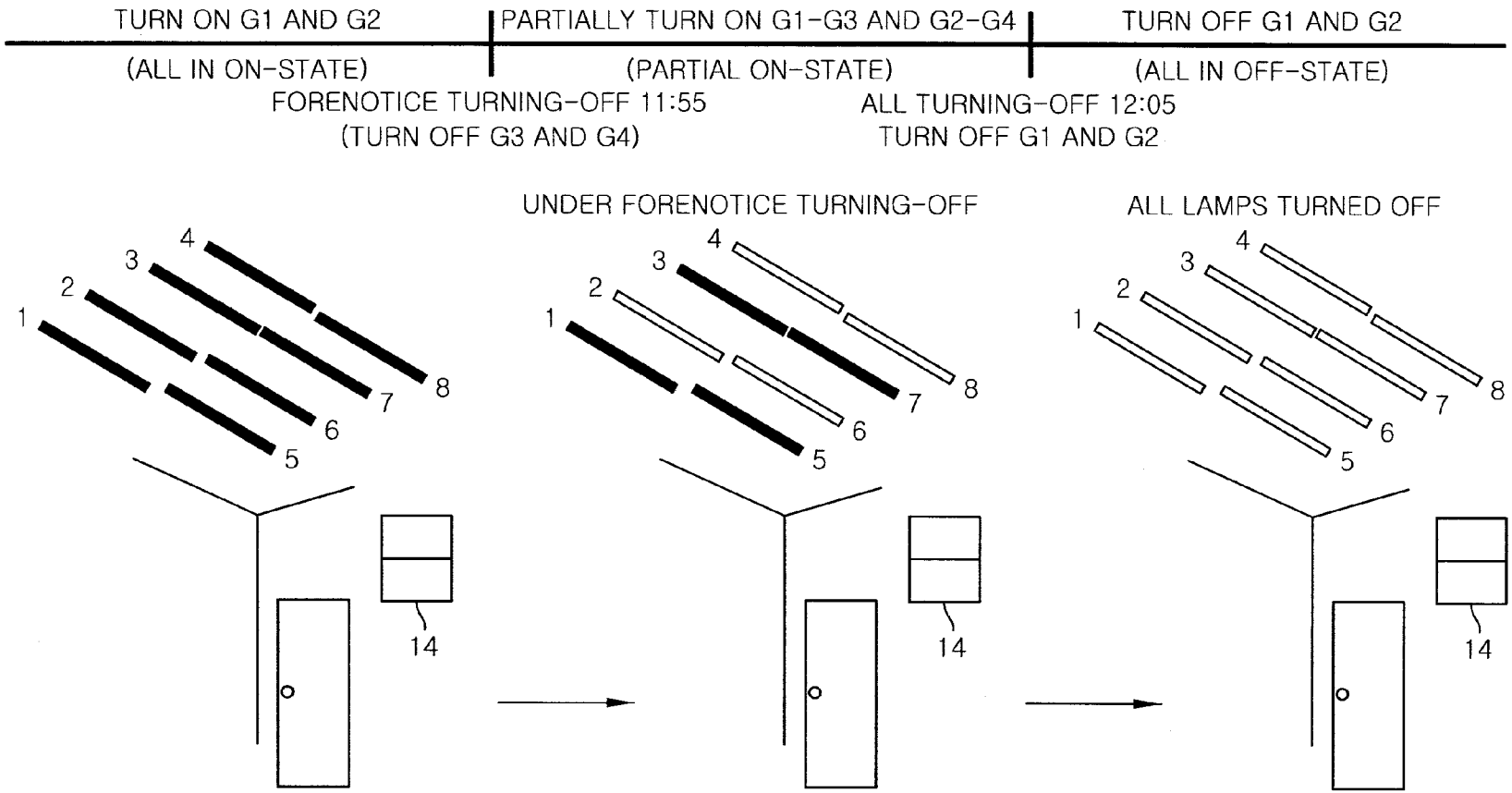
FIG. 11 is an explanatory view illustrating a time-dependent change in the on-state of the lamps.
Figure 12:
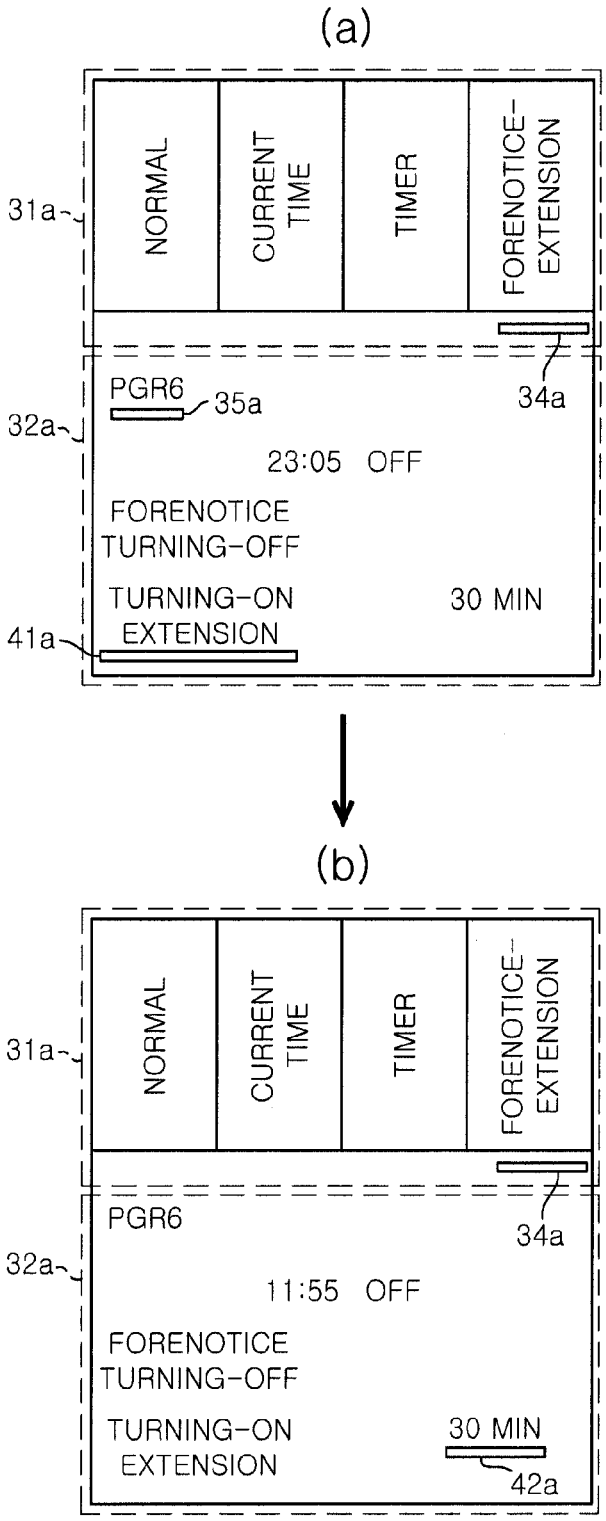
FIG. 12 illustrate examples of screen images available before and after changing the setting program in the forenotice-extension mode, (a) of FIG. 12 being a screen image available before changing the turning-on extension time and (a) of FIG. 12 being a screen image available after changing the turning-on extension time.
Figure 13:
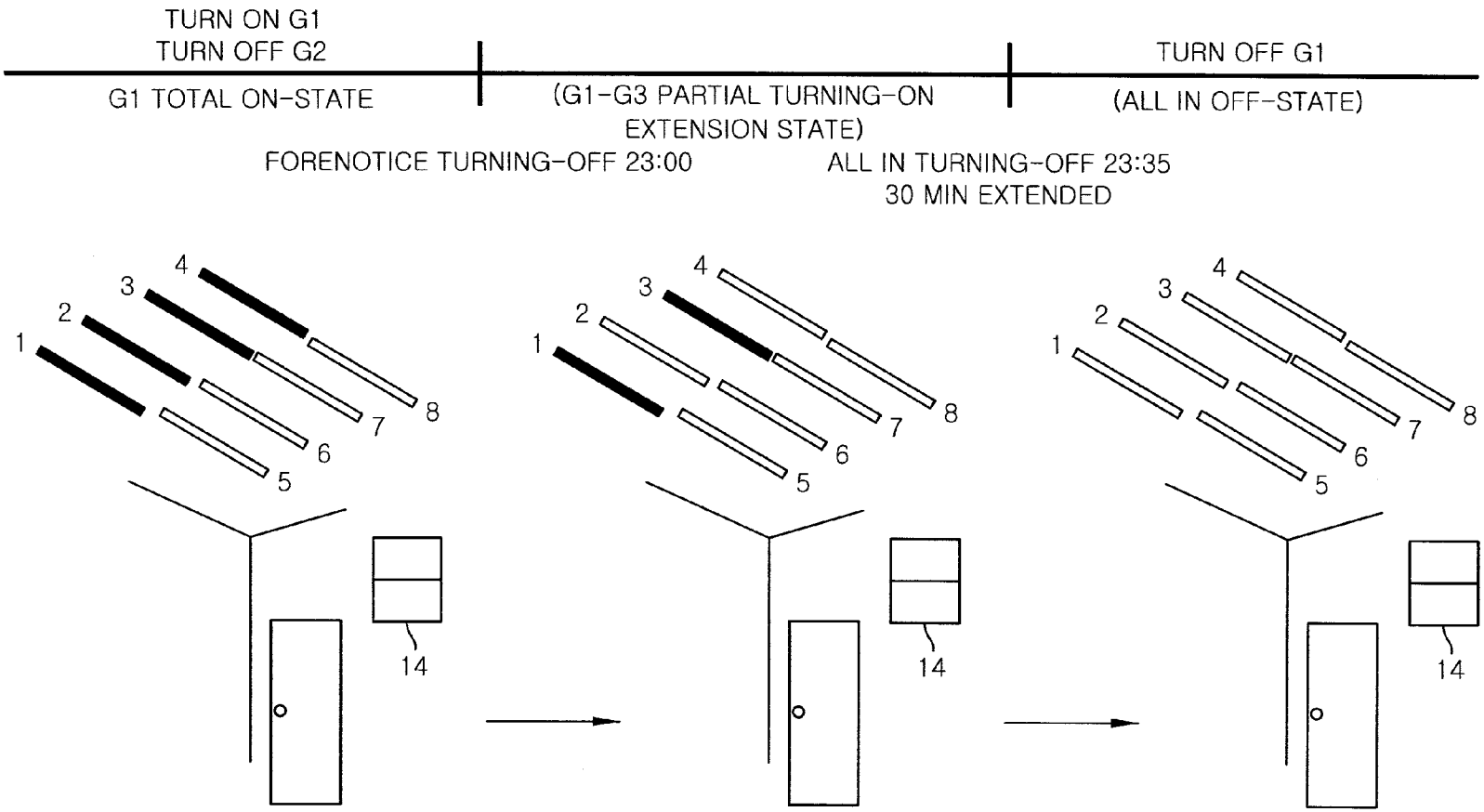
FIG. 13 is an explanatory view illustrating the time-dependent change in the on-state of the lamps.

Next, a process of newly registering or changing the setting program in the forenotice-extension mode will be described with reference to FIGS. 9 to 13. FIG. 9 is a flowchart explaining a process of newly registering or changing the setting program in the forenotice-extension mode. FIG. 10 show examples of screen images available before and after changing the forenotice turning-off time of the setting program in the forenotice-extension mode, (a) of FIG. 10 illustrating a screen image available before changing the forenotice turning-off time and (b) of FIG. 10 illustrating a screen image available after changing the forenotice turning-off time. FIG. 11 is an explanatory view illustrating the time-dependent change of the on-state of the lamps 1 to 8. FIG. 12 show examples of screen images available before and after changing the turning-on extension time of the setting program in the forenotice-extension mode, (a) of FIG. 12 illustrating a screen image available before changing the turning-on extension time and (b) of FIG. 12 illustrating a screen image available after changing the turning-on extension time. FIG. 13 is an explanatory view illustrating the time-dependent change of the on-state of the lamps 1-8. In the description made with reference to FIGS. 9 to 13, it is assumed that the first operation unit is used by way of example.

Referring to FIG. 9, the input detection unit 20 of the illumination control terminal 14 detects whether the handle cover HC1 is in an open state (step S21). If it is detected that the handle cover HC1 is in the open state (YES in step S21), the terminal control unit 15 designates the "forenotice-extension mode" of the mode display area 31*a* with an underbar 34*a* as the switch SW4*a* (see FIG. 6) corresponding to the mode selection button 28*a* is pushed a specified number of times (step S22).

If the "forenotice-extension mode" is designated with the underbar 34*a* (YES in step S22), the terminal control unit 15 causes the display unit 17 to display menus of the forenotice-extension mode in the setting content display area 32*a*. If an input indicative of the new registration of a setting program is made through the displayed menus (YES in step S23), various kinds of parameters (e.g., the groups of the lamps to be controlled and the set time at which the lamps are to be turned on or off) of the setting program to be newly registered are set (step S24). Based on the parameters thus set, the terminal control unit 15 generates a setting program and stores the setting program in the memory 16 (step S29). Thus, the process shown in FIG. 9 comes to an end.

If an input indicative of the change of a setting program is made through the menus of the forenotice-extension mode displayed in the setting content display area 32*a* (NO in step S23), the terminal control unit 15 causes the display unit 17 to display one of the setting programs shown in FIG. 5 in the setting content display area 32*a* as shown in (a) of FIG. 10 or (a) of FIG. 12 (step S25). The setting program thus displayed may be either a setting program whose program number is initially set to be displayed at the outset or a previous setting program displayed just before. When displaying the previous setting program, the terminal control unit 15 may have the memory 16 to store the program number of the previous setting program and cause the display unit 17 to display the setting programs based on the program number of the previous setting program stored in the memory 16.

After the setting program is displayed as shown in (a) of FIG. 10 or (a) of FIG. 12, one of the switch SW2*a* corresponding to the increment button 26*a*, the switch SW3*a* corresponding to the decrement button 27*a*, the switch SW5*a* corresponding to the selection button 29*a* and the switch SW6*a* corresponding to the setting button 30*a* is operated so that the terminal control unit 15 can change the parameters of the setting program (step S26). The terminal control unit 15 causes the memory 16 to store the setting program thus changed (step S29). Thereafter, the process shown in FIG. 9 comes to an end.

If it is detected in step S21 that the handle cover HC1 is not in the open state (NO in step S21) and if the setting program is to be newly registered (YES in step S27), the control signal on the new registration of the setting program issued by the setting communications device 50 is inputted to the communications unit 25 of the illumination control terminal 14 (YES in step S28). The communications unit 25 receives the control signal thus inputted and notifies the terminal control unit 15 of the fact that it has received the control signal. Upon receiving the notice that the communications unit 25 has received the signal on the new registration of a setting program from the setting communications device 50, the terminal control unit 15 acquires the setting program and causes the memory 16 to store the setting program (step S29). Thus, the process shown in FIG. 9 comes to an end.

Description will now be made on the examples shown in (a) and (b) of FIG. 10. As shown in (a) of FIG. 10, upon pushing the switch SW4*a* corresponding to the mode selection button 28*a*, the terminal control unit 15 designates the "forenotice-extension mode" of the mode display area 31*a* with the underbar 34*a*. At this time, the terminal control unit 15 causes the display unit 17 to initially display the parameter "PGR1" indicating the setting program of program number 1 (PGR1) in the setting content display area 32*a*. The setting program initially displayed upon selecting the forenotice-extension mode from the mode display area 31*a* may be an arbitrary one set by the previously-defined setting.

In case where the setting program of program number 1 (PGR1) is displayed in the setting content display area 32*a* as shown in (a) of FIG. 10, the terminal control unit 15 designates the parameter "PGR1" displayed in the setting content display area 32*a* with an underbar 35*a* as a primary key. Upon pushing the switch SW2*a* corresponding to the increment button 26*a* or the switch SW3*a* corresponding to the decrement button 27*a* while the parameter "PGR1" is selected by the underbar 35*a*, the terminal control unit 15 causes the display unit 17 to display the setting program of arbitrary program number corresponding to the number of pushing times. For example, if the switch SW2*a* corresponding to the increment button 26*a* is pushed once while the parameter "PGR1" is selected by the underbar 35*a*, the setting program of program number 2 corresponding to the parameter "PGR 2" is displayed in the setting content display area 32*a*.

The setting program of program number 1 shown in (a) of FIG. 10 is set to turn off, for a forenotice purpose, the lamps 2, 4, 6 and 8 of groups G2 and G4 at 12:00 as illustrated in FIG. 5. In case where a parameter changing task is performed with respect to the setting program of program number 1 (PGR1) displayed in the setting content display area 32*a* shown in (a) of FIG. 10, the terminal control unit 15 designates the parameter "forenotice turning-off time" displayed in the setting content display area 32*a* with an underbar 39*a* as the primary key upon pushing the switch SW6*a* corresponding to the setting button 30*a* while the parameter "PGR3" is selected by the underbar 35*a*. If the parameter "forenotice turning-off time" is designated with the underbar 39*a* as illustrated in (a) of FIG. 10, the terminal control unit 15 of the illumination control terminal 14 is capable of changing the forenotice turning-off time of the setting program of program number 1. In the first embodiment, the parameter "forenotice turning-off time" can be selected from "none", "5 min earlier" and "10 min earlier". However, the parameter "forenotice turning-off time" may be arbitrarily set.

If the switch SW5*a* corresponding to the selection button 29*a* is pushed while the parameter "forenotice turning-off time" is selected by the underbar 39*a*, the terminal control unit 15 designates the parameter "5 min earlier" indicative of one selection option of the forenotice turning-off time of the setting program with an underbar 40*a* as the primary key as illustrated in (b) of FIG. 10. By pushing the switch SW2*a* corresponding to the increment button 26*a* or the switch SW3*a* corresponding to the decrement button 27*a* while the underbar 40*a* is displayed in the setting content display area 32*a*, it becomes possible to select one of the parameters "none", "5 min earlier" and "10 min earlier" as the forenotice turning-off time.

In case where the switch SW6*a* corresponding to the setting button 30*a* is pushed after the forenotice turning-off time has been changed to the parameter "5 min earlier" by pushing the switch SW2*a* corresponding to the increment button 26*a* or the switch SW3*a* corresponding to the decrement button 27*a*, the terminal control unit 15 causes the memory 16 to store the setting program of program number 1 in which the forenotice turning-off time is set to 11:55.

While not shown in (a) and (b) of FIG. 10, the terminal control unit 15 may designate the control target group of the setting program with an underbar (not shown) to enable a user to change the control target group. In this case, the control target group of the setting program can be arbitrarily changed by pushing the switch SW2*a* corresponding to the increment button 26*a* or the switch SW3*a* corresponding to the decrement button 27*a* a specified number of times.

The variations in the on/off time of the lamps 1 to 8 depending on the setting program of program number 1 changed as above and the setting program of program number 2 will be described with reference to FIG. 11. Referring to FIG. 11, the lamps 1 to 8 are all kept in an on-state (which is called "all in on-state") until the newly-set forenotice turning-off time, 11:55, in accordance with the setting program of program number 1 stored in the memory 16. If the current time coincides with the forenotice turning-off time of the setting program of program number 1, 11:55, the terminal control unit 15 of the illumination control terminal 14 outputs to the operation control unit 13 a control signal for turning off, for a forenotice purpose, the lamps 2, 4, 6 and 8 of groups G3 and G4 in accordance with the setting program of program number 1. Responsive to this control signal, the operation control unit 13 controls the lamps 2, 4, 6 and 8 so that they can be turned off for a forenotice purpose (which is called a "partial on-state"). If the current time coincides with the all turning-off time of the setting program of program number 2, 12:05, the terminal control unit 15 outputs to the operation control unit 13 a control signal for turning off all the lamps 1 to 8 of groups G1 and G2 in accordance with the setting program of program number 2. Responsive to this control signal, the operation control unit 13 controls the lamps 1 to 8 so that they can be turned off in their entirety (which is called "all in off-state").

Description will now be made on the examples shown in (a) and (b) of FIG. 12. As shown in (a) of FIG. 10, upon pushing the switch SW4*a* corresponding to the mode selection button 28*a*, the terminal control unit 15 designates the "forenotice-extension mode" of the mode display area 31*a* with the underbar 34*a*. At this time, the terminal control unit 15 causes the display unit 17 to initially display the parameter "PGR1" indicating the setting program of program number 1 (PGR1) in the setting content display area 32*a*. The setting program initially displayed upon selecting the forenotice-extension mode from the mode display area 31*a* may be an arbitrary one set by the previously-defined setting.

In case where the setting program of program number 1 (PGR1) is displayed in the setting content display area 32*a* as shown in (a) of FIG. 10, the terminal control unit 15 designates the parameter "PGR1" displayed in the setting content display area 32*a* with the underbar 35*a*. Upon pushing the switch SW2*a* corresponding to the increment button 26*a* or the switch SW3*a* corresponding to the decrement button 27*a* while the parameter "PGR1" is selected by the underbar 35*a*, the terminal control unit 15 causes the display unit 17 to display the setting program of arbitrary program number corresponding to the number of pushing times. (a) of FIG. 12 is a screen image showing that the terminal control unit 15 causes the display unit 17 to display the setting program of program number 6, which is set by pushing the switch SW2*a* corresponding to the increment button 26*a* or the switch SW3*a* corresponding to the decrement button 27*a* a specified number of times.

The setting program of program number 6 shown in (a) of FIG. 12 is set to turn off the lamps 1 to 4 of group G1 at 23:05 as illustrated in FIG. 5.

In case where a parameter changing task is performed with respect to the setting program of program number 6 (PGR6) displayed in the setting content display area 32*a* shown in (a) of FIG. 12, the terminal control unit 15 designates the parameter "turning-on extension time" displayed in the setting content display area 32*a* with an underbar 41*a* as a primary key upon pushing the switch SW6*a* corresponding to the setting button 30*a* while the parameter "PGR6" is selected by the underbar 35*a*. If the parameter "turning-on extension time" is designated with the underbar 41*a* as illustrated in (a) of FIG. 12, the terminal control unit 15 of the illumination control terminal 14 is capable of changing the turning-on extension time of the setting program of program number 6. In the first embodiment, the parameter "turning-on extension time" can be selected from "30 min" and "1 hour". However, the parameter "turning-on extension time" may be arbitrarily set.

If the switch SW5*a* corresponding to the selection button 29*a* is pushed while the parameter "turning-on extension time" is selected by the underbar 41*a*, the terminal control unit 15 designates the parameter "30 min" indicative of one selection option of the turning-on extension time of the setting program with an underbar 42*a* as the primary key as illustrated in (b) of FIG. 12. By pushing the switch SW2*a* corresponding to the increment button 26*a* or the switch SW3*a* corresponding to the decrement button 27*a* while the underbar 42*a* is displayed in the setting content display area 32*a*, it becomes possible to select one of the parameters "30 min" and "1 hour" as the turning-on extension time.

In case where the setting button 30*a* is pushed after the turning-on extension time has been changed to the parameter "30 min" by pushing the switch SW2*a* corresponding to the increment button 26*a* or the switch SW3*a* corresponding to the decrement button 27*a*, the terminal control unit 15 causes the memory 16 to store the setting program of program number 6 in which the turning-on extension time is set to 23:35.

While not shown in (a) and (b) of FIG. 12, the terminal control unit 15 may designate the control target group of the setting program with an underbar (not shown) to enable a user to change the control target group. In this case, the control target group of the setting program can be arbitrarily changed by pushing the switch SW2*a* corresponding to the increment button 26*a* or the switch SW3*a* corresponding to the decrement button 27*a* a specified number of times.

The variations in the on/off time of the lamps 1 to 8 depending on the setting program of program number 5 and the setting program of program number 6 changed as above will be described with reference to FIG. 13. Referring to FIG. 13, the lamps 1 to 4 of group G1 are kept in an on-state (which is called "all of G1 in on-state") until the forenotice turning-off time, 23:00, previously set in the setting program of program number 5 stored in the memory 16, but the lamps 5 to 8 of group G2 is kept in an off-state. If the current time coincides with the forenotice turning-off time of the setting program of program number 5, 23:00, the terminal control unit 15 of the illumination control terminal 14 outputs to the operation control unit 13 a control signal for turning off, for a forenotice purpose, the lamps 2 and 4 of groups G3 in accordance with the setting program of program number 5. Responsive to this control signal, the operation control unit 13 controls the lamps 2 and 4 so that they can be turned off for a forenotice purpose (which is called a "G1-G3 partial on-state"). If the current time coincides with the all turning-off time of the setting program of program number 6, 23:35, the terminal control unit 15 outputs to the operation control unit 13 a control signal for turning off all the lamps 1 to 4 of group G1 in accordance with the setting program of program number 6. Responsive to this control signal, the operation control unit 13 controls the lamps 1 to 4 so that they can be turned off in their entirety (which is called "all in off-state").

As described above, the illumination control terminal in accordance with the first embodiment of the present invention includes the frame K to which the handle cover HC1 (or HC2) is pivotably attached for rotating about the pivot shaft J1 (or J2) extending in the longitudinal direction of the frame K. In particular, the operation panel SWa (or SWb) for outputting a control signal on the on/off operation of the lamps 1 to 8 is arranged on the front surface of the handle cover HC1 (or HC2). On the rear surface of the handle cover HC1 (or HC2), there are arranged the various kinds of buttons 26*a* to 30*a* (or 26*b* to 30*b*) as a setting operation unit for setting the kind and on/off time of the lamps 1 to 8 and the locking portion KC1 (or KC2) for keeping the handle cover HC1 (or HC2) in a closed state. On the front surface of the frame K, there are arranged the display unit 17 (or 18) for displaying the setting contents to be set by the various kinds of buttons 26*a* to 30*a* (or 26*b* to 30*b*) and the locked portion HKC1 (or HKC2) for keeping the handle cover HC1 (or HC2) in a closed state through engagement with the locking portion KC1 (or KC2).

Built-in in the frame K are the memory 16 as a storage unit storing the setting programs set by the various kinds of buttons 26*a* to 30*a* (or 26*b* to 30*b*) and the terminal control unit 15 provided with the internal clock C3 as a clock for indicating the current time. The terminal control unit 15 is designed to output a control signal on the on/off operation of the lamps 1 to 8 upon pushing the operation panel SWa (or SWb) or in accordance with the setting program in case where the current time indicated by the internal clock C3 coincides with the set time of the setting program stored in the memory 16.

With the illumination control terminal 14 in accordance with the first embodiment, in case where the handle cover HC1 (or HC2) is in an open state, it is possible to efficiently and easily perform the setting of the lamps to be turned on or off by pushing one of the operation panels SWa and SWb through the setting communications device 50 or through the display unit 17 and the various kinds of buttons 26*a* to 30*a* (or the display unit 18 and the various kinds of buttons 26*b* to 30*b*). In case where the handle cover HC1 (or HC2) is in a closed state, the operation of the lamps 1 to 8 set to be turned on or off upon pushing the operation panels SWa and SWb can be controlled within the installation area much smaller in space than the installation area of the conventional illumination control terminal 14*z*.

The setting program may include contents with which all or some of the lamps 1 to 8 are collectively turned off at a specified set time. In this case, the illumination control terminal 14 can collectively turn off all or some of the lamps 1 to 8 at the specified set time in accordance with the setting program regardless of whether the operation panel SWa or SWb is pushed or not.

The setting program may include contents with which some of the lamps 1 to 8 are turned off before the specified set time. In this case, the illumination control terminal 14 can collectively turn off some of the lamps 1 to 8 just before the specified set time in accordance with the setting program regardless of whether the operation panel SWa or SWb is pushed or not.

The turning-off time of the setting program may be set by the various kinds of buttons 26*a* to 30*a* (or 26*b* to 30*b*) as a setting operation unit. Moreover, the turning-off time may be extended by using the setting operation unit. In this case, the illumination control terminal 14 of the first embodiment can efficiently set the setting program stored in the memory 16 on a case-by-case basis by using the various kinds of buttons 26*a* to 30*a* (or 26*b* to 30*b*).

The illumination control terminal 14 of the first embodiment includes the LED lamp 23 (or 24) as a notification unit for notifying a user of the on/off state of the lamps 1 to 8. The LED lamp 23 (or 24) emits first-color light (red light) to notify the on-state of the lamps 1 to 4 and emits second-color light (green light) to notify the off-state of the lamps 5 to 8. By providing the LED lamp 23 (or 24), the illumination control terminal 14 of the first embodiment can show the on/off state of the lamps 1 to 8 in an appropriate manner.

Second Embodiment

Configuration of Illumination Control System 100'

Figure 14:
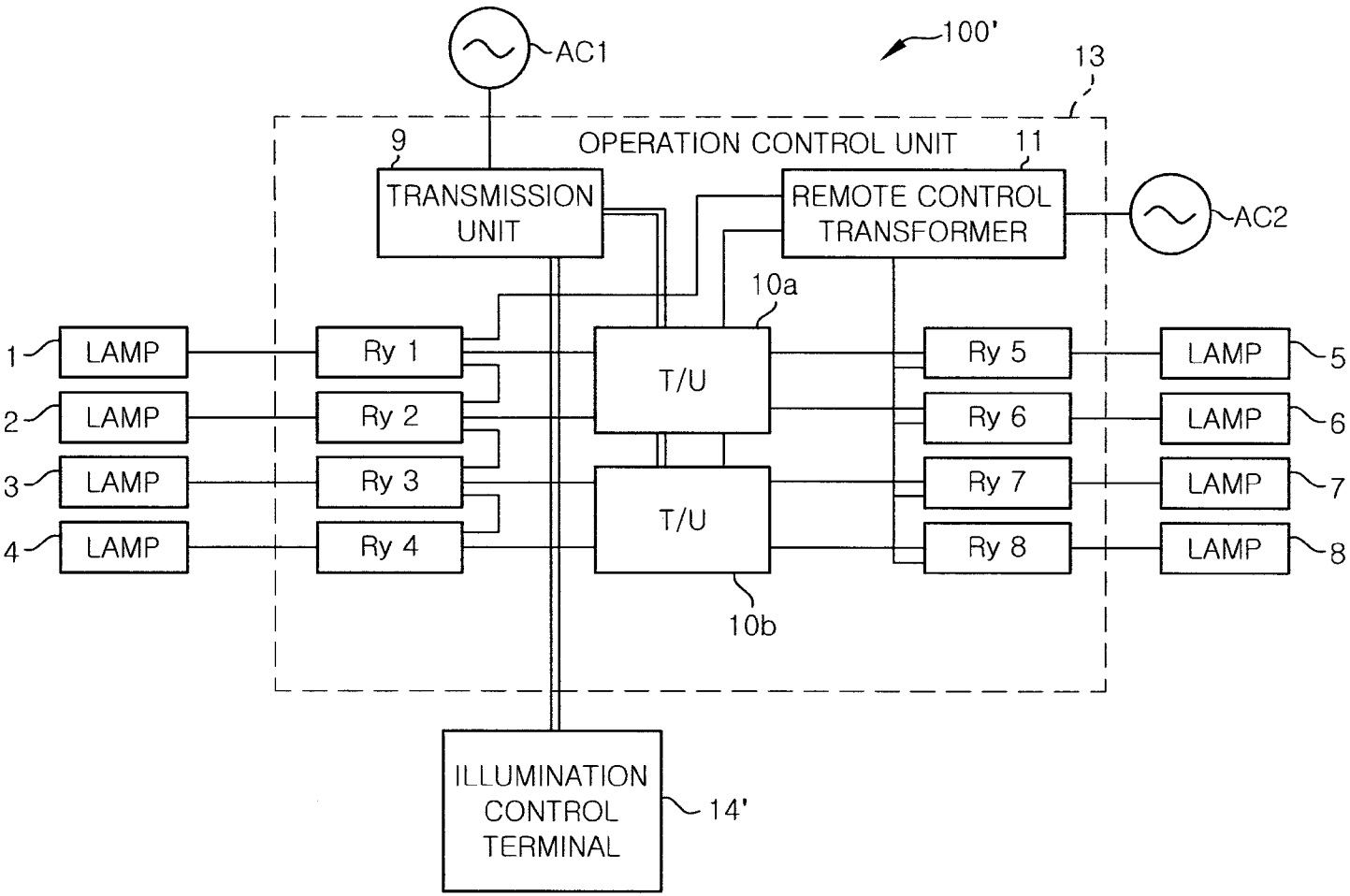
FIG. 14 is an explanatory view showing a system configuration of an illumination control system in accordance with a second embodiment of the present invention.
Figures 15A, 15B, 15C, 15D:
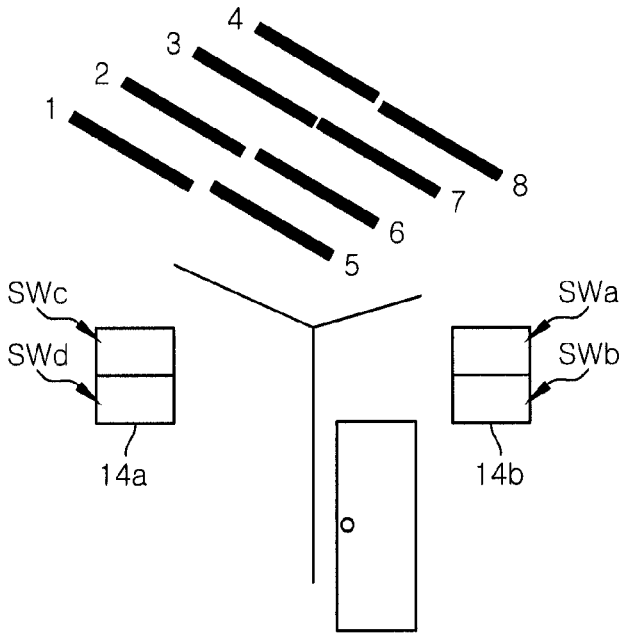
FIGS. 15A to 15D are explanatory views showing an arrangement of lamps, a correspondence relationship between the lamps and their addresses, a correspondence relationship between the groups and their addresses and a correspondence relationship between the operation panels and the groups, FIG. 15A being an explanatory view depicting the arrangement of lamps, FIG. 15B being an explanatory view illustrating the correspondence relationship between the lamps and their addresses, FIG. 15C being an explanatory view illustrating the correspondence relationship between the groups and their addresses, and FIG. 15D being an explanatory view illustrating the correspondence relationship between the operation panels and the groups.

The configuration of an illumination control system 100' in accordance with a second embodiment, which includes an illumination control terminal 14' as an illumination switch, will be described with reference to FIGS. 14 to 15D. A basic configuration of the illumination control system 100' of the second embodiment shown in FIG. 14 is substantially the same as the configuration of the illumination control system 100 of the first embodiment shown in FIG. 1. The illumination control system 100' of the second embodiment differs from the illumination control system 100 of the first embodiment in that the illumination control system 100' includes the illumination control terminal 14' instead of the illumination control terminal 14. FIGS. 15A to 15D are explanatory views showing the arrangement of lamps 1-8, a correspondence relationship between the lamps 1-8 and their addresses, a correspondence relationship between the groups and their addresses and a correspondence relationship between the operation panels and the groups. The arrangement of the lamps and the correspondence relationships shown in FIGS. 15A to 15D are substantially the same as those shown in FIGS. 2A to 2D. One difference resides in that, as shown in FIG. 15A, the illumination control terminal 14' of the illumination control system 100' in the second embodiment includes an illumination control terminal 14*a* and an illumination control terminal 14*b*. Another difference lies in the correspondence relationship between the operation panels SWa', SWb', SWc' and SWd' and the groups of lamps to be turned on or off upon pushing the operation panels SWa', SWb', SWc' and SWd' (see FIG. 15D). Description will now be made on the points differing from the illumination control system 100 of the first embodiment. Like reference numerals will be given to like parts and the description thereof will be omitted. Further, since the illumination control terminal 14*a* has the same configuration as the illumination control terminal 14*b*, a configuration of the illumination control terminal 14*b* and an illumination control of the lamps 1-4 through the illumination control terminal 14*b* are mainly described hereinafter, and description of a configuration and an illumination control of the illumination control terminal 14*a* for controlling the lamps 5-8 is omitted. Further, the entire control of lamps 1-8 is described by using the illumination control terminal 14' when needed.

Referring to FIG. 15A, the illumination control terminal 14*b* includes operation panels SWa' and SWb' as its operation switch units while the illumination control terminal 14*a* includes operation panels SWc' and SWd' as its operation switch units. The correspondence relationship between the operation panels SWa', SWb', SWc' and SWd' and the groups of lamps to be turned on or off upon pushing the operation panels SWa', SWb', SWc' and SWd' will be described with reference to FIG. 15D. As can be seen in FIG. 15D, the lamps 1 to 4 belonging to group G1 are turned on or off upon pushing the operation panel SWa'. The lamps 2 and 4 belonging to group G3 are turned on or off upon pushing the operation panel SWb'. The lamps 5 to 8 belonging to group G2 are turned on or off upon pushing the operation panel SWc'. The lamps 6 and 8 belonging to group G4 are turned on or off upon pushing the operation panel SWd'.

Referring back to FIG. 14, the illumination control terminal 14' of the present embodiment outputs a control signal in the following two cases. In the first case, a control signal is automatically outputted from the illumination control terminal 14' if the current time coincides with the set time of the setting programs set by the illumination control terminal 14'. In the second case, a control signal is outputted if the operation panel SWa', SWb, SWc' or SWd' of the illumination control terminal 14' is manually pushed by a user. In the description made herein below, the setting programs defined above includes turning-off programs (see FIG. 20A) and repeated turning-off programs (see FIG. 20B).

In case where the setting programs are previously stored in both the transmission unit 9 and the illumination control terminal 14', the control signal automatically outputted at the set time in the first case contains the current time and the program numbers of the setting programs in which the current time is used as the set time. If the setting programs are previously stored only in the illumination control terminal 14', the control signal outputted from the illumination control terminal 14' in the first case contains the current time and the individual parameters (see FIGS. 20A and 20B) of the setting programs in which the current time is used as the set time.

In case where the setting programs are previously stored at least in both the transmission unit 9 and the illumination control terminal 14', the control signal outputted by the manual pushing operation in the second case contains the current time and information on the kind of the manually-pushed operation panel SWa', SWb', SWc' or SWd'. If the setting programs are previously stored only in the illumination control terminal 14', the control signal outputted from the illumination control terminal 14' in the second case contains the current time, the individual parameters (see FIGS. 20A and 20B) of the setting programs in which the current time is used as the set time, and information on the kind of the manually-pushed operation panel SWa', SWb', SWc' or SWd'.

(Configuration of Illumination Control Terminal 14')

Figure 16:
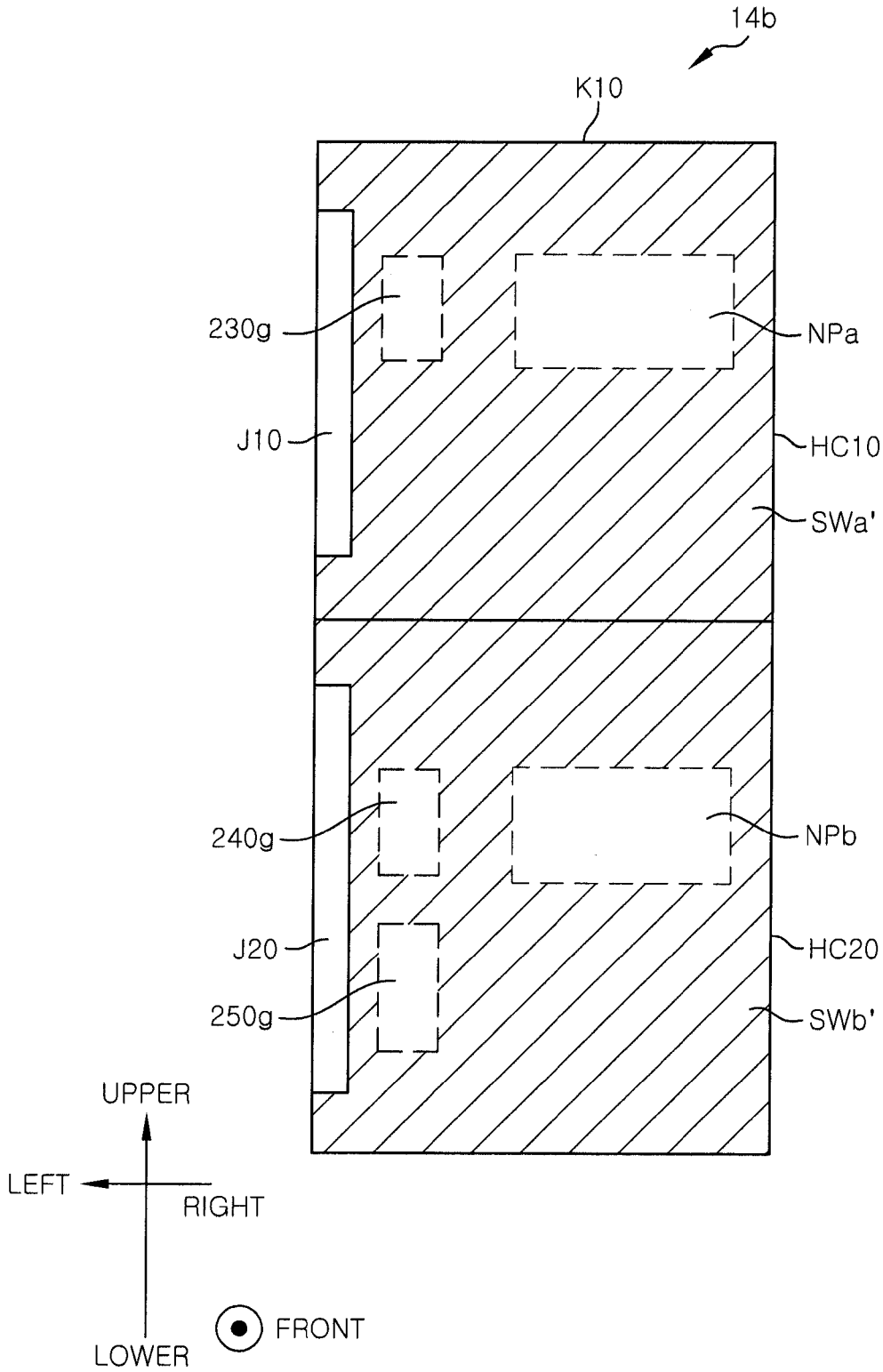
FIG. 16 is an outward appearance view showing an illumination control terminal with handle covers thereof kept in a closed state.
Figure 17:
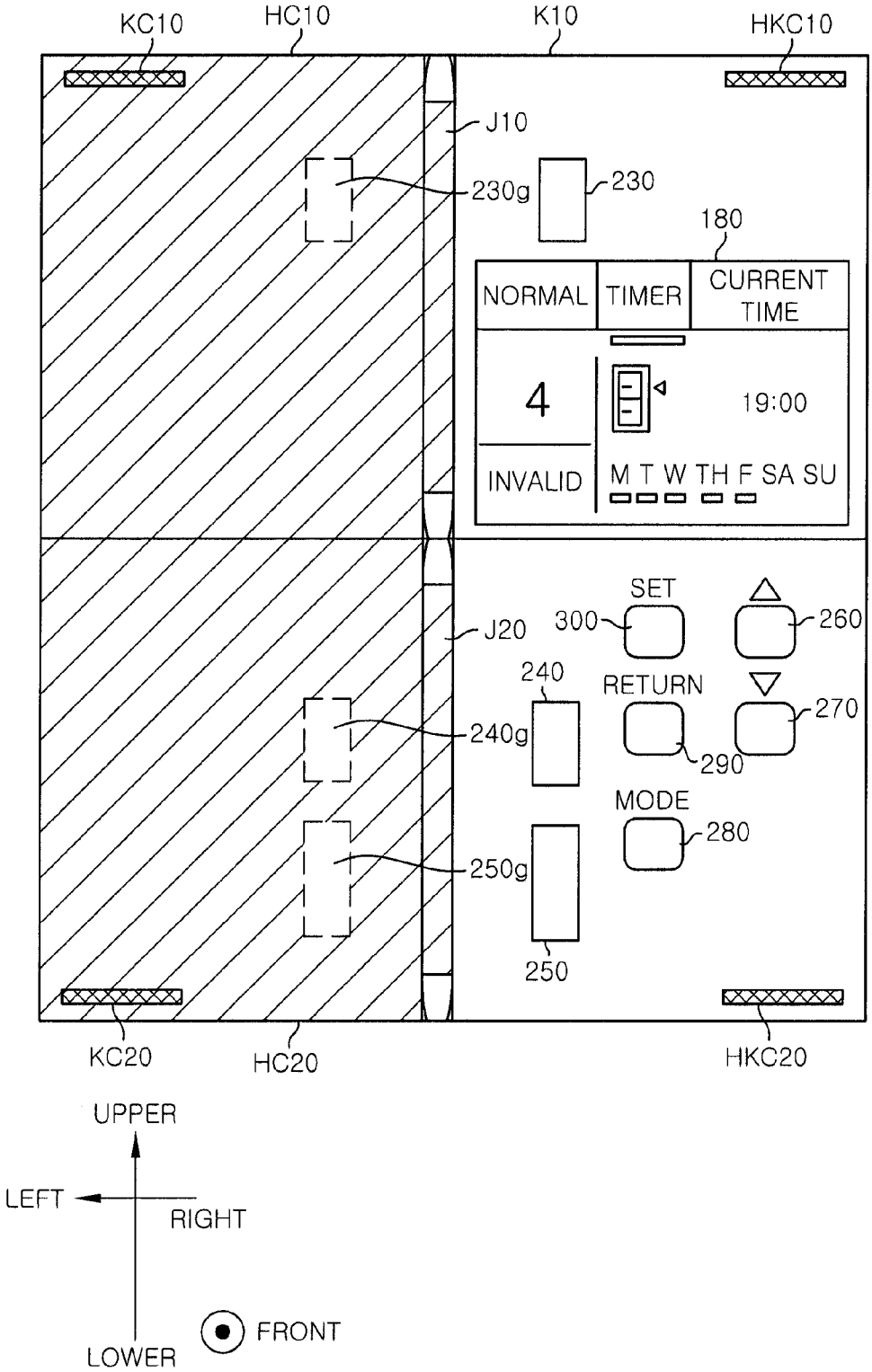
FIG. 17 is an outward appearance view showing the illumination control terminal with the handle covers thereof kept in an open state.

The illumination control terminal 14' outputs to the transmission unit 9 of the operation control unit 13 a control signal for controlling the on/off operation of the lamps 1 to 8. The details of the outward appearance of the illumination control terminal 14*b* will now be described with reference to FIGS. 16 and 17. FIG. 16 is an outward appearance view showing the illumination control terminal 14*b* of the second embodiment with handle covers HC10 and HC20 thereof kept in a closed state. FIG. 17 is an outward appearance view showing the illumination control terminal 14*b* of the second embodiment with the handle covers HC10 and HC20 thereof kept in an open state.

As shown in FIG. 16, the illumination control terminal 14*b* is used as an illumination switch and is visibly arranged on a wall surface of an office, a factory, a store or other place. The illumination control terminal 14*b* includes first and second operation units of generally equal size arranged on a very thin frame K10 of generally rectangular solid shape. The first operation unit includes an operation panel SWa' while the second operation unit includes an operation panel SWb'. The first and second operation units make up a setting operation unit of the illumination control terminal 14*b*.

The first operation unit includes at least a very thin frame K10 of generally rectangular solid shape, a pivot shaft J10 arranged on the front surface of the frame K10 to extend in the longitudinal direction of the frame K10 and the handle cover HC10 pivotably attached to the frame K10 for rotating about the pivot shaft J10. FIG. 16 shows the handle cover HC10 rotated by zero degree and kept in a closed state. As shown in FIG. 16, an operation panel SWa' and a name plate surface NPa are arranged on the front surface of the handle cover HC10. Also arranged on the front surface of the handle cover HC10 is a cutout portion 230*g*. The name plate surface NPa is a blank section in which the name of the division illuminated by the lamps 1 to 4 corresponding to the operation panel SWa', the number of the lamps 1 to 4 corresponding to the operation panel SWa' or other information is written. The cutout portion 230*g* is a through-hole through which the on/off state of an LED lamp 230 (to be described later with reference to FIG.

17) arranged on the front surface of the frame K10 can be observed even when the handle cover HC10 is kept in a closed state.

The second operation unit includes at least a very thin frame K10 of generally rectangular solid shape, a pivot shaft J20 arranged on the front surface of the frame K10 to extend in the longitudinal direction of the frame K10 and the handle cover HC20 pivotably attached to the frame K10 for rotating about the pivot shaft J20. As shown in FIG. 16, an operation panel SWb' and a name plate surface NPb are arranged on the front surface of the handle cover HC20. Also arranged on the front surface of the handle cover HC20 are cutout portions 240g and 250g. The name plate surface NPb is a blank section in which the name of the division illuminated by the lamps 2 and 4 corresponding to the operation panel SWb', the number of the lamps 2 and 4 corresponding to the operation panel SWb' or other information is written. The cutout portion 240g is a through-hole through which the on/off state of an LED lamp 240 (to be described later with reference to FIG. 17) arranged on the front surface of the frame K10 can be observed even when the handle cover HC20 is kept in a closed state. The cutout portion 250g is a through-hole that makes a communications unit 250 (to be described later with reference to FIG. 17) operable regardless of whether the handle cover HC20 is in an open state or a closed state.

Referring to FIG. 17, the cutout portion 230g set forth above and a locking portion KC10 for keeping the handle cover HC10 in a locked state through engagement with a locked portion HKC10 arranged on the front surface of the frame K10 are provided on the rear surface of the handle cover HC10. FIG. 17 shows the handle cover HC10 rotated by 180 degrees. As shown in FIG. 17, the cutout portions 240g and 250g set forth above and a locking portion KC20 for keeping the handle cover HC20 in a locked state through engagement with a locked portion HKC20 arranged on the front surface of the frame K10 are provided on the rear surface of the handle cover HC20.

The state in which the handle cover HC10 (or HC20) is locked to the frame K by the engagement of the locking portion KC10 (or KC20) and the locked portion HKC10 (or HKC20) as shown in FIG. 16 will be defined as a closed state of the handle cover HC10 (or HC20). The state in which the locking portion KC10 (or KC20) is disengaged from the locked portion HKC10 (or HKC20) as shown in FIG. 17 will be defined as an open state of the handle cover HC10 (or HC20).

As shown in FIG. 17, a display unit 180 and an LED lamp 230 are arranged on the front surface of the frame K10 of the first operation unit.

Figure 18:
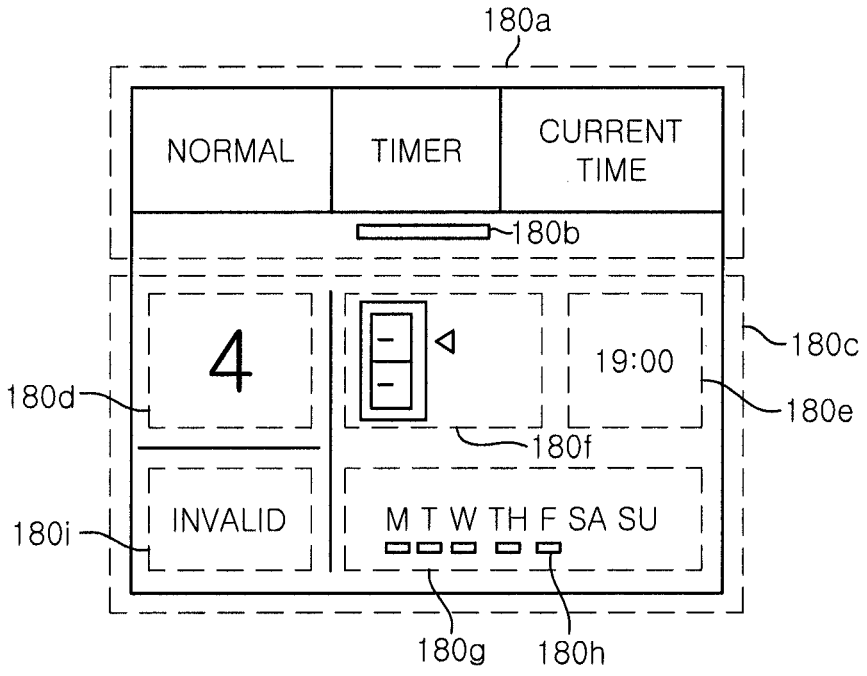
FIG. 18 is an explanatory view illustrating contents displayed on a display unit.

The contents to be displayed on the display unit 180 will be described with reference to FIG. 18. The screen of the display unit 180 is largely divided into a mode display area 180a and a setting content display area 180c.

The mode display area 180a is an area for displaying various kinds of modes and specifying the currently selected mode. In the mode display area 180a shown in FIG. 18, a "timer mode" is selected by a mode selection bar 180b. Description will now be made on the various kinds of modes including a "normal mode", a "timer mode" and a "current time mode". The "normal mode" is a mode indicating that the illumination control terminal 14b is in a normal operation, which excludes the timer mode and the current time mode. The "timer mode" is a mode for making it possible to change or review the individual operation parameters of one or more programs previously set and stored in the illumination control terminal 14b. The "current time mode" is a mode for setting the current time of an internal clock C30 (see FIG. 19) built in the illumination control terminal 14b.

The setting content display area 180c is an area for displaying the contents corresponding to a mode selected in the mode display area 180a. For example, if the "normal mode" is selected in the mode display area 180a, the contents of the setting program to be executed next on the basis of the current time may be displayed in the setting content display area 180c. In this case, in addition to the contents of the setting program to be executed next, the current time may be further displayed in a set time display region 180e. If the "timer mode" is selected in the mode display area 180a, the contents of the setting program selected for a changing or reviewing purpose by the operation of the below-mentioned individual buttons 260 to 300 may be displayed in the setting content display area 180c. If the "current time mode" is selected in the mode display area 180a, the current time may be displayed in a flickering manner in the set time display region 180e of the setting content display area 180c.

The setting content display area 180c will now be described in detail. The setting content display area 180c includes a program number display region 180d, a set time display region 180e, a target operation panel display region 180f, a set weekday display region 180g and a flag display region 180i. The program number display region 180d is a region for displaying the program number of the setting program (see FIGS. 20A and 20B) selected for a changing or reviewing purpose. In FIG. 18, the program number "4" is displayed in the program number display region 180d. The set time display region 180e is a region for displaying the set time of the setting program (see FIGS. 20A and 20B) selected for a changing or reviewing purpose. In FIG. 18, the set time "19:00" is displayed in the set time display region 180e. The target operation panel display region 180f is a region for distinguishably displaying the kind of the operation panel associated with the lamps to be turned off by the setting program (see FIGS. 20A and 20B) selected for a changing or reviewing purpose. In FIG. 18, the operation panel "SWa'" is displayed as the kind of the operation panel in the target operation panel display region 180f. The set weekday display region 180g is a region in which the execution days of the setting program (see FIGS. 20A and 20B) selected for a changing or reviewing purpose are distinguishably designated with a weekday selection bar 180h. Referring to FIG. 18, "Monday (M)", "Tuesday (T)", "Wednesday (W)", "Thursday (TH)" and "Friday (F)" are designated as the execution days in the set weekday display region 180g. "Saturday (SA)" and "Sunday (SU)" are not designated with the weekday selection bar 180h because they are not the execution days of the setting program. Lastly, the flag display region 180i is a region for displaying the content of a flag indicating whether to execute the setting program (see FIGS. 20A and 20B) selected for a changing or reviewing purpose. In FIG. 18, "invalid" indicating non-execution of the setting program is displayed in the flag display region 180i. In case of executing the setting program, "valid" rather than "invalid" is displayed in the flag display region 180i.

Referring back to FIG. 17, if the operation panel SWa' of the first operation unit is pushed or if a control signal for turning off the lamps 1 to 4 corresponding to the operation panel SWa' is outputted from the illumination control terminal 14b at the set time, the LED lamp 230 emits light to distinguishably notify the on/off state of the lamps 1 to 4. For instance, the LED lamp 230 emits red light to notify the on-state of the lamps 1 to 4 of group G1 or emits green light to notify the off-state of the lamps 1 to 4.

As shown in FIG. 17, an increment button 260, a decrement button 270, a mode selection button 280, a return button 290 and a setting button 300 are arranged on the front surface of the frame K10 of the second operation unit. These buttons will be described in detail. The mode selection button 280 is a button for, when pushed, changing the mode designated by the mode selection bar 180*b* to select one of the normal mode, the timer mode and the current time mode. The return button 290 is a button for, when the timer mode is selected for instance by the mode selection button 280, returning the set item of the individual operation parameters of the setting program selected in the timer mode. For example, when the weekdays are set after setting the program number and the set time, the return button 290 may be pushed in order to alter the set time. The increment button 260 and the decrement button 270 are buttons for, when the current time mode or the timer mode is selected by the mode selection button 280, increasing or decreasing the individual operation parameters in one of the current time mode and the timer mode, and also for, when the current time mode is selected, increasing or decreasing the digits of the current time that can be changed in the current time mode. The setting button 300 is a button for setting the individual operation parameters selected as above.

Referring again to FIG. 17, an LED lamp 240 and a communications unit 250 as well as the various kinds of buttons 260 to 300 are arranged on the front surface of the frame K10 of the second operation unit.

If the operation panel SWb' of the second operation unit is pushed or if a control signal for turning off the lamps 2 and 4 corresponding to the operation panel SWb' is outputted from the illumination control terminal 14*b* at the set time, the LED lamp 240 emits light to distinguishably notify the on/off state of the lamps 2 and 4. For instance, the LED lamp 240 emits red light to notify the on-state of the lamps 2 and 4 of group G3 or emits green light to notify the off-state of the lamps 2 and 4 of group G3.

The communications unit 250 receives a setting program inputted from a setting communications device 50 (see FIG. 19), i.e., an external terminal, through infrared communications or other communications.

Next, the configuration of the illumination control terminal 14*b* will be described in detail with reference to FIG. 19, which is a block diagram showing the internal configuration of the illumination control terminal 14*b* in accordance with the second embodiment. The illumination control terminal 14*b* includes a terminal control unit 150, an internal clock C30, a memory 160, a display unit 180, a switch group 190, an input detection unit 200, an LED lamp 230, an LED lamp 240 and a communications unit 250. The illumination control terminal 14*b* is operated by using a driving power source the electric power supplied from the transmission unit 9 of the operation control unit 13.

The terminal control unit 150 is formed of an MPU (Micro Processing Unit) and controls the operation of the respective components of the illumination control terminal 14*b*. The internal clock C30 indicates the current time by counting the clock pulses generated from a clock circuit (not shown). The memory 160 stores the information indicating which switch of the switch group 190 was selected and pushed. Responsive to the push signal (to be described later) outputted by the input detection unit 200, the terminal control unit 150 generates a control signal for controlling the on/off operation of the lamps and outputs the control signal to the operation control unit 13.

The memory 160 is formed of a non-volatile memory such as an EEPROM or the like and stores the operation parameters of the setting programs shown in FIGS. 20A and 20B, which are associated with the turning-off control of the lamps 1 to 8. The operation parameters of the setting programs will now be described with reference to FIGS. 20A and 20B. As mentioned earlier, the setting programs employed in the second embodiment are largely divided into "turning-off programs" and "repeated turning-off programs". FIG. 20A shows turning-off programs PRa while FIG. 20B illustrates repeated turning-off programs PRb. Further, the turning-off programs PRa of the groups G1 and G3 are only shown in FIG. 20A, and the repeated turning-off program PRb of the groups G1 and G2 are only shown in FIG. 20B.

Each of the turning-off programs PRa shown in FIG. 20A contains a program number, a control target, a forenotice turning-off time, a forenotice turning-off duration (min), a turning-off time, a control day, an operation panel and a flag, which will now be described briefly.

The "program number" denotes the ID (or identification number) of each of the turning-off programs PRa. The "control target" denotes the group of control target lamps to be normally turned off or turned off for a forenotice purpose in accordance with each of the turning-off programs PRa identified by the program number. The "forenotice turning-off time" denotes the time at which some of the control target lamps to be turned off in accordance with each of the turning-off programs PRa are turned off for a forenotice purpose earlier than the turning-off time thereof. The "forenotice turning-off duration" denotes the forenotice turning-off execution time period counted from the forenotice turning-off time of the control target lamps to be turned off in accordance with each of the turning-off programs PRa. The "turning-off time" denotes the time at which all the control target lamps to be turned off in accordance with each of the turning-off programs PRa are collectively turned off. The "control day" denotes the days on which each of the turning-off programs PRa is executed. The "operation panel" denotes the kind of the operation panel by which the control target lamps to be turned off in accordance with each of the turning-off programs PRa can be manually turned on or off. Lastly, the "flag" indicates whether to execute each of the turning-off programs PRa. For example, if the flag is "valid", the turning-off program PRa having such a flag is executed. If the flag is "invalid", the turning-off program PRa having such a flag is not executed.

Description will now be made on the turning-off programs PRa shown in FIG. 20A. Referring to FIG. 20A, the turning-off program PRa of program number 1 indicates that the lamps 2 and 4 of group G3 are turned off for a forenotice purpose between 11:55 and 12:00 from Monday to Friday and further that the lamps 2 and 4 of group G3 can be manually turned on or off with the operation panel SWb'. The turning-off program PRa of program number 2 indicates that the lamps 1 to 4 of group G1 are normally turned off at 12:00 from Monday to Friday and further that the lamps 1 to of group G1 can be manually turned on or off with the operation panel SWa'. The turning-off program PRa of program number 3 indicates that the lamps 2 and 4 of group G3 are turned off for a forenotice purpose between 17:55 and 18:00 from Monday to Friday and further that the lamps 2 and 4 of group G3 can be manually turned on or off with the operation panel SWb'. The turning-off program PRa of program number 4 indicates that the lamps 1 to 4 of group G1 are normally turned off at 18:00 from Monday to Friday and further that the lamps 1 to 4 of group G1 can be manually turned on or off with the operation panel SWa'. The turning-off program PRa of program number 5 indicates that the lamps 2 and 4 of group G3 are turned off for a forenotice purpose between 18:55 and 19:00 from Monday to Friday and further that the lamps 2 and 4 of group G3 can be manually turned on or off with the operation panel SWb'. The turning-off program PRa of program number 6 indicates that the lamps 1 to 4 of group G1 are normally turned off at 19:00 from Monday to Friday and further that the lamps 1 to of group G1 can be manually turned on or off with the operation panel SWa'. The turning-off program PRa of program number 7 indicates that the lamps 2 and 4 of group G3 are turned off for a forenotice purpose between 19:55 and 20:00 from Monday to Friday and further that the lamps 2 and of group G3 can be manually turned on or off with the operation panel SWb'. The turning-off program PRa of program number 8 indicates that the lamps 1 to 4 of group G1 are normally turned off at 20:00 from Monday to Friday and further that the lamps 1 to 4 of group G1 can be manually turned on or off with the operation panel SWa'.

Each of the repeated turning-off programs PRb shown in FIG. 20B contains a program number, a control target, a repeated turning-off start time, a repeated turning-off end time, a turning-off time interval (min), a control day and a flag, which will now be described briefly.

The "program number" denotes the ID (or identification number) of each of the repeated turning-off programs PRb. The "control target" denotes the group of control target lamps to be normally turned off in accordance with each of the repeated turning-off programs PRb identified by the program number. The "repeated turning-off start time" denotes the start time of the time period during which the control target lamps to be normally turned off in accordance with each of the repeated turning-off programs PRb are repeatedly turned off in a specified turning-off time interval. The "repeated turning-off end time" denotes the end time of the time period during which the control target lamps to be normally turned off in accordance with each of the repeated turning-off programs PRb are repeatedly turned off in a specified turning-off time interval. The "turning-off time interval" denotes the time interval in which the control target lamps to be normally turned off in accordance with each of the repeated turning-off programs PRb are repeatedly and normally turned off. During the time period between the repeated turning-off start time and the repeated turning-off end time, the control target lamps are repeatedly and normally turned off at every time point determined by the turning-off time interval. The "control day" denotes the days on which each of the repeated turning-off programs PRb is executed. Lastly, the "flag" indicates whether to execute each of the repeated turning-off programs PRb. For example, if the flag is "valid", the repeated turning-off program PRb having such a flag is executed. If the flag is "invalid", the repeated turning-off program PRb having such a flag is not executed.

Description will now be made on the repeated turning-off programs PRb shown in FIG. 20B. Referring to FIG. 20B, the repeated turning-off program PRb of program number 1 indicates that the lamps 5 to 8 of group G2 are repeatedly and normally turned off every 60 minutes between 17:55 and 05:00 on Saturday and Sunday. However, the repeated turning-off program PRb of program number 1 is not executed because the flag thereof is invalid. The repeated turning-off program PRb of program number 2 indicates that the lamps 1 to 4 of group G1 are repeatedly and normally turned off every 60 minutes between 18:00 and 23:00 from Monday to Friday. The repeated turning-off program PRb of program number 3 indicates that the lamps 5 to 8 of group G2 are repeatedly and normally turned off every 30 minutes between 19:00 and 22:00 from Monday to Friday.

Referring back to FIG. 19, the display unit 180 is formed of, e.g., an LCD (Liquid Crystal Display), and is arranged on the front surface of the frame K10 of the first operation unit as can be seen in FIG. 17. The display unit 180 is configured to display the contents corresponding to the mode selected by pushing the mode selection button 280 as set forth above. If the normal mode is selected, the display unit 180 displays the contents of the setting program to be executed next on the basis of the current time, and the current time indicated by the internal clock C30 of the terminal control unit 150. If the current time mode is selected, the display unit 180 displays the current time in a flickering manner so that a user can set the current time. If the timer mode is selected, the display unit 180 displays the setting program (i.e., the turning-off program PRa or the repeated turning-off program PRb) selected by pushing the various kinds of buttons 260 to 300.

The switch group 190 includes a switch SWa1 corresponding to the operation panel SWa', a switch SWb1 corresponding to the operation panel SWb', a switch SWak, a switch SWbk, a switch SW26 corresponding to the increment button 260, a switch SW27 corresponding to the decrement button 270, a switch SW28 corresponding to the mode selection button 280, a switch SW29 corresponding to the return button 290 and a switch SW30 corresponding to the setting button 300. Each of the switches of the switch group 190 outputs a signal indicative of the pushing operation thereof to the input detection unit 200 each time when the operation panel or the button corresponding to the switch is selected and pushed (hereinafter, such signal referred to as 'push signal'). The switch SWak is provided, e.g., in the frame K10 in an adjoining relationship with the locked portion HKC10 arranged on the front surface of the frame K10 of the first operation unit. Only when the closed state of the handle cover HC10 is assured by the engagement of the locking portion KC10 and the locked portion HKC10, the switch SWak outputs a push signal indicative of the closed state of the handle cover HC10 to the input detection unit 200. Therefore, if the handle cover HC10 is in an open state, the switch SWak does not output any push signal to the input detection unit 200. Similarly, the switch SWbk is provided, e.g., in the frame K10 in an adjoining relationship with the locked portion HKC20 arranged on the front surface of the frame K10 of the second operation unit. Only when the closed state of the handle cover HC20 is assured by the engagement of the locking portion KC20 and the locked portion HKC20, the switch SWbk outputs a push signal indicative of the closed state of the handle cover HC20 to the input detection unit 200. Therefore, if the handle cover HC20 is in an open state, the switch SWbk does not output any push signal to the input detection unit 200.

The input detection unit 200 monitors the operation of the respective switches of the switch group 190, receives the push signal outputted from one of the switches of the switch group 190 and outputs the push signal to the terminal control unit 150. The push signal outputted from the input detection unit 200 to the terminal control unit 150 contains at least the kind of the pushed switch of the switch group 190. Responsive to the push signal outputted from the switch SWak or SWbk, the input detection unit 200 detects the open state or the closed state of the handle cover HC10 or HC20.

If the terminal control unit 150 determines that the lamps 1 to 4 of group G1 are turned on, the LED lamp 230 emits red light under the control of the terminal control unit 150. If the terminal control unit 150 determines that the lamps 1 to 4 of group G1 are turned off, the LED lamp 230 emits green light under the control of the terminal control unit 150. If a push signal outputted upon pushing the switch SWa1 is acquired through the input detection unit 200 while the switch SWa1 corresponding to the operation panel SWa' is not pushed and while the lamps 1 to 4 of group G1 are kept turned off, the terminal control unit 150 determines that the lamps 1 to 4 of group G1 are being turned on. Similarly, if a push signal outputted upon pushing the switch SWa1 is acquired through the input detection unit 200 while the switch SWa1 is pushed to turn on the lamps 1 to 4 of group G1, the terminal control unit 150 determines that the lamps 1 to 4 of group G1 are being turned off.

If the terminal control unit 150 determines that the lamps 2 and 4 of group G3 are turned on, the LED lamp 240 emits red light under the control of the terminal control unit 150. If the terminal control unit 150 determines that the lamps 2 and 4 of group G3 are turned off, the LED lamp 240 emits green light under the control of the terminal control unit 150. If a push signal outputted upon pushing the switch SWb1 is acquired through the input detection unit 200 while the switch SWb1 corresponding to the operation panel SWb' is not pushed and while the lamps 2 and 4 of group G3 are kept turned off, the terminal control unit 150 determines that the lamps 2 and 4 of group G3 are being turned on. Similarly, if a push signal outputted upon pushing the switch SWb1 is acquired through the input detection unit 200 while the switch SWb1 is pushed to turn on the lamps 2 and 4 of group G3, the terminal control unit 150 determines that the lamps 2 and 4 of group G3 are being turned off.

The communications unit 250 is arranged on the front surface of the frame K10 of the second operation unit to receive a control signal on the new registration of the setting programs shown in FIGS. 20A and 20B, which is transmitted from a setting communications device 50, i.e., an external terminal, through infrared communications or other communications. The control signal on the new registration of the setting programs contains the sign of new registration of the setting programs and the individual operation parameters of the setting programs inputted from the setting communications device 50. The operation parameters include at least the group of the control target lamps, the set time at which the normal turning-off and the forenotice turning-off are to be executed, and the control day. If a control signal on the new registration of the setting programs is received from the setting communications device 50, the communications unit 250 notifies the terminal control unit 150 of the fact that it has received the control signal. In case where the terminal control unit 150 is notified of the fact that the communications unit 250 has received the control signal on the new registration of the setting programs from the setting communications device 50, the terminal control unit 150 acquires the setting programs and causes the memory 160 to store the setting programs.

(Operation of Illumination Control Terminal 14*b*: Change or Renewal of Turning-Off Program PRa)

Figure 22:
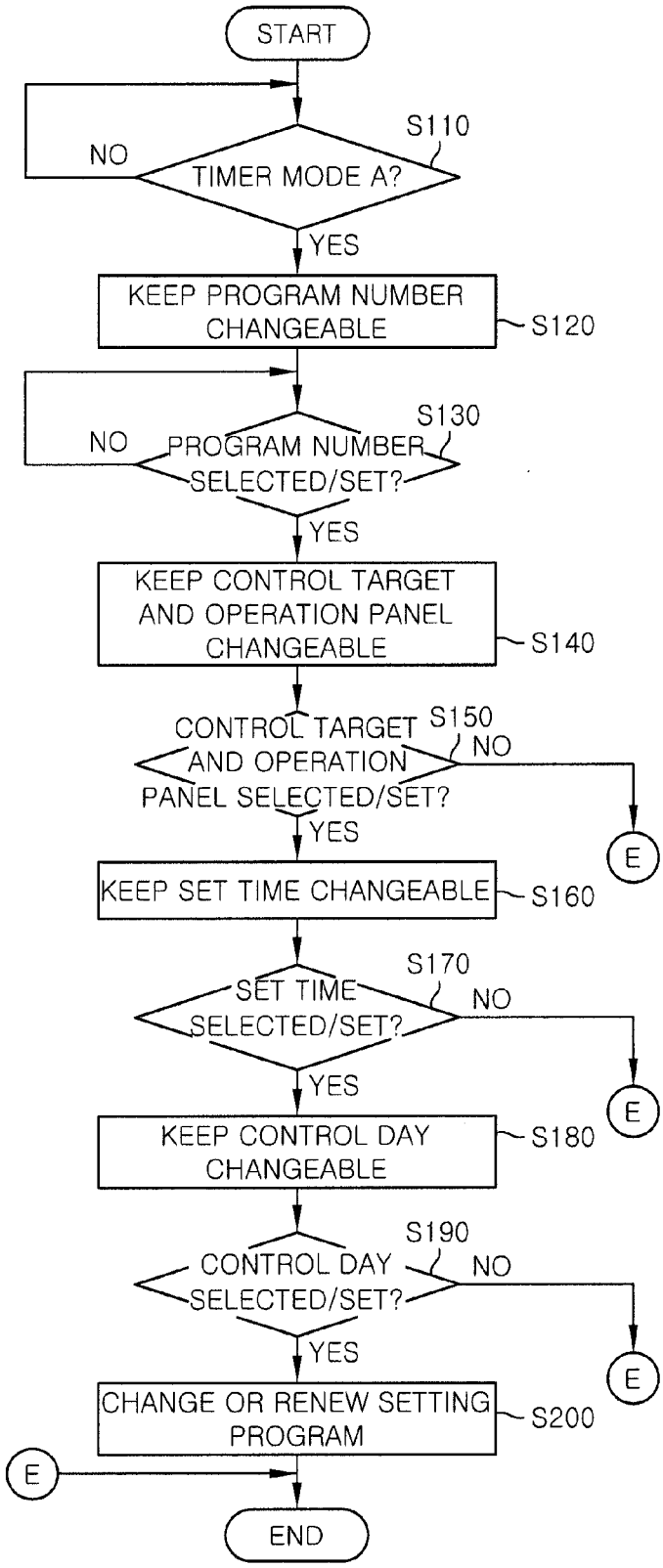
FIG. 22 is a flowchart illustrating a process of changing one kind of setting programs (the turning-off programs) in the illumination control terminal of the second embodiment.
Figure 23A:
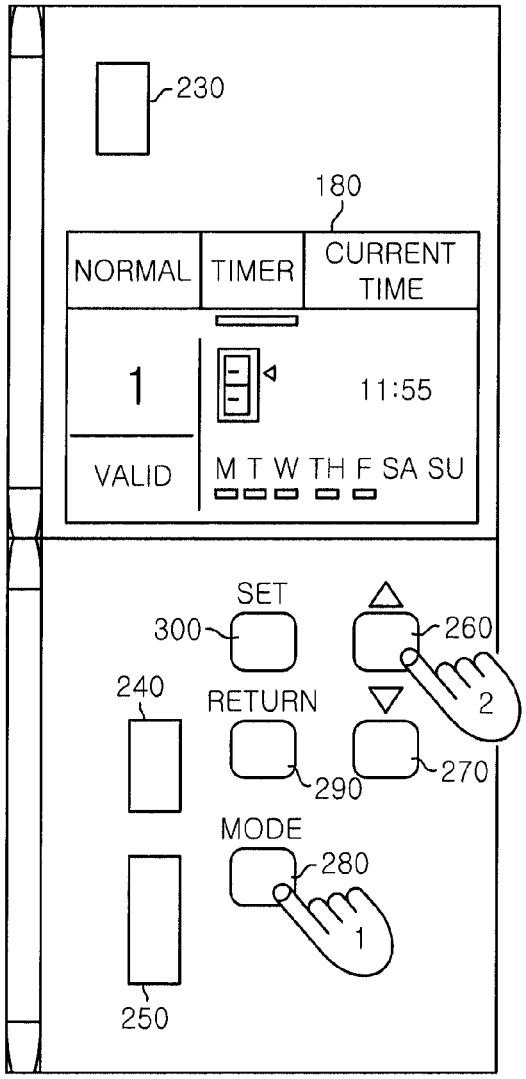
FIGS. 23A and 23B illustrate examples of screen images available when changing the turning-off programs used as the setting programs, FIG. 23A being a screen image showing how to select a timer mode A with a mode selection button and how to select a desired turning-off program, and FIG. 23B being a screen image showing how to set the desired turning-off program.
Figure 23B:
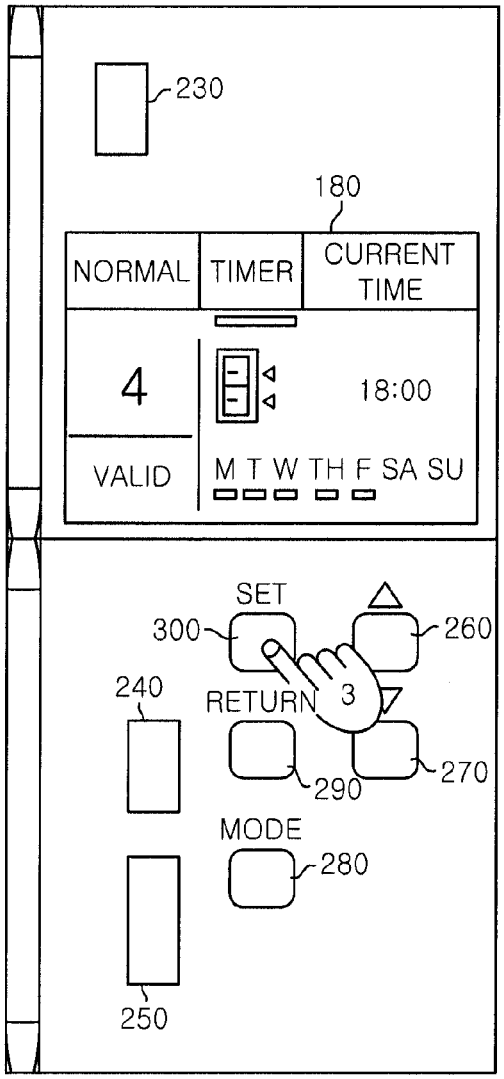
Figure 24A:
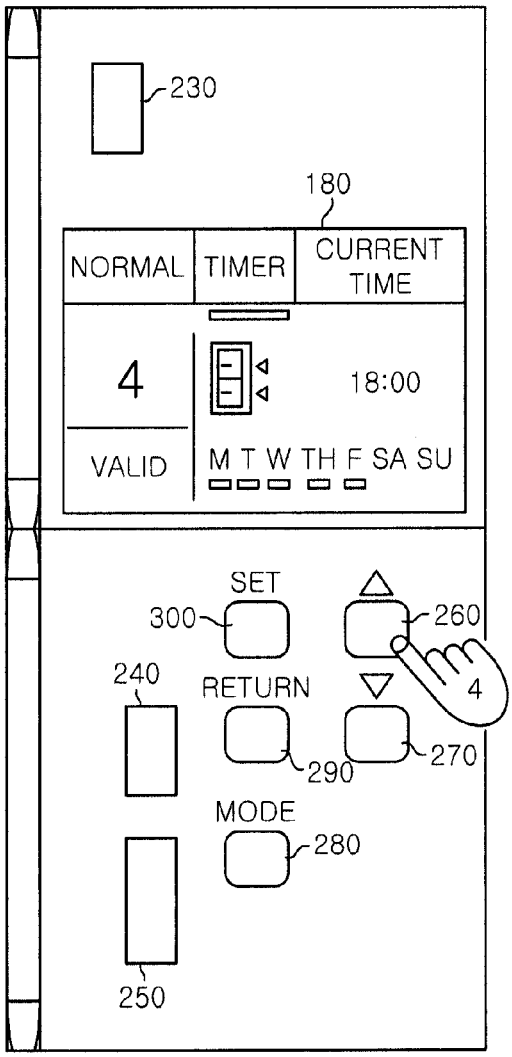
FIGS. 24A and 24B illustrate examples of screen images available when changing the turning-off programs used as the setting programs, FIG. 24A being a screen image showing how to select a desired control target and a desired operation panel, and FIG. 24B being a screen image showing how to set the desired control target and the desired operation panel.
Figure 24B:
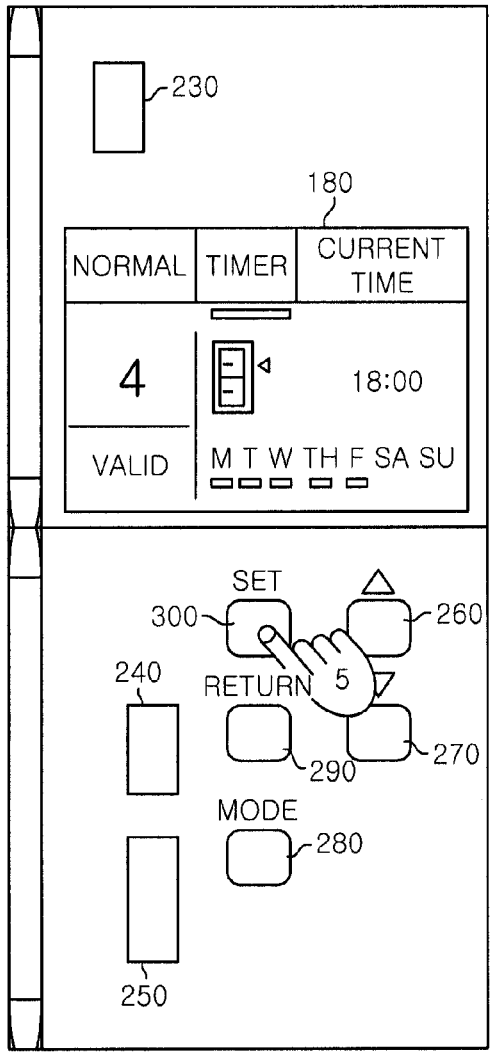
Figure 25A:
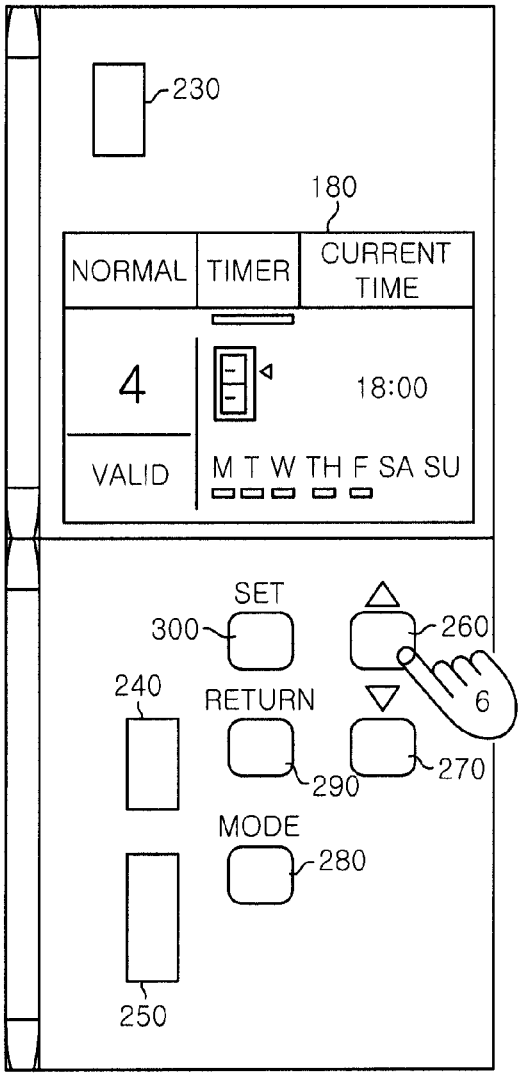
FIGS. 25A and 25B illustrate examples of screen images available when changing the turning-off programs used as the setting programs, FIG. 25A being a screen image showing how to select a desired turning-off time, and FIG. 25B being a screen image showing how to set the desired turning-off time.
Figure 25B:
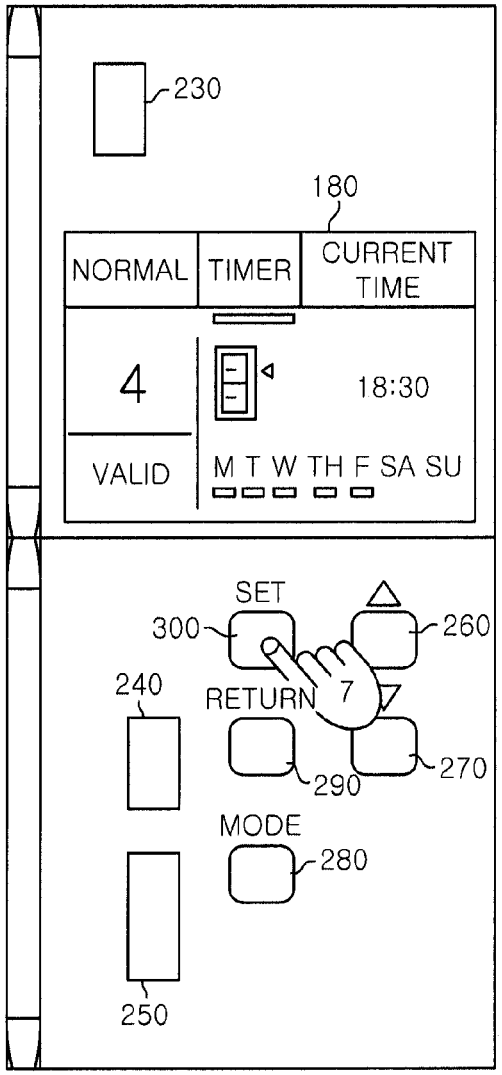
Figure 26A:
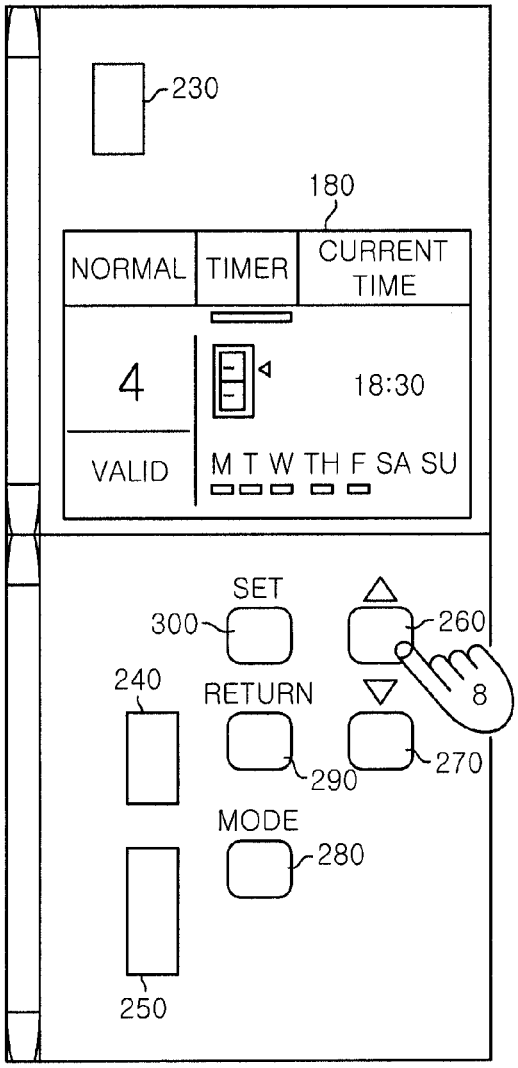
FIGS. 26A and 26B illustrate examples of screen images available when changing the turning-off programs used as the setting programs, FIG. 26A being a screen image showing how to select a desired turning-off day, and FIG. 26B being a screen image showing how to set the desired turning-off day.
Figure 26B:
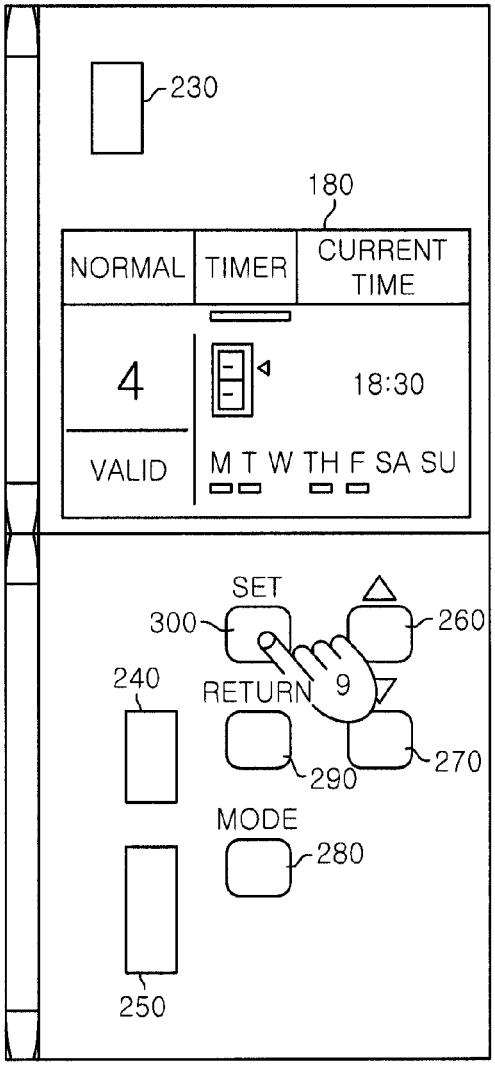

Next, a process of changing the setting programs (the turning-off programs PRa) in the timer mode will be described with reference to FIG. 21 to FIG. 26B. FIG. 21 is an explanatory view showing a management example of the turning-off programs PRa and the repeated turning-off programs PRb in offices or other places. FIG. 22 is a flowchart illustrating a process of changing the setting programs (the turning-off programs PRa) in the timer mode A (to be described later) of the illumination control terminal 14*b* in accordance with the second embodiment. FIGS. 23A to 26B illustrate examples of screen images available when changing the turning-off programs PRa. More specifically, FIG. 23A is a screen image showing how to select the timer mode A with the mode selection button 230 and how to select a desired turning-off program PRa. FIG. 23B is a screen image showing how to set the desired turning-off program PRa. FIG. 24A is a screen image showing how to select a desired control target and a desired operation panel. FIG. 24B is a screen image showing how to set the desired control target and the desired operation panel. FIG. 25A is a screen image showing how to select a desired turning-off time. FIG. 25B is a screen image showing how to set the desired turning-off time. FIG. 26A is a screen image showing how to select a desired turning-off day. FIG. 26B is a screen image showing how to set the desired turning-off day.

Referring to FIG. 21, it is assumed that the lamps are manually turned on by pushing individual switches (not shown) by a user. Since the repeated turning-off program PRb of program number 2 shown in FIG. 21B is valid, the lamps 1 to 4 of group G1 are repeatedly turned off every 60 minutes between 18:00 and 23:00 as illustrated in FIG. 21. In the following description on the flowchart shown in FIG. 22, it is assumed that the input detection unit 200 of the illumination control terminal 14*b* has already detected the open states of the handle covers HC10 and HC20.

Referring to FIG. 22, the terminal control unit 150 determines whether the timer mode A is selected by the push signal outputted from the switch SW28 in response to the pushing operation of the mode selection button 280 (step S110). The timer mode A is a mode for enabling the turning-off program PRa to be changed in accordance with the flowchart shown in FIG. 22. In the illumination control terminal 14*b* of the second embodiment, the transition to the timer mode A is caused by pushing the mode selection button 280.

If it is determined that the transition to the timer mode A has been made by pushing the switch SW28 corresponding to the mode selection button 280 (YES in step S110), the terminal control unit 150 causes the display unit 180 to display, e.g., the operation parameters of the turning-off program PRa of program number 1, in the setting content display area 180*c*. The pushing operation of the mode selection button 280 corresponds to the finger operation 1 illustrated in FIG. 23A. Moreover, the terminal control unit 150 keeps changeable the program number, one of the operation parameters displayed in the setting content display area 180*c* (step S120).

The contents of the operation parameters displayed in the setting content display area 180*c* upon transition to the timer mode A may be the contents of the turning-off program PRa whose operation parameters have been changed previously. In this case, the program number of the previously-changed turning-off program PRa is stored in the memory 160. Thereafter, upon transition to the timer mode A, the operation parameters of the turning-off program PRa corresponding to the program number stored in the memory 160 are displayed in the setting content display area 180*c* of the display unit 180.

The terminal control unit 150 determines whether a program number has been selected by the push signal outputted from the switch SW26 or SW27 in response to the pushing operation of the increment button 260 or the decrement button 270 and whether the selected program number has been set by the push signal outputted from the switch SW30 in response to the pushing operation of the setting button 300 (step S130). If it is determined that the program number has been selected and set (YES in step S130), the terminal control unit 150 causes the display unit 180 to display the operation parameters of the turning-off program PRa of the set program number in the setting content display area 180*c*. Turning to the pushing operation of the increment button 260 or the decrement button 270, the pushing operation of, e.g., the increment button 260, corresponds to the finger operation 2 shown in FIG. 23A. The pushing operation of the setting button 300 corresponds to the finger operation 3 shown in FIG. 23B. In addition, the terminal control unit 150 keeps changeable the control target and the operation panel, some of the operation parameters displayed in the setting content display area 180*c*

(step S140). The relationships between the control target groups and the operation panels are previously set by the transmission unit 9 of the operation control unit 13 as shown in FIG. 15D.

The terminal control unit 150 determines whether a control target and an operation panel have been selected by the push signal outputted from the switch SW26 or SW27 in response to the pushing operation of the increment button 260 or the decrement button 270 and whether the selected control target and the selected operation panel have been set by the push signal outputted from the switch SW30 in response to the pushing operation of the setting button 300 (step S150). If it is determined that the control target and the operation panel have not been selected and set (NO in step S150), the turning-off program PRa is not changed in the timer mode A but merely seen by a user for a reviewing purpose or for other purposes. Thus, the flow illustrated in FIG. 22 comes to an end. No in step S150 is made, e.g., when at least one of the handle covers HC10 and HC20 is closed by a user.

In contrast, if it is determined that the control target and the operation panel have been selected and set (YES in step S150), the terminal control unit 150 causes the display unit 180 to display the set control target and the set operation panel in the setting content display area 180*c*. Turning to the pushing operation of the increment button 260 or the decrement button 270, the pushing operation of, e.g., the increment button 260, corresponds to the finger operation 4 shown in FIG. 24A. The pushing operation of the setting button 300 corresponds to the finger operation 5 shown in FIG. 24B. In addition, the terminal control unit 150 keeps changeable the set time (or the turning-off time), one of the operation parameters displayed in the setting content display area 180*c* (step S160).

The terminal control unit 150 determines whether a set time has been selected by the push signal outputted from the switch SW26 or SW27 in response to the pushing operation of the increment button 260 or the decrement button 270 and whether the selected set time has been set by the push signal outputted from the switch SW30 in response to the pushing operation of the setting button 300 (step S170). If it is determined that the set time has not been selected and set (NO in step S170), the turning-off program PRa is not changed in the timer mode A but merely seen by a user for a reviewing purpose or for other purposes. Thus, the flow illustrated in FIG. 22 comes to an end. No in step S170 is made, e.g., when at least one of the handle covers HC10 and HC20 is closed by a user.

In contrast, if it is determined that the set time has been selected and set (YES in step S170), the terminal control unit 150 causes the display unit 180 to display the set time in the setting content display area 180*c*. Turning to the pushing operation of the increment button 260 or the decrement button 270, the pushing operation of, e.g., the increment button 260, corresponds to the finger operation 6 shown in FIG. 25A. The pushing operation of the setting button 300 corresponds to the finger operation 7 shown in FIG. 25B. In addition, the terminal control unit 150 keeps changeable the control day (or the turning-off day), one of the operation parameters displayed in the setting content display area 180*c* (step S180).

The terminal control unit 150 determines whether a control day has been selected by the push signal outputted from the switch SW26 or SW27 in response to the pushing operation of the increment button 260 or the decrement button 270 and whether the selected control day has been set by the push signal outputted from the switch SW30 in response to the pushing operation of the setting button 300 (step S190). If it is determined that the control day has not been selected and set (NO in step S190), the turning-off program PRa is not changed in the timer mode A but merely seen by a user for a reviewing purpose or for other purposes. Thus, the flow illustrated in FIG. 22 comes to an end. No in step S190 is made, e.g., when at least one of the handle covers HC10 and HC20 is closed by a user.

In contrast, if it is determined that the control day has been selected and set (YES in step S190), the terminal control unit 150 causes the display unit 180 to display the set control day in the setting content display area 180*c*. Turning to the pushing operation of the increment button 260 or the decrement button 270, the pushing operation of, e.g., the increment button 260, corresponds to the finger operation 8 shown in FIG. 26A. The pushing operation of the setting button 300 corresponds to the finger operation 9 shown in FIG. 26B. After setting the control day, the terminal control unit 150 terminates the tasks of setting the operation parameters displayed in the setting content display area 180*c*. Then, the turning-off program PRa is renewed by changing the operation parameters of the turning-off program PRa selected in step S130 to the operation parameters set in steps S150, S170 and S190 (step S200). Thereafter, the flow illustrated in FIG. 22 comes to an end. In the flow illustrated in FIG. 22, description of the setting (valid/invalid) for the flag corresponding to each program number in the operation parameters of the turning-off program PRa is omitted.

(Operation of Illumination Control Terminal 14*b*: Change or Renewal of Repeated Turning-Off Program PRb)

Figure 27:
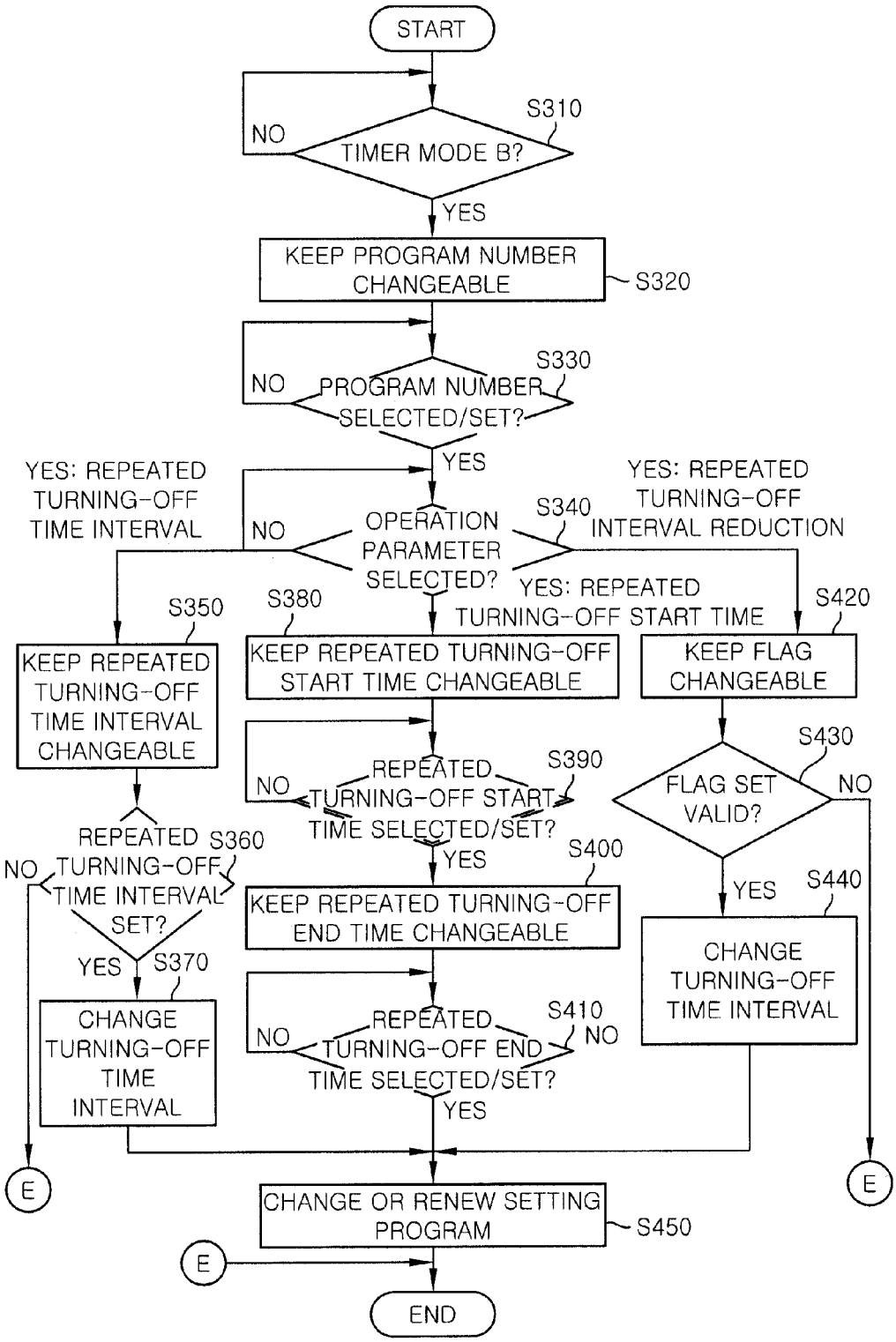
FIG. 27 is a flowchart illustrating a process of changing still another of setting programs (the repeated turning-off programs) in the illumination control terminal of the second embodiment.
Figure 28A:
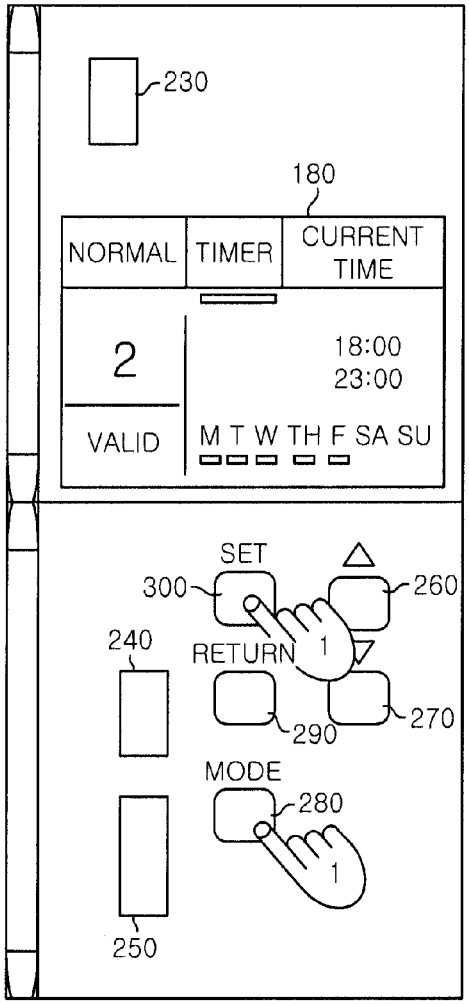
FIGS. 28A and 28B illustrate examples of screen images available when changing the repeated turning-off programs used as the setting programs, FIG. 28A being a screen image showing how to select a timer mode B and a desired repeated turning-off program with a mode selection button and a setting button, and FIG. 28B being a screen image showing how to select and set a desired turning-off time interval in the repeated turning-off program.
Figure 28B:
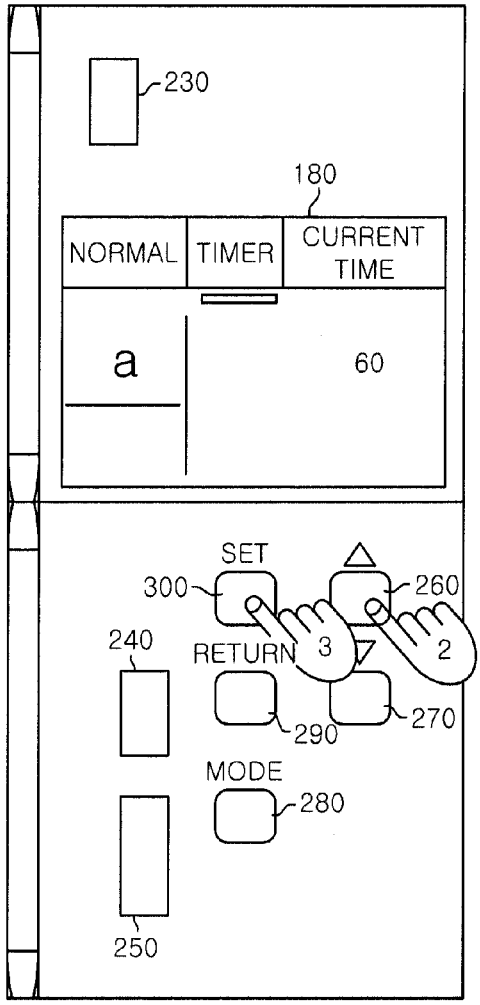
Figure 29A:
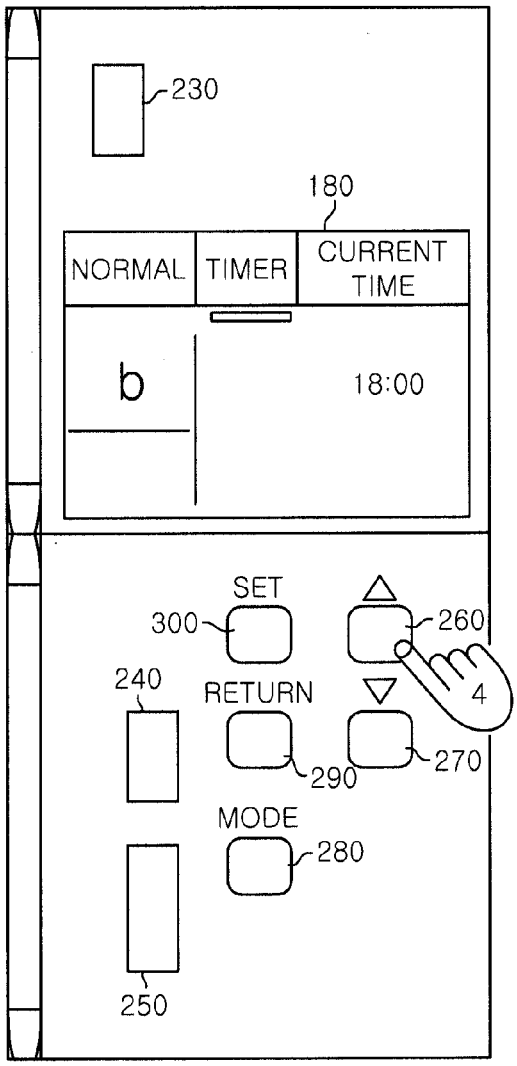
FIGS. 29A and 29B illustrate examples of screen images available when changing the repeated turning-off programs used as the setting programs, FIG. 29A being a screen image showing how to select a desired turning-off start time in the repeated turning-off program, and FIG. 29B being a screen image showing how to set the desired turning-off start time in the repeated turning-off program.
Figure 29B:
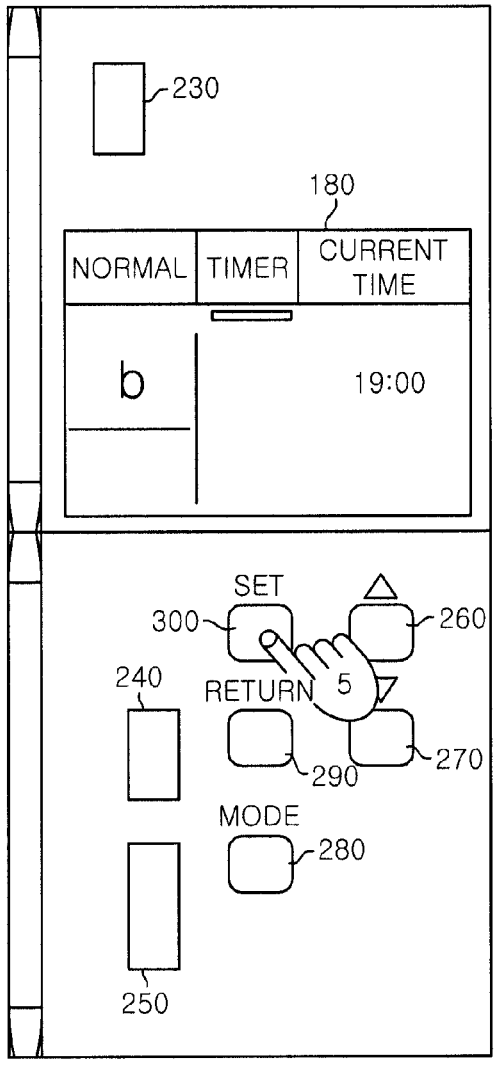
Figure 30A:
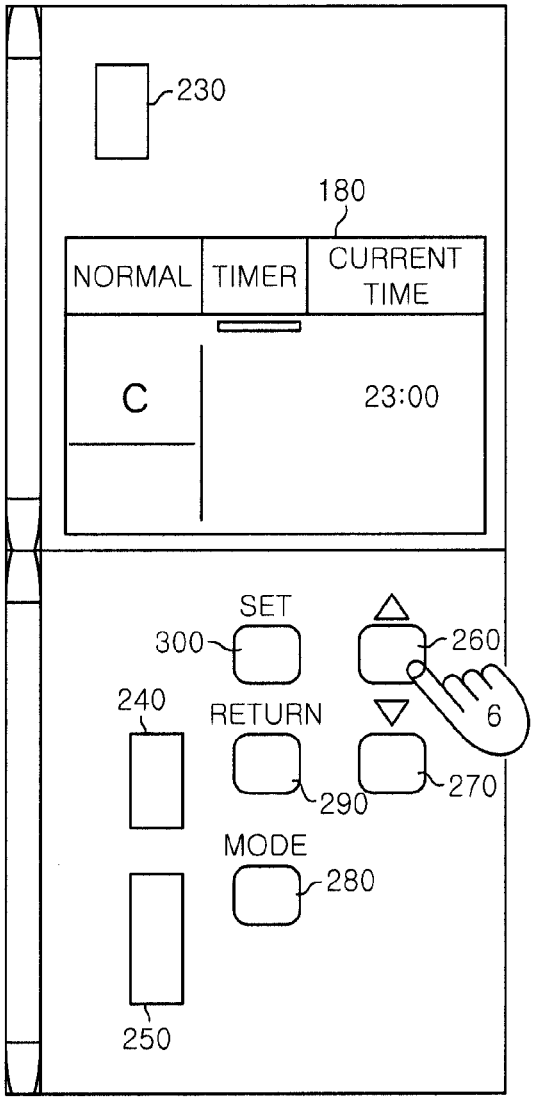
FIGS. 30A and 30B illustrate examples of screen images available when changing the repeated turning-off programs used as the setting programs, FIG. 30A being a screen image showing how to select a desired turning-off end time in the repeated turning-off program, and FIG. 30B being a screen image showing how to set the desired turning-off end time in the repeated turning-off program.
Figure 30B:
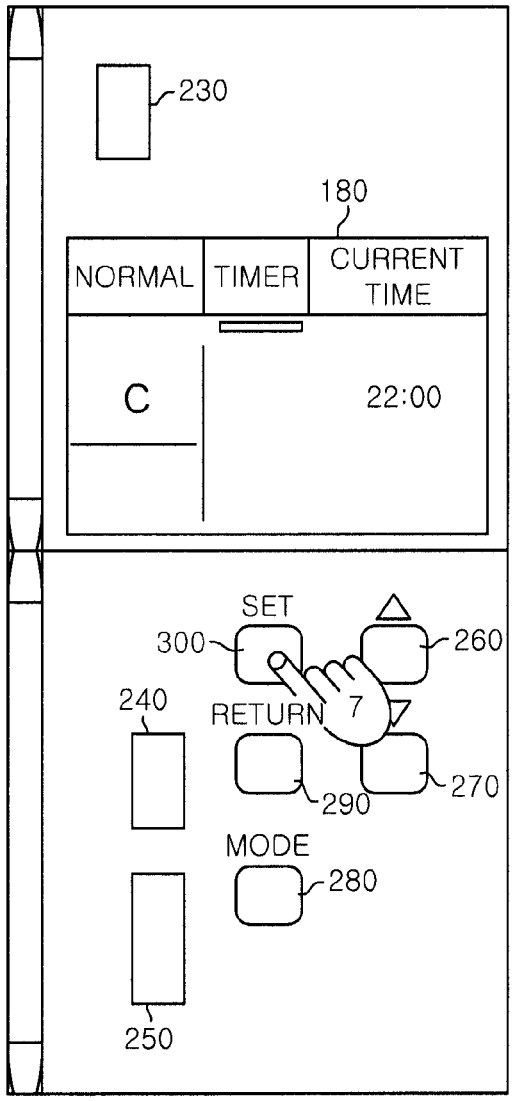
Figure 31:
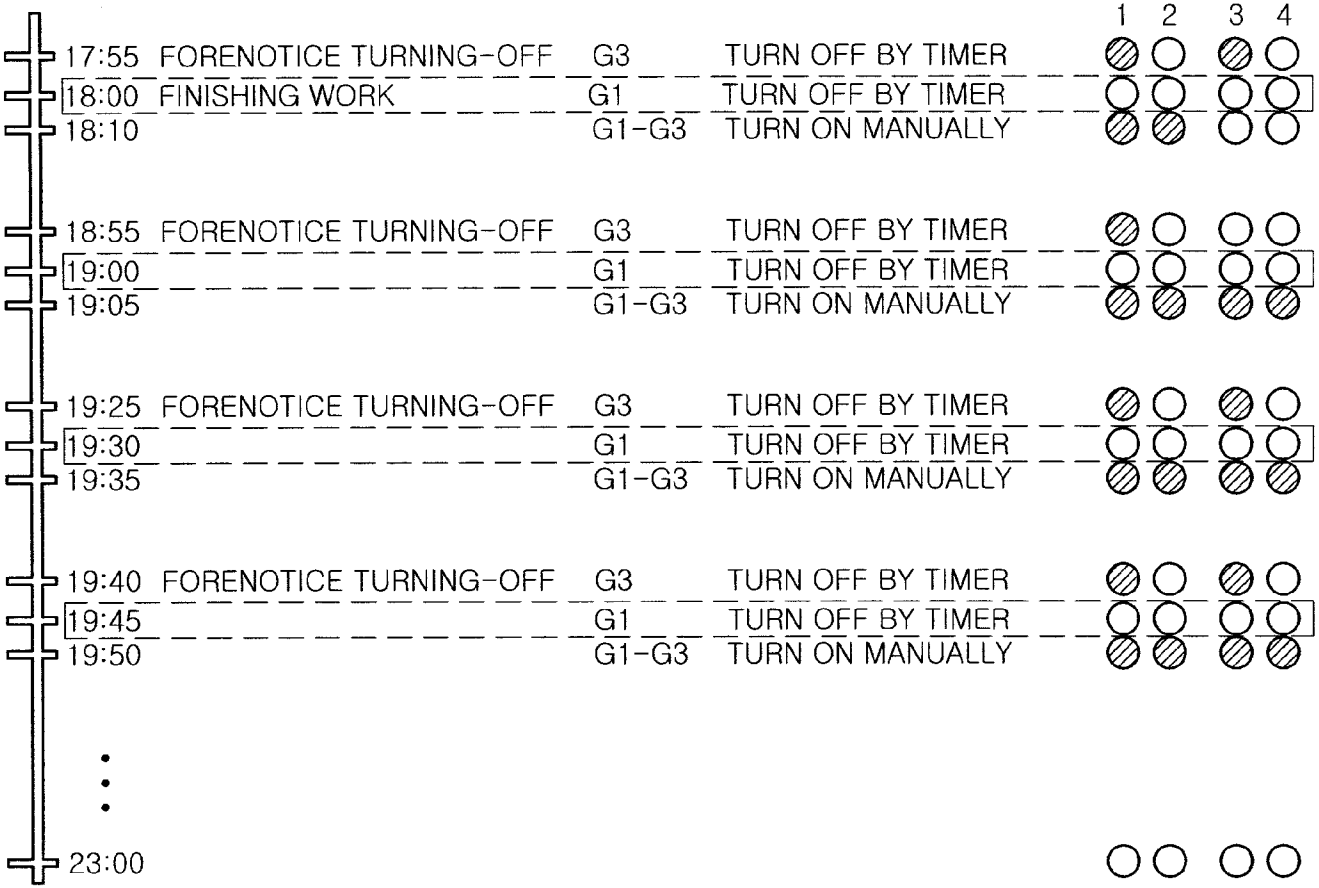
FIG. 31 is an explanatory view showing a management example of the turning-off programs and the repeated turning-off programs used as the setting programs.
Figure 32A:
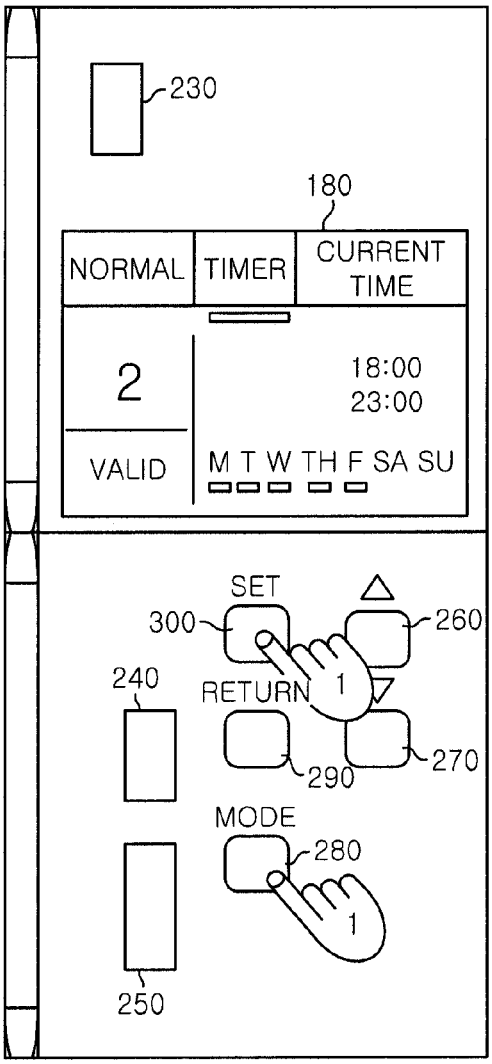
FIGS. 32A and 32B illustrate examples of screen images available when changing the repeated turning-off programs, FIG. 32A being a screen image showing a state in which a timer mode B is selected by pushing a mode selection button and a setting button together, and FIG. 32B being a screen image showing how to set the repeated turning-off time interval reduction in the repeated turning-off program.
Figure 32B:
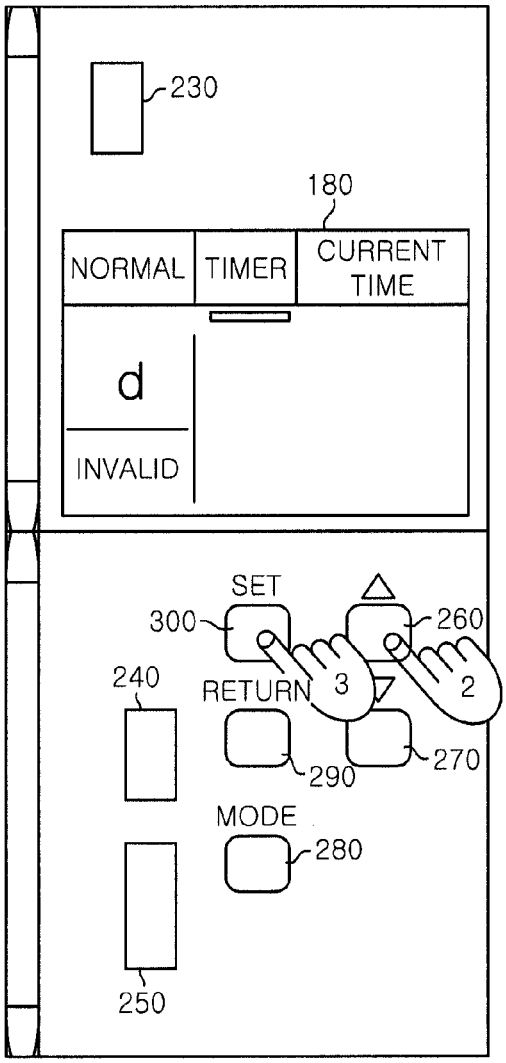
Figure 33A:
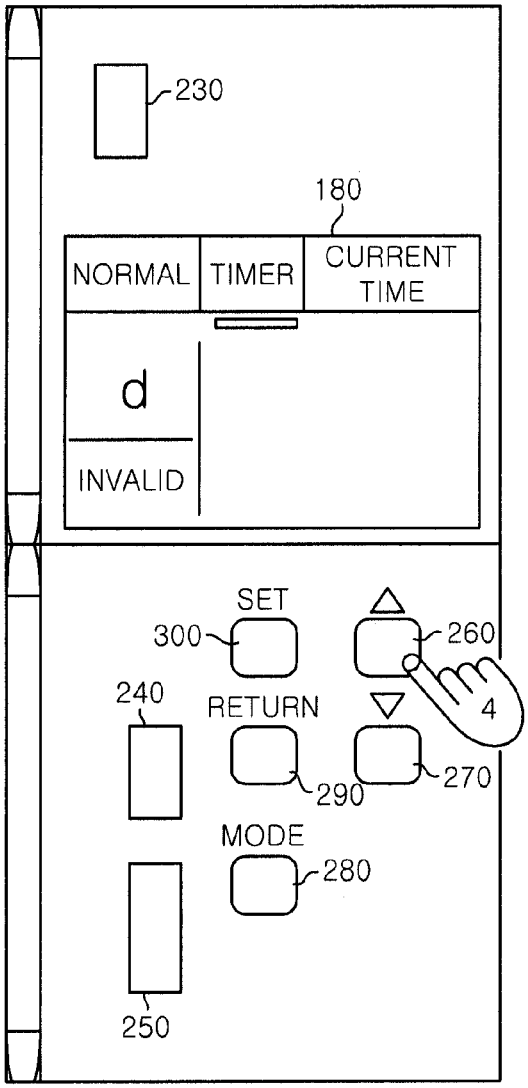
FIGS. 33A and 33B illustrate examples of screen images available when changing the repeated turning-off programs, FIG. 33A being a screen image showing how to select a flag on the repeated turning-off time interval reduction in the repeated turning-off program, and FIG. 33B being a screen image showing how to set valid the flag on the repeated turning-off time interval reduction in the repeated turning-off program.
Figure 33B:
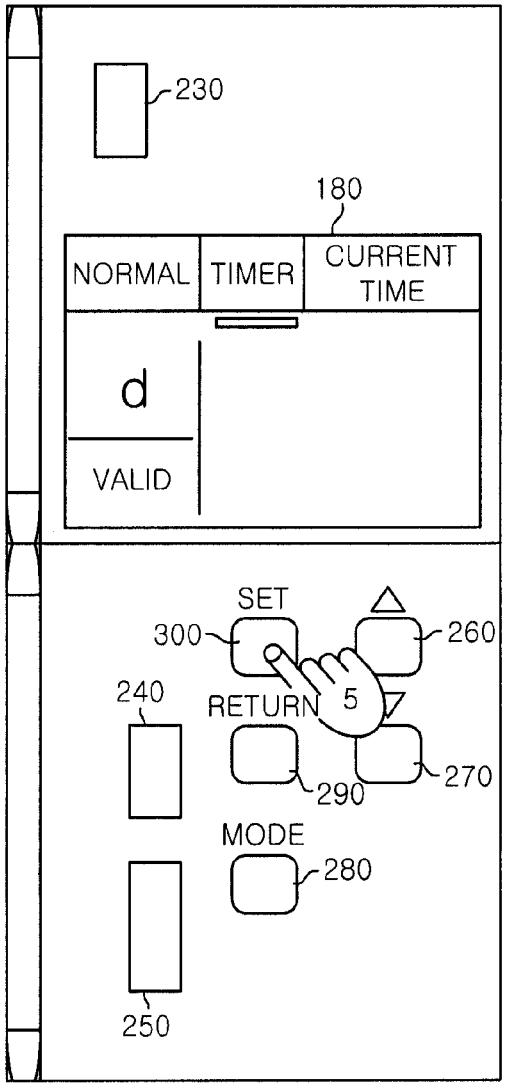

Next, a process of changing the setting programs (the turning-off programs PRb) in the timer mode will be described with reference to FIG. 27 to FIG. 33B. FIG. 27 is a flowchart illustrating a process of changing the setting programs (the repeated turning-off programs PRb) in the illumination control terminal 14*b* in accordance with the second embodiment. FIGS. 28A to 30B illustrate examples of screen images available when changing the repeated turning-off programs PRb. More specifically, FIG. 28A is a screen image showing how to make the repeated turning-off program PRb changeable with the mode selection button 280 and the setting button 300. FIG. 28B is a screen image showing how to select and set a desired turning-off time interval in the repeated turning-off program PRb. FIG. 29A is a screen image showing how to select a desired turning-off start time in the repeated turning-off program PRb. FIG. 29B is a screen image showing how to set the desired turning-off start time in the repeated turning-off program. FIG. 30A is a screen image showing how to select a desired turning-off end time in the repeated turning-off program PRb. FIG. 30B is a screen image showing how to set the desired turning-off end time in the repeated turning-off program PRb. FIG. 31 is an explanatory view showing another management example of the turning-off programs PRa and the repeated turning-off programs PRb. FIGS. 32A and 32B illustrate examples of screen images available when changing the repeated turning-off program PRb. FIG. 32A is a screen image showing a state in which the repeated turning-off program PRb is selected by pushing the mode selection button 280 and the setting button 300 together. FIG. 32B is a screen image showing how to set the repeated turning-off time interval reduction in the repeated turning-off program PRb. FIG. 33A is a screen image showing how to select a flag on the repeated turning-off time interval reduction in the repeated turning-off program PRb. FIG. 33B is a screen image showing how to set valid the flag on the repeated turning-off time interval reduction in the repeated turning-off program PRb. In the description made with reference to FIGS. 27 to 30B, the handle covers HC10 and HC20 are all kept in an open state. In the following description on the flowchart shown in FIG. 27, it is assumed that the input detection unit 200 of the illumination control terminal 14*b* has already detected the open states of the handle covers HC10 and HC20.

Referring to FIG. 27, the terminal control unit 150 determines whether the timer mode B is selected by the push signals outputted from the switch SW28 and switch SW30 in response to the simultaneous long pushing operation of the mode selection button 280 and the setting button 300 (step S310). The timer mode B is a mode for enabling the repeated turning-off program PRb to be changed in accordance with the flowchart shown in FIG. 27. In the illumination control terminal 14*b* of the second embodiment, the transition to the timer mode B is caused by the simultaneous long pushing operation of the mode selection button 280 and the setting button 300. If it is determined that the transition to the timer mode B has been made by the simultaneous long pushing operation of the switches SW28 and SW30 corresponding to the mode selection button 280 and the setting button 300 (YES in step S310), the terminal control unit 150 causes the display unit 180 to display, e.g., the operation parameters of the repeated turning-off program PRb of program number 2, in the setting content display area 180*c*. The simultaneous long pushing operation of the mode selection button 280 and the setting button 300 corresponds to the finger operation 1 illustrated in FIG. 28A or 32A.

Moreover, the terminal control unit 150 keeps changeable the program number, one of the operation parameters displayed in the setting content display area 180*c* (step S320). The contents of the operation parameters displayed in the setting content display area 180*c* upon transition to the timer mode B may be the contents of the repeated turning-off program PRb whose operation parameters have been changed previously. In this case, the program number of the previously-changed repeated turning-off program PRb is stored in the memory 160. Thereafter, upon transition to the timer mode B, the operation parameters of the repeated turning-off program PRb corresponding to the program number stored in the memory 160 are displayed in the setting content display area 180*c* of the display unit 180.

The terminal control unit 150 determines whether a program number has been selected by the push signal outputted from the switch SW26 or SW27 in response to the pushing operation of the increment button 260 or the decrement button 270 and whether the selected program number has been set by the push signal outputted from the switch SW30 in response to the pushing operation of the setting button 300 (step S330). If it is determined that the program number has been selected and set (YES in step S330), the terminal control unit 150 determines whether one of the repeated turning-off time interval, the repeated turning-off start time and the repeated turning-off time interval reduction among the operation parameters of the repeated turning-off program PRb identified by the set program number have been selected by the push signal outputted from the switch SW26 or SW27 in response to the pushing operation of the increment button 260 or the decrement button 270 and whether the selected operation parameter has been set by the push signal outputted from the switch SW30 in response to the pushing operation of the setting button 300 (step S340). Turning to the pushing operation of the increment button 260 and the decrement button 270, the pushing operation of, e.g., the increment button 260, corresponds to the finger operation 2 shown in FIG. 28B or 32B. The pushing operation of the setting button 300 corresponds to the finger operation 3 shown in FIG. 28B or 32B.

If it is determined in step S340 that the repeated turning-off time interval is to be set (YES: repeated turning-off time interval in S340), the terminal control unit 150 keeps changeable the repeated turning-off time interval (step S350). Then, the terminal control unit 150 determines whether a repeated turning-off time interval of, e.g., "45 min", has been selected in place of "60 min" by the push signal outputted from the switch SW26 or SW27 in response to the pushing operation of the increment button 260 or the decrement button 270 and whether the selected repeated turning-off time interval (e.g., "45 min") has been set by the push signal outputted from the switch SW30 in response to the pushing operation of the setting button 300 (step S360). If it is determined that the repeated turning-off time interval has not been selected and set (NO in step S360), the repeated turning-off program PRb is not changed in the timer mode B but merely seen by a user for a reviewing purpose or for other purposes. Thus, the flow illustrated in FIG. 27 comes to an end. No in step S360 is made, e.g., when at least one of the handle covers HC10 and HC20 is closed by a user.

If it is determined that the repeated turning-off time interval has been selected and set (YES in step S360), the terminal control unit 150 changes the repeated turning-off time interval (step S370) and, then, the terminal control unit 150 renews the setting programs (the repeated turning-off programs PRb) by reflecting the change made in step S370 (step S450). Thereafter, the flow illustrated in FIG. 27 comes to an end. In the flow illustrated in FIG. 27, description of the setting for the control targets, the control day and the flag corresponding to each program number in the operation parameters of the repeated turning-off program PRb is omitted.

If it is determined in step S340 that the repeated turning-off start time is to be set (YES: repeated turning-off start time in S340), the terminal control unit 150 keeps changeable the repeated turning-off start time (step S380). Then, the terminal control unit 150 determines whether a repeated turning-off start time of, e.g., "19:00", has been selected in place of "18:00" by the push signal outputted from the switch SW26 or SW27 in response to the pushing operation of the increment button 260 or the decrement button 270 and whether the selected repeated turning-off start time (e.g., 19:00) has been set by the push signal outputted from the switch SW30 in response to the pushing operation of the setting button 300 (step S390). If it is determined that the repeated turning-off start time has been selected and set (YES in step S390), the terminal control unit 150 causes the display unit 180 to display the set repeated turning-off start time in the setting content display area 180*c*. Turning to the pushing operation of the increment button 260 or the decrement button 270, the pushing operation of, e.g., the increment button 260, corresponds to the finger operation 4 shown in FIG. 29A. The pushing operation of the setting button 300 corresponds to the finger operation 5 shown in FIG. 29B. In addition, the terminal control unit 150 keeps changeable the repeated turning-off end time, one of the operation parameters displayed in the setting content display area 180*c* (step S400).

The terminal control unit 150 determines whether a repeated turning-off end time has been selected by the push signal outputted from the switch SW26 or SW27 in response to the pushing operation of the increment button 260 or the decrement button 270 and whether the selected repeated turning-off end start time has been set by the push signal outputted from the switch SW30 in response to the pushing operation of the setting button 300 (step S410). If it is determined that the repeated turning-off end time has been selected and set (YES in step S410), the terminal control unit 150 causes the display unit 180 to display the set repeated turning-off end time in the setting content display area 180*c*. Turning to the pushing operation of the increment button 260 or the decrement button 270, the pushing operation of, e.g., the increment button 260, corresponds to the finger operation 6 shown in FIG. 30A. The pushing operation of the setting button 300 corresponds to the finger operation 7 shown in FIG. 30B. In addition, the terminal control unit 150 renews the setting programs (the repeated turning-off programs PRb) by changing the operation parameters to the ones set in steps S390 and S410 (step S450). Thereafter, the flow shown in FIG. 27 comes to an end.

If it is determined in step S340 that the repeated turning-off time interval reduction is to be set (YES: repeated turning-off time interval reduction in S340), the terminal control unit 150 keeps changeable the flag on the repeated turning-off time interval reduction (step S420). Turning to the pushing operation of the increment button 260, the decrement button 270 and the setting button 300, the pushing operation of, e.g., the increment button 260, corresponds to the finger operation 2 shown in FIG. 32B. The pushing operation of the setting button 300 corresponds to the finger operation 3 shown in FIG. 32B. The terminal control unit 150 determines whether a flag on the repeated turning-off time interval reduction, e.g., "valid", has been selected in place of "invalid" by the push signal outputted from the switch SW26 or SW27 in response to the pushing operation of the increment button 260 or the decrement button 270 and whether the selected flag "valid" has been set by the push signal outputted from the switch SW30 in response to the pushing operation of the setting button 300 (step S430). If it is determined that the selected flag "valid" has not been set (NO in S430), the flag on the repeated turning-off time interval reduction is not changed in the timer mode B but merely seen by a user for a reviewing purpose or for other purposes. Thus, the flow illustrated in FIG. 27 comes to an end. The negative determination in step S430 is made, e.g., when at least one of the handle covers HC10 and HC20 is closed by a user. Turning to the pushing operation of the increment button 260 and the decrement button 270, the pushing operation of, e.g., the increment button 260, corresponds to the finger operation 4 shown in FIG. 33A. The pushing operation of the setting button 300 corresponds to the finger operation 5 shown in FIG. 33B.

If it is determined that the flag "valid" has been selected and set (YES in step S430), the terminal control unit 150 changes the repeated turning-off time interval (step S440). For example, if the flag on the repeated turning-off time interval reduction of the repeated turning-off program PRb of program number 2 shown in FIG. 20B has been changed from "invalid" to "valid", the repeated turning-off time interval is reduced in such a pattern of e.g., "60 min", "30 min", "15 min", "10 min", "5 min", and "5 min" is continuously repeated as shown in FIG. 31. However, the reduced repeated turning-off time interval is not limited thereto. Next, the terminal control unit 150 renews the setting programs (the repeated turning-off programs PRb) by reflecting the change made in step S440 (step S450). Thereafter, the flow illustrated in FIG. 27 comes to an end.

With the illumination control terminal 14' of the second embodiment, it is possible to thoroughly turn off lamps in an office, a factory, a store or other place and to sharply reduce the power consumption of lamps without having to prepare a vast number of turning-off programs one by one. If the handle covers HC10 and HC20 are all kept in an open state, the setting of the lamps 1 to 8 to be turned on or off upon pushing the operation panel SWa', SWb', SWc' or SWd' can be efficiently and easily performed with the setting communications device 50.

The setting program may further include contents with which some of the lamps are turned off for a forenotice purpose earlier than the repeated turning-off time. This makes it possible to give a warning or forenotice on the forthcoming turning-off of lamps to a user, thereby urging the user to thoroughly manage the turning-off of lamps.

The time period between the repeated turning-off start time and the repeated turning-off end time specified in the setting programs can be changed by the setting operation units, e.g., the first operation unit and the second operation unit. This makes it possible to realize the repeated turning-off of lamps depending on the user's management environment.

The turning-off time interval of lamps in the setting programs can be reduced by the setting operation units, e.g., the first operation unit and the second operation unit. This makes it possible to shorten the repeated turning-off time interval depending on the user's management environment, thereby reducing the power consumption.

In case where the setting contents (e.g., the operation parameters) of the setting programs (the turning-off program PRa and the repeated turning-off programs PRb) previously stored in the memory 160 are changed and renewed by the illumination control terminal 14', the terminal control unit 150 outputs the changed and renewed contents of the setting programs to the transmission unit 9. This makes it possible to synchronize the setting programs stored in the illumination control terminal 14' with the setting programs stored in the transmission unit 9.

In the second embodiment described above, the repeated turning-off programs PRb shown in FIG. 20B include the contents with which the lamps of the control targets (groups) are normally turned off in a specified turning-off time interval between the repeated turning-off start time and the repeated turning-off end time. In addition, a repeated forenotice turning-off program including the contents with which the lamps of the control targets (groups) are turned off for a forenotice purpose in a specified turning-off time interval between the repeated turning-off start time and the repeated turning-off end time may be stored in the memory 160. By referring to the repeated forenotice turning-off program stored in the memory 160, the terminal control unit 150 may turn off the lamps for a forenotice purpose in a specified turning-off time interval during the time period set by the repeated forenotice turning-off program.

Figure 34A:
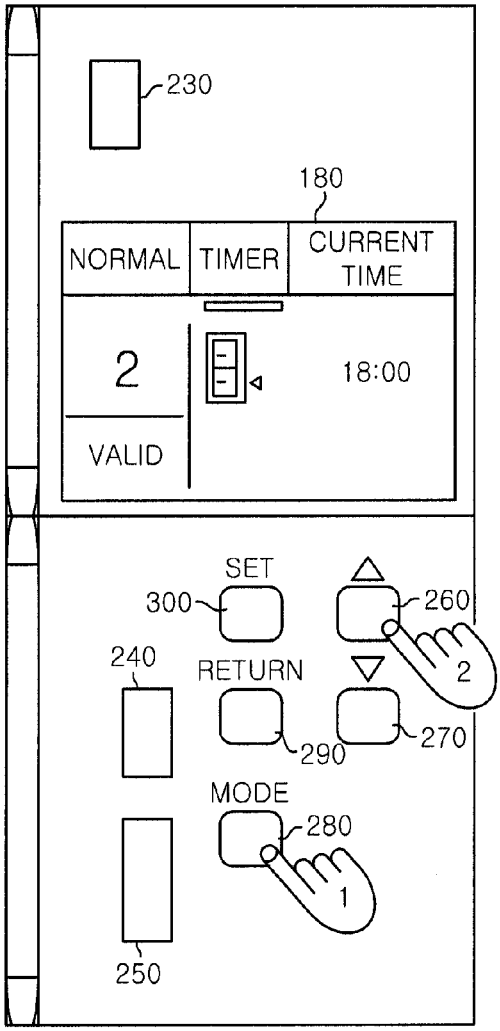
FIGS. 34A and 34B illustrate examples of screen images available when selecting a user mode with a mode selection button and changing a flag in a desired turning-off program, FIG. 34A being a screen image showing how to select the desired turning-off program and the flag in the user mode, and FIG. 34B being a screen image showing how to set the flag thus selected.
Figure 34B:
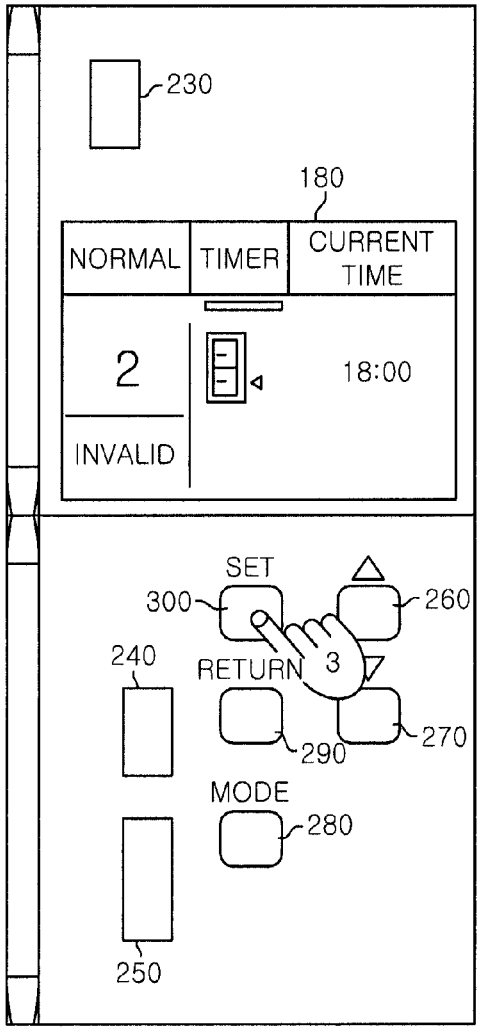
Figure 35:
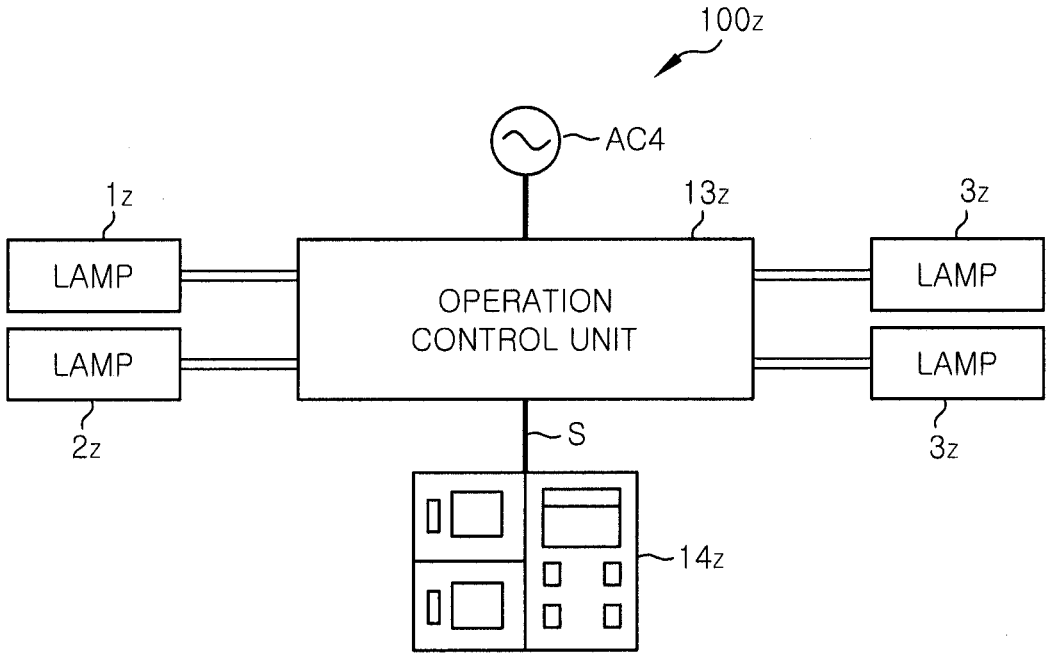
FIG. 35 (PRIOR ART)
FIG. 35 is an explanatory view showing the configuration of a conventional illumination control system.

In addition to the second embodiment described above, the authority to change the setting programs may be given to each user of the illumination control terminal 14' in order to assure information security of the setting programs (the turning-off programs PRa and the repeated turning-off programs PRb). For example, a manufacturer that manufactures and sells the illumination control terminal 14' is given a manufacturer mode in which the manufacturer is authorized to prepare and change the setting programs. A middleman, e.g., an electric engineer, who purchases the illumination control terminal 14' from the manufacturer and resells it to a user, is given a middleman mode in which the middleman is authorized to merely change the setting programs. A user (e.g., an office dweller) who actually manages and uses the illumination control terminal 14' is given a user mode in which the user is authorized to merely change over the valid and invalid states of the setting programs. FIGS. 34A and 34B are explanatory views showing how to select and set the flag of the setting program that can be operated by a user in case where the user mode is given. FIG. 34A is a screen image showing how to select the timer mode A and the desired turning-off program with the mode selection button 280. FIG. 34B is a screen image showing how to set the flag of the setting program thus selected. As shown in FIG. 34A, the increment button 260 is pushed while the timer mode A is selected by pushing the mode selection button 280 through the finger operation 1.

Thus, the turning-off program PRa of program number 2 thus selected is displayed to be "valid". If the increment button 260 is pushed through the finger operation 2 as shown in FIG. 34A and if the setting button 300 is pushed through the finger operation 3, the turning-off program PRa of program number 2 thus selected is displayed to be "invalid". By giving the authority to change the setting programs to each user of the illumination control terminal 14', it is possible to reliably assure information security of the setting programs.

Figure 19:
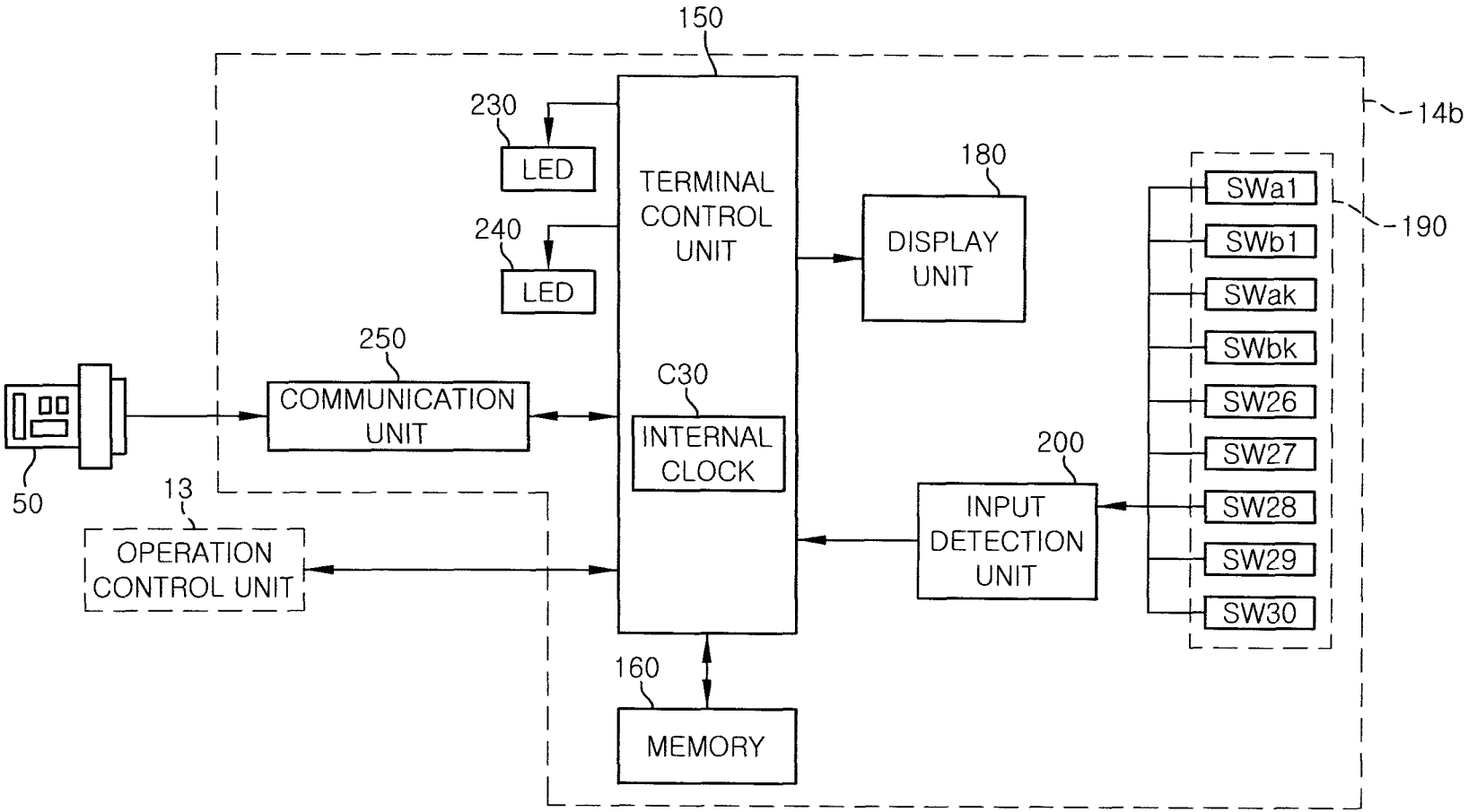
FIG. 19 is a block diagram showing an internal configuration of an illumination control terminal of the second embodiment.

Upon receiving from the setting communications device 50 a control signal on the new registration of the normally turned-off program, one of the turning-off programs PRa shown in FIGS. 20A and 20B, the terminal control unit 150 shown in FIG. 19 newly registers the normally turned-off program. Along with this new registration, a program with which some of the control target lamps to be normally turned off are turned off for a forenotice purpose, e.g., 5 min earlier than the normal turning-off time of the newly registered program, may be automatically generated and stored in the memory 160.

In the first and second embodiments described above, the illumination control terminal 14 (or 14') includes the communications unit 25 (or 250) provided on the front surface of the frame K (or K10) for receiving the setting program to be stored in the memory 16 (or 160) from the setting communications device 50 as an external terminal. The terminal control unit 150 causes the memory 16 (or 160) to sore the setting program received by the communications unit 25 (or 250). Provision of the communications unit 25 (or 250) makes it possible for the illumination control terminal 14 (or 14') to newly prepare, and store in the memory 16 (or 160), a vast number of setting programs in an efficient manner with no operation of the illumination control terminal 14 (or 14') but through the operation of the setting communications device 50.

In the first and second embodiments described above, the illumination control system 100 (or 100') includes the illumination control terminal 14 (or 14') for outputting a control signal and the operation control unit 13 for controlling the on/off operation of the lamps 1 to 8 in response to the control signal outputted by the illumination control terminal 14 (or 14'). This makes it possible to provide an illumination control system including the illumination control terminal 14 (or 14'), which is capable of efficiently and easily performing the setting of the lamps turned on or off upon pushing one of the operation panels and capable of saving the installation area of the illumination control terminal 14 (or 14').

In the description made above, if the switch SWa0 (or SWa1) is pushed while the handle cover HC1 (or HC10) of the first operation unit remains in a closed state, the illumination control terminal 14 (or 14') outputs a control signal for turning on or off the lamps of the groups set in FIG. 5 (or FIGS. 20A and 20B). If the handle cover HC1 (or HC10) remains in an open state and if the current time coincides with the set time of one of the setting programs illustrated in FIG. 5 (or FIGS. 20A and 20B), the illumination control terminal 14 (or 14') outputs a control signal corresponding to the setting program. As an alternative example, only if the current time coincides with the set time of one of the setting programs illustrated in FIG. 5 (or FIGS. 20A and 20B), the illumination control terminal 14 (or 14') may output a control signal corresponding to the setting program even if the switch SWa0 (or SWa1) is not pushed while the handle cover HC1 (or HC10) remains in a closed state.

In the description made above, the locking portion KC1 (or KC10) is arranged on the rear surface of the handle cover HC1 (or HC10) and the locked portion HKC1 (or HKC10) is arranged on the front surface of the frame K (or K10) in order to keep the handle cover HC1 (or HC10) in a closed state. As an alternative example, the handle cover HC1 (or HC10) may be kept in a closed state by using a permanent magnet as the locked portion HKC1 (or HKC10) and a magnetic material as the locking portion KC1 (or KC10). This alternative configuration may be employed to keep the handle cover HC2 (or HC20) in a closed state. As a further alternative unit for keeping the handle cover HC1 (or HC10) in a closed state through engagement of the locking portion KC1 (or KC10) and the locked portion HKC1 (or HKC10), a touch panel may be provided in a partial area of the front surface of the handle cover HC1 (or HC10). If the touch panel is pushed, the terminal control unit 15 (or 150) determines that the handle cover HC1 (or HC10) needs to be brought into a closed state. In this case, the terminal control unit 15 (or 150) causes an electronic circuit (not shown) to keep the handle cover HC1 (or HC10) in a closed state. The touch panel may be provided in the handle cover HC2 (or HC20).

In the description made above, the communications unit (or 250) is arranged on the front surface of the frame K (or K10) of the second operation unit. Alternatively, the communications unit 25 (or 250) may be arranged on the front surface of the frame K (or K10) of the first operation unit.

Even when the handle cover HC2 (or HC20) is kept in an open state, the communications unit 25 (or 250) may receive a control signal transmitted from the setting communications device 50 through infrared communications or other communications.

In case where one of the lamps 1 to 4 is turned off for a forenotice purpose, the LED lamp 23 (or 230) may flicker to notify the forenotice turning-off. Similarly, the LED lamp 24 (or 240) may be configured to flicker to notify the forenotice turning-off of lamps.

While the invention has been shown and described with respect to the embodiments, it will be understood by those skilled in the art that various changes and modification may be made without departing from the scope of the invention as defined in the following claims.

What is claimed is:

1. An illumination control terminal, comprising:

a frame with a pivot shaft extending in a longitudinal direction;

a handle cover pivotably attached to the frame for rotating about the pivot shaft;

an operation switch unit arranged on a front surface of the handle cover for, when pushed, turning on or off lamps;

a setting operation unit arranged on a rear surface of the handle cover for setting a set time at which the lamps are turned on or off, the handle cover including a locking portion arranged on the rear surface thereof to keep the handle cover in a closed state;

a display unit arranged on a front surface of the frame for displaying setting contents set by the setting operation unit, the frame including a locked portion arranged on the front surface thereof to keep the handle cover in the closed state through engagement with the locking portion;

a storage unit storing a setting program set by the setting operation unit; and a terminal control unit for outputting a control signal on an on/off operation of the lamps, either upon pushing the operation switch unit or according to the setting program in case where a current time indicated by a clock built in the terminal control unit coincides with the set time of the setting program stored in the storage unit.

2. The illumination control terminal of claim 1, wherein the setting program set by the setting operation unit includes contents with which all or some of the lamps are collectively turned off at a specified turning-off time.

3. The illumination control terminal of claim 2, wherein the setting program set by the setting operation unit includes contents with which some of the lamps are turned off earlier than the specified turning-off time.

4. The illumination control terminal of claim 2, wherein the setting operation unit is designed for use in setting the specified turning-off time.

5. The illumination control terminal of claim 2, wherein the setting operation unit is designed for use in extending the specified turning-off time.

6. The illumination control terminal of claim 1, further comprising:

a notification unit for notifying an on/off state of the lamps.

7. The illumination control terminal of claim 1, further comprising:

a communications unit arranged on the front surface of the frame for receiving the setting program from an external terminal, the terminal control unit being designed to store the setting program received by the communications unit in the storage unit.

8. An illumination control system, comprising:

the illumination control terminal of claim 1; and an operation control unit for controlling the on/off operation of the lamps in response to the control signal outputted from the illumination control terminal.

9. An illumination control terminal, comprising:

a frame with a pivot shaft extending in a longitudinal direction;

a handle cover pivotally attached to the frame for rotation about the pivot shaft;

an operation switch unit arranged on a front surface of the handle cover for, when pushed, turning on or off lamps;

a locking portion arranged on a rear surface the handle cover to keep the handle cover in a closed state;

a setting operation unit arranged on a front surface of the frame for setting a set time at which the lamps are turned on or off;

a display unit arranged on a front surface of the frame for displaying setting contents set by the setting operation unit, the frame including a locked portion arranged on the front surface thereof to keep the handle cover in the closed state through engagement with the locking portion;

a storage unit for storing a setting program set by the setting operation unit; and a terminal control unit for outputting a control signal on an on/off operation of the lamps, either upon pushing the operation switch unit or according to the setting program in case where a current time indicated by a clock built in the terminal control unit coincides with the set time of the setting program stored in the storage unit, wherein the setting program includes contents with which all or some of the lamps are repeatedly turned off in a specified time interval during a specified time period.

10. The illumination control terminal of claim 9, wherein the setting program further includes contents with which some of the lamps are turned off for a forenotice purpose earlier than the repeated turning-off time.

11. The illumination control terminal of claim 9, wherein the setting operation unit is designed for use in changing the specified time period.

12. The illumination control terminal of claim 10, wherein the setting operation unit is designed for use in reducing the specified time interval.

13. The illumination control terminal of claim 9, further comprising:

a communications unit arranged on the front surface of the frame for receiving the setting program from an external terminal, the terminal control unit being designed to store the setting program received by the communications unit in the storage unit.

14. An illumination control system, comprising:

an illumination control terminal including: a frame with a pivot shaft extending in a longitudinal direction; a handle cover pivotally attached to the frame for rotation about the pivot shaft; an operation switch unit arranged on a front surface of the handle cover for, when pushed, turning on or off lamps, the handle cover including a locking portion arranged on a rear surface thereof to keep the handle cover in a closed state; a setting operation unit arranged on a front surface of the frame for setting a set time at which the lamps are turned on or off; a display unit arranged on a front surface of the frame for displaying setting contents set by the setting operation unit, the frame including a locked portion arranged on the front surface thereof to keep the handle cover in the closed state through engagement with the locking portion; a storage unit for storing a setting program set by the setting operation unit; and a terminal control unit for outputting a control signal on an on/off operation of the lamps, either upon pushing the operation switch unit or according to the setting program in case where a current time indicated by a clock built in the terminal control unit coincides with the set time of the setting program stored in the storage unit; and an operation control unit for controlling the on/off operation of the lamps in response to the control signal outputted from the illumination control terminal, wherein the setting program includes contents with which all or some of the lamps are repeatedly turned off in a specified time interval during a specified time period.

* * * * *